US011400575B2

(12) United States Patent
Tanaka

(10) Patent No.: US 11,400,575 B2
(45) Date of Patent: Aug. 2, 2022

(54) PNEUMATIC TOOL

(71) Applicant: MAX CO., LTD., Tokyo (JP)

(72) Inventor: Hiroshi Tanaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 65 days.

(21) Appl. No.: 16/797,563

(22) Filed: Feb. 21, 2020

(65) Prior Publication Data

US 2020/0269404 A1 Aug. 27, 2020

(30) Foreign Application Priority Data

Feb. 22, 2019 (JP) ..... JP2019-030820
Feb. 22, 2019 (JP) ..... JP2019-030821
Feb. 22, 2019 (JP) ..... JP2019-030822
Feb. 22, 2019 (JP) ..... JP2019-030823
Feb. 22, 2019 (JP) ..... JP2019-030824

(51) Int. Cl.
*B25C 1/04* (2006.01)

(52) U.S. Cl.
CPC ..... *B25C 1/047* (2013.01); *B25C 1/045* (2013.01); *B25C 1/046* (2013.01)

(58) Field of Classification Search
CPC ..... B25C 1/042; B25C 1/043; B25C 1/045; B25C 1/046; B25C 1/047; B25C 1/06
USPC ..... 227/130; 173/218, 169
See application file for complete search history.

(56) References Cited

U.S. PATENT DOCUMENTS 1,942,784 A * 1/1934 Terrill ..... B25B 21/00 173/218
2,857,596 A * 10/1958 Allen ..... B25C 5/1665 227/123
3,023,413 A * 3/1962 Fischer ..... B25C 1/04 227/112
3,369,287 A * 2/1968 Brochetti ..... B25B 27/026 29/252
5,772,096 A 6/1998 Osuka et al.
6,123,241 A * 9/2000 Walter ..... B25C 1/08 123/46 SC
6,223,966 B1 * 5/2001 Nayrac ..... B25C 1/08 227/130
6,247,626 B1 * 6/2001 MacVicar ..... B25C 1/08 227/8
6,695,193 B1 * 2/2004 Chang ..... B25C 1/041 227/130

(Continued)

FOREIGN PATENT DOCUMENTS

CN 106891297 A 6/2017
EP 2062691 A1 5/2009
JP 3287172 B2 3/2002

OTHER PUBLICATIONS

The Extended European Search Report mailed in corresponding EP Patent Application No. 201585395 dated Jul. 20, 2020.

*Primary Examiner* — Joshua G Kotis
(74) *Attorney, Agent, or Firm* — Weihrouch IP

(57) ABSTRACT

A pneumatic tool includes a drive mechanism configured to be actuated by a pneumatic pressure of compressed air, a body housing having the drive mechanism embedded therein, a grip housing connected to the body housing, and an electromagnetic valve configured to control supply of the compressed air to the drive mechanism, wherein the electromagnetic valve is arranged on an opposite side to the body housing, as seen in an extension direction of the grip housing.

15 Claims, 37 Drawing Sheets

(56) References Cited

U.S. PATENT DOCUMENTS

| | | | | |
|---|---|---|---|---|
| 6,695,194 | B1 * | 2/2004 | Chang | B25C 1/043 227/130 |
| 7,494,035 | B2 * | 2/2009 | Weaver | B25C 1/04 173/217 |
| 7,766,205 | B2 * | 8/2010 | Calvet | B25C 1/08 227/8 |
| 7,950,557 | B2 * | 5/2011 | Fujiyama | B25C 1/047 227/130 |
| 8,893,670 | B2 * | 11/2014 | Kosuge | B25C 1/08 123/46 H |
| 8,936,104 | B2 * | 1/2015 | Rothenwaender | A61C 1/003 173/1 |
| 2002/0035876 | A1 * | 3/2002 | Donaldson, Jr. | B25B 23/1453 73/862.21 |
| 2010/0200260 | A1 * | 8/2010 | Mikami | B25B 21/00 173/176 |
| 2011/0107881 | A1 * | 5/2011 | Nelson | B25B 23/1453 81/470 |
| 2014/0264204 | A1 * | 9/2014 | Kittell | B25C 11/00 254/133 R |
| 2018/0117748 | A1 * | 5/2018 | Ishikawa | B25C 1/06 |
| 2019/0111552 | A1 * | 4/2019 | Nagao | B25C 7/00 |
| 2019/0270190 | A1 * | 9/2019 | Tanaka | B25C 1/00 |

* cited by examiner

PNEUMATIC TOOL

CROSS-REFERENCE TO RELATED APPLICATIONS

This application is based upon and claims the benefit of priority from prior Japanese patent application No. 2019-030820, filed on Feb. 22, 2019, Japanese patent application No. 2019-030821, filed on Feb. 22, 2019, Japanese patent application No. 2019-030822, filed on Feb. 22, 2019, Japanese patent application No. 2019-030823, filed on Feb. 22, 2019, and Japanese patent application No. 2019-030824, filed on Feb. 22, 2019, the disclosures of which are incorporated herein in their entirety by reference, and priority is claimed to each of the foregoing.

TECHNICAL FIELD

The present invention relates to a pneumatic tool configured to be actuated by a pneumatic pressure of compressed air, and more particularly, to a pneumatic tool for which an electromagnetic valve is used.

BACKGROUND ART

In general, a variety of tools are widely used as a pneumatic tool configured to be actuated by a pneumatic pressure of compressed air. For example, a nailing machine is practically provided in which when a trigger is pulled, the compressed air is caused to rapidly flow into an upper part of a piston, the piston is impulsively actuated by a pressure of the compressed air and a nail is thus struck out. The nailing machine is configured such that, when a nose part is pressed to a material to be struck, a contact member as a safety device is slid, and when the trigger is operated in a slid state of the contact member, the nail is struck out.

However, according to the nailing machine, when the contact member or the trigger moves to a predetermined position, a valve is mechanically actuated to switch an inflow path of the compressed air. For this reason, an inflow timing of the compressed air is influenced depending on how to arrange the contact member or the trigger, a speed at which an operator operates the contact member or the trigger, and the like, so that it is difficult to control a striking timing. For example, in a case of so-called "contact striking" in which the contact member is pressed to the material to be struck and a nail is struck in a pulled state of the trigger, an aspect that the operator feels recoil and the operability change, depending on how far the contact member is pushed in for striking the nail. In order to improve the aspect that the operator feels and the operability, it is desired to finely control an actuation timing of the machine.

In order to meet the desire, for example, it is considered to use an electromagnetic valve disclosed in Patent Literature 1. That is, when an electromagnetic valve configured to be electrically actuated by a switch is used, since the machine is actuated at the time when the switch is pushed, it is possible to easily control the actuation timing of the machine.

Patent Literature 1: Japanese Patent No. 3,287,172B

As disclosed in Patent Literature 1, when the electromagnetic valve is used for the pneumatic tool, it is problematic where to arrange electric components such as the electromagnetic valve. A trouble such as breakage of a component, disconnection and the like may occur due to impact upon actuation of the machine, depending on the arrangement place of the electric component.

Also, when the electromagnetic valve is arranged in a place that is easily affected by the impact, a movable iron core of the electromagnetic valve is moved due to the impact, so that a malfunction may be caused. The malfunction can be prevented by setting a high load for a spring for pressing the movable iron core, for example. However, the spring load is set high, a high force is required so as to actuate the movable iron core against the spring load, which in turn enlarges the electromagnetic valve (coil) and increases power consumption.

As disclosed in Patent Literature 1, when the electromagnetic valve is used for the pneumatic tool, it is necessary to add the electric components such as an electromagnetic valve, a control substrate and the like to a pneumatic tool of the related art. However, at present, no solution is found for the arrangement and wiring method of the electric components, so that it is difficult to realize a pneumatic tool for which an electromagnetic valve is used.

For example, an attaching property and a maintenance property are significantly deteriorated, depending on the arrangement and wiring method of the electric components.

Also, a structure of an existing pneumatic tool for which the electric components are not used is largely changed, which lowers the production efficiency and increases the cost.

As disclosed in Patent Literature 1, when the electromagnetic valve is used for the pneumatic tool, if the electronic component malfunctions due to any cause, the pneumatic tool may be actuated even though there is no operator's operation.

As disclosed in Patent Literature 1, when the electromagnetic valve is used for the pneumatic tool, it is necessary to set a control substrate, which is configured to control the actuation of the electromagnetic valve, to an energization state when in use. However, if the control substrate is set to the energization state all the time, standby power is consumed even when not in use. Therefore, in order to suppress the power consumption, a machine of which a main power supply can be turned on or off or a machine that shifts to a power-saving state when not in use is provided.

However, according to the machine of which the main power supply is turned on or off by the operator, the operator may forget to turn off the main power supply. Also, according to the machine that shifts to a power-saving state when not in use, weak current continues to flow through the control substrate even when not in use. Therefore, the electricity is uselessly consumed.

The present invention is to provide a pneumatic tool capable of easily controlling an actuation timing of a machine by using an electromagnetic valve and preventing a malfunction without enlarging the electromagnetic valve.

The present invention is to provide a pneumatic tool capable of implementing control of an actuation timing by using an electromagnetic valve without significantly deteriorating an attaching property and a maintenance property.

The present invention is to provide a pneumatic tool capable of preventing an unintentional operation to increase safety in a structure where an electromagnetic valve is used so as to control supply of compressed air to a drive mechanism.

The present invention is to provide a pneumatic tool capable of implementing power saving by suppressing useless energization when not in use in a configuration where an electromagnetic valve is used.

SUMMARY OF INVENTION

According to an aspect of the invention, there is provided a pneumatic tool comprising a drive mechanism configured to be actuated by a pneumatic pressure of compressed air, a body housing having the drive mechanism embedded therein, a grip housing connected to the body housing, and an electromagnetic valve configured to control supply of the compressed air to the drive mechanism, wherein the electromagnetic valve is arranged on an opposite side to the body housing, as seen in an extension direction of the grip housing.

BRIEF DESCRIPTION OF DRAWINGS

FIGS. 2A and 2B are sectional views of an electromagnetic valve, in which FIG. 2A depicts a closed state of the electromagnetic valve and FIG. 2B depicts an opened state of the electromagnetic valve.

FIGS. 9A and 9B are partially enlarged sectional views in the vicinity of an operation part in accordance with the first modified example, in which FIG. 9A depicts a state before operation and FIG. 9B depicts a state after operation.

FIGS. 11A and 11B depict the second modified example, in which FIG. 11A is a sectional view of a control unit and FIG. 11B is a sectional view of an air-type control unit.

FIGS. 32A and 32B depict a structure in the vicinity of a joint in accordance with a modified example of the fourth embodiment, in which FIG. 32A depicts a state before the plug is mounted and FIG. 32B depicts a state after the plug is mounted.

FIGS. 35A, 35B and 35C are partially enlarged sectional views in the vicinity of a brightness sensor, in which FIG. 35A depicts a state in which the brightness sensor is exposed, FIG. 35B depicts a state in which the brightness sensor is covered with a finger, and FIG. 35C depicts a state in which the brightness sensor is covered with a cover.

FIGS. 36A and 36B are partially enlarged sectional views in the vicinity of a brightness sensor in accordance with a first modified example of the fifth embodiment, in which FIG. 36A depicts a state in which the brightness sensor is exposed and FIG. 36B depicts a state in which the brightness sensor is covered with a slide member.

FIGS. 37A and 37B are partially enlarged sectional views in the vicinity of a brightness sensor in accordance with a second modified example of the fifth embodiment, in which FIG. 37A depicts a state in which the brightness sensor is exposed to an opening and FIG. 37B depicts a state in which the brightness sensor is covered with a slide member.

DESCRIPTION OF EMBODIMENTS

First Embodiment

A first embodiment of the present invention will be described with reference to FIGS. 1 to 14. In the meantime, in descriptions below, a striking-out direction of a nail (a downward direction, in FIG. 3) is referred to as a downward direction, an opposite direction (an upward direction, in FIG. 3) to the downward direction is referred to as an upward direction, a direction of a body housing 12 (a leftward direction, in FIG. 3), as seen from an extension direction D1 of a grip housing 25, is referred to as a forward direction, and an opposite direction (a rightward direction, in FIG. 3) to the forward direction is referred to as a rearward direction.

Figure 1:
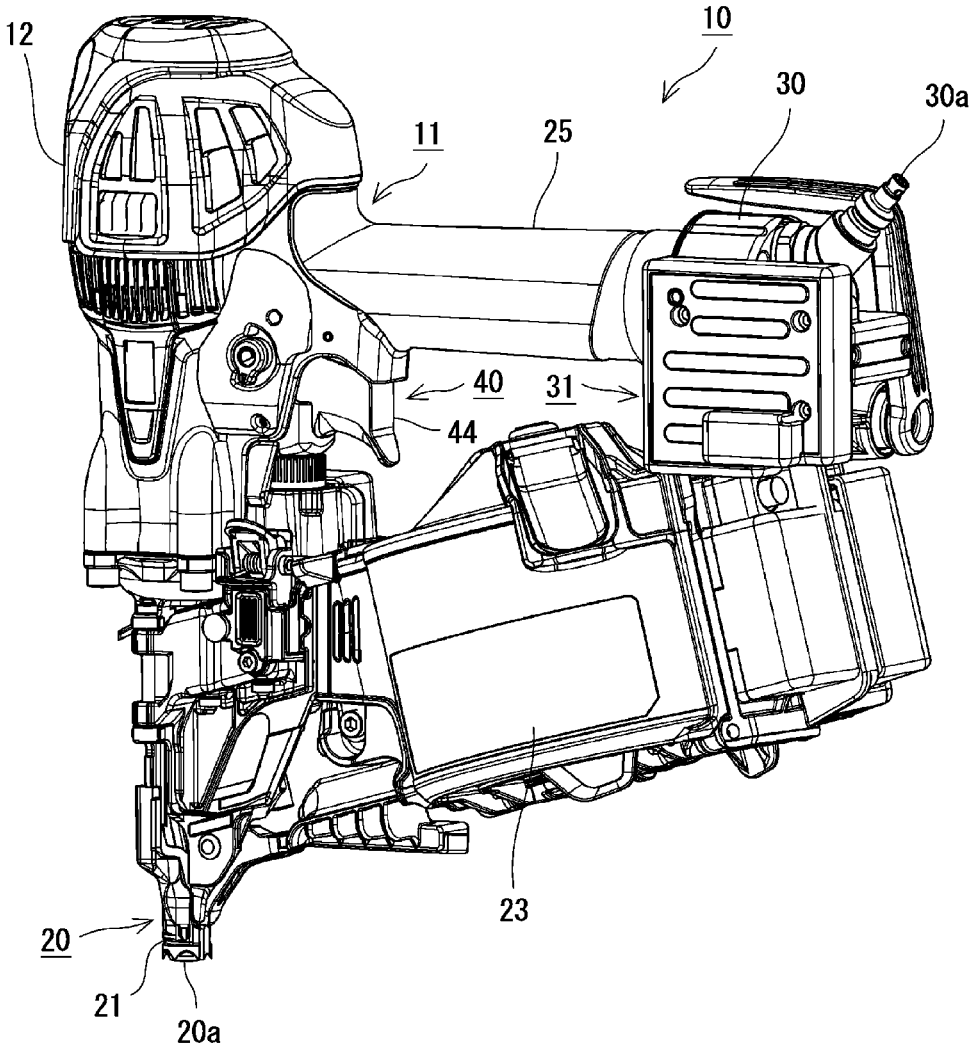
FIG. 1 depicts an outer appearance of a pneumatic tool in accordance with the present invention.

A pneumatic tool 10 in accordance with the present embodiment is a nailing machine as shown in FIG. 1 configured to be actuated by a pneumatic pressure of compressed air supplied from an outside, for example. In the meantime, in the present embodiment, the nailing machine is exemplified as the pneumatic tool 10. However, the pneumatic tool 10 is not limited to the nailing machine, and other tools may also be possible. For example, a tool such as a screw fastener configured to be actuated by compressed air is also possible.

As shown in FIG. 1, the pneumatic tool 10 has a tool main body 11 of which a grip housing 25 is substantially perpendicularly coupled to a body housing 12.

The body housing 12 is a tubular member having a drive mechanism 13 accommodated therein. A tip end portion of the body housing 12 is provided with a nose part 20 that is to be pressed to a material to be struck. The nose part 20 is connected to a magazine 23 in which coupled nails are accommodated, and a head nail of the coupled nails loaded in the magazine 23 is supplied to the nose part 20 by a supply device. The nail supplied to the nose part 20 is struck out from an ejection port 20*a* provided to a tip end of the nose part 20 by a driver 16 (which will be described later) at the time when the drive mechanism 13 is actuated.

Figure 4:
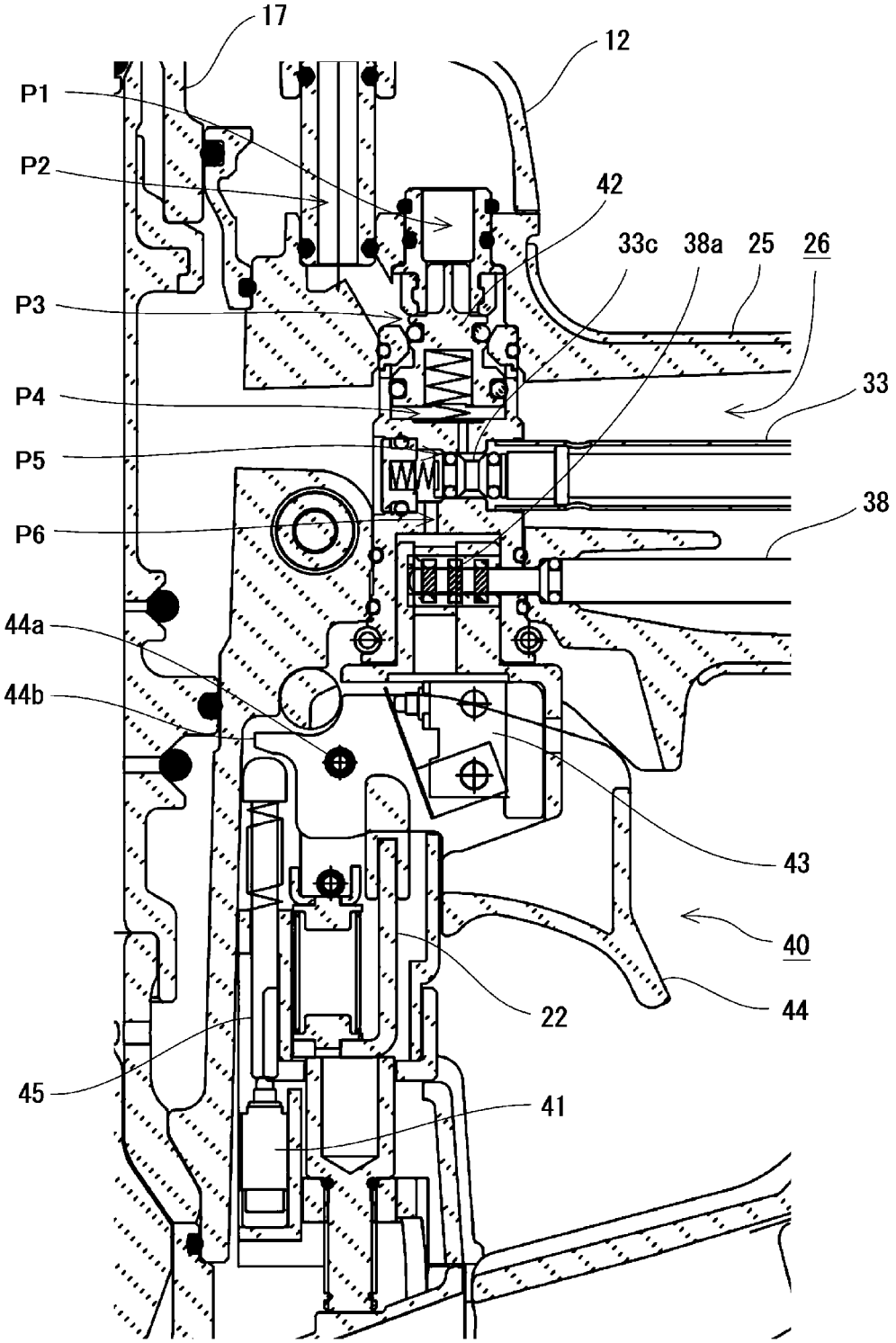
FIG. 4 is a partially enlarged sectional view of the pneumatic tool before the drive mechanism is actuated.
Figure 6:
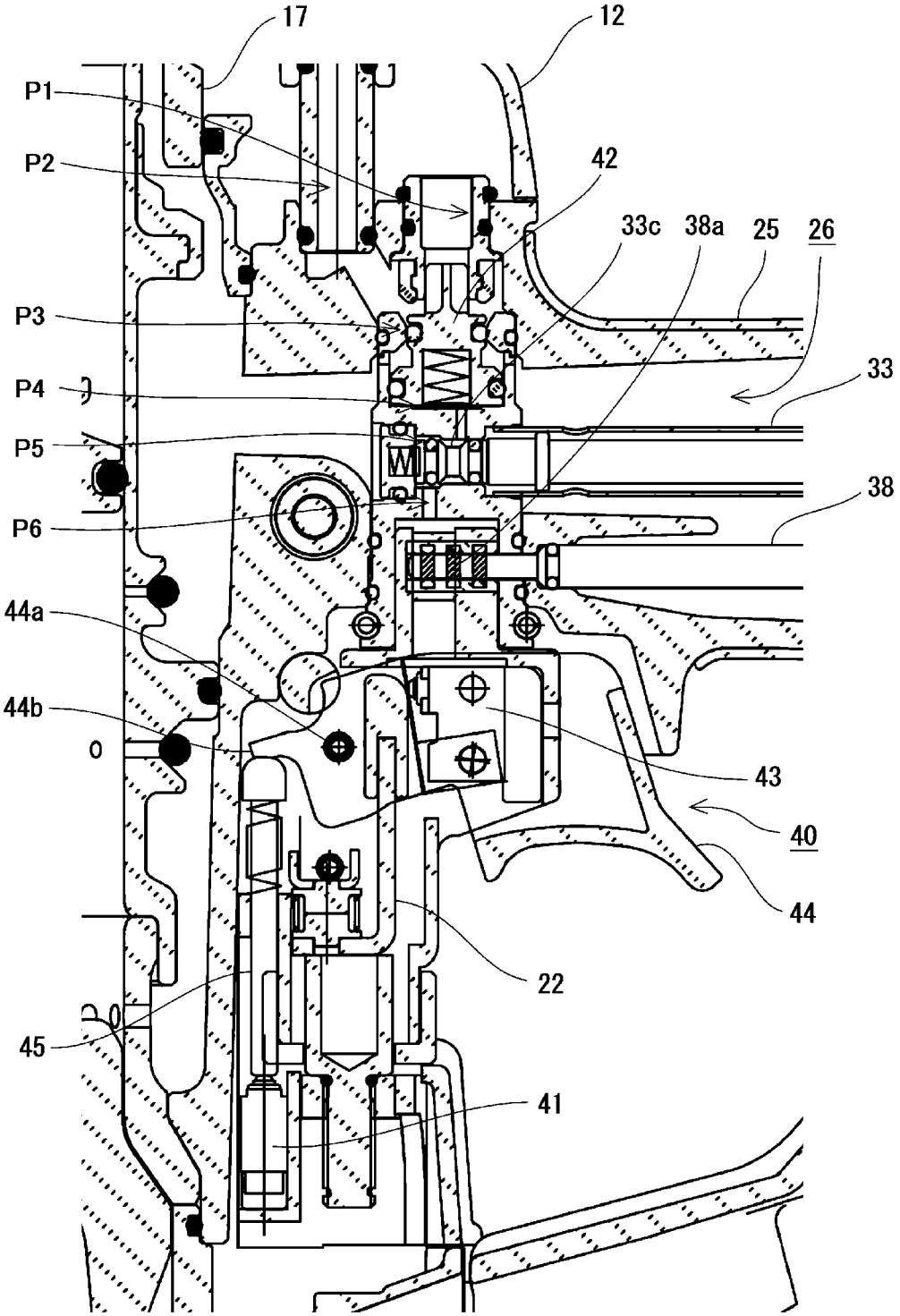
FIG. 6 is a partially enlarged sectional view of the pneumatic tool while the drive mechanism is being actuated.

A contact member 21 that can be slid in a striking-out direction of the nail is attached to the nose part 20. The contact member 21 is urged to protrude from the nose part 20 in a natural state, and is pushed and slid inward when the nose part 20 is pressed to the material to be struck. When the contact member 21 is slid, a contact arm 22 coupled to the contact member 21 is integrally slid. As shown in FIGS. 4 and 6, the contact arm 22 extends to a position in which a contact switch 43 (which will be described later) can be pressed. For this reason, when the contact member 21 is pushed and the contact arm 22 is thus slid, the contact arm 22 presses the contact switch 43 whereby it is detected that the nose part 20 is pressed against the material to be struck.

Figure 3:
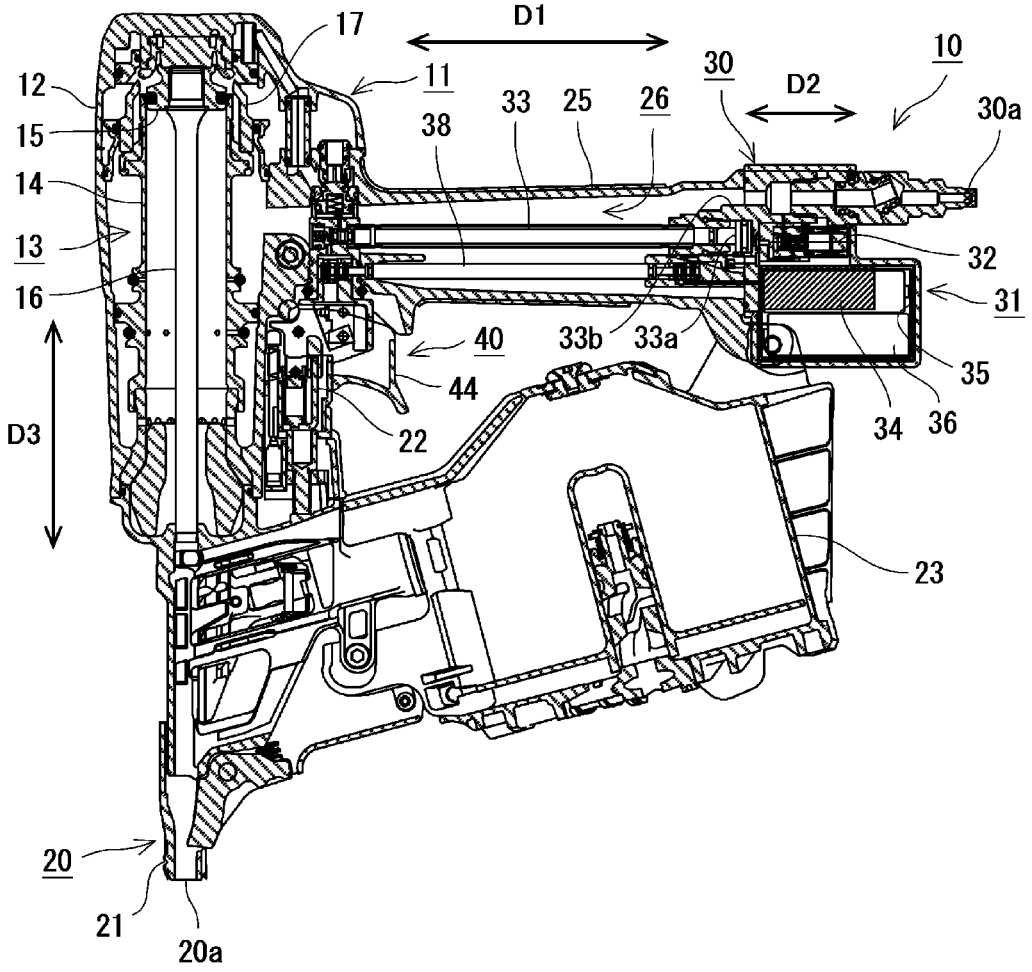
FIG. 3 is a sectional view of a pneumatic tool in accordance with a first embodiment of the present invention, before a drive mechanism is actuated.
Figure 5:
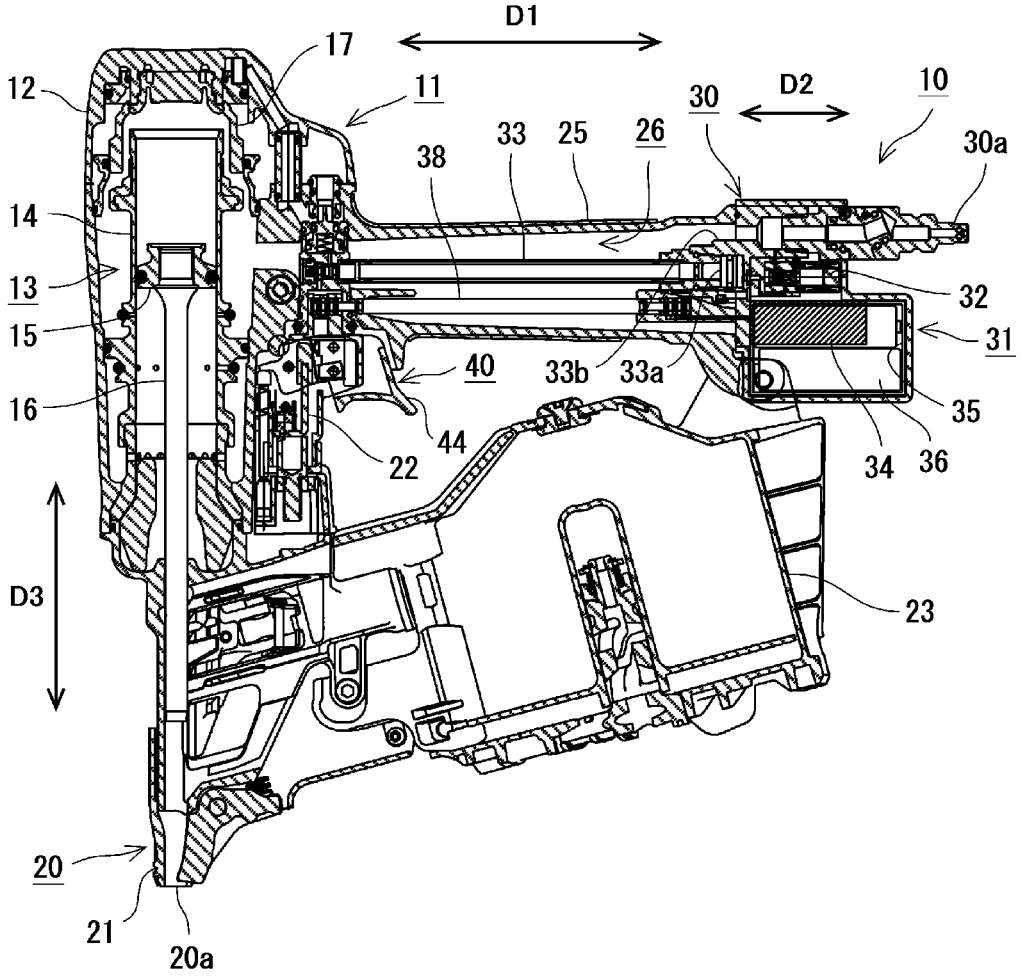
FIG. 5 is a sectional view of the pneumatic tool while the drive mechanism is being actuated.

As shown in FIGS. 3 and 5, the drive mechanism 13 in accordance with the present embodiment is actuated while sliding a piston 15 by the pneumatic pressure of the compressed air. The piston 15 is slidably arranged in a cylinder 14, and is impulsively slid toward the nose part 20 when the compressed air is caused to flow into an upper part of the piston 15. A driver 16 configured to slide integrally with the piston 15 is coupled to a lower part of the piston 15. The driver 16 is slidably arranged in the nose part 20, and can strike out the nail standing by in the nose part 20 toward the ejection port 20*a*.

The inflow of the compressed air for actuating the piston 15 is controlled by a head valve 17 arranged to cover an upper opening of the cylinder 14. As shown in FIG. 3, in a state in which the drive mechanism 13 is not actuated, the head valve 17 is located below, so that the inflow of the compressed air into the upper part of the piston 15 is prevented. On the other hand, as shown in FIG. 5, when the drive mechanism 13 is actuated, the head valve 17 is moved upward to communicate the cylinder 14 and a main chamber 26 (which will be described later) each other, so that the inflow of the compressed air into the upper part of the piston 15 is permitted. When the compressed air is caused to flow into the upper part of the piston 15, the piston 15 is impulsively slid downward by the pressure of the compressed air, so that the nail is struck out by the driver 16 coupled to the piston 15.

The grip housing 25 connected to the body housing 12 has a rod shape that can be gripped by the operator. Also, an operation part 44 that can be pulled with an index finger of the operator is provided in a position in which the index finger is put when the operator grips the grip housing 25. When the operation part 44 is operated, a switch 41 for an electromagnetic valve attached to the drive mechanism 13 becomes on, so that an operation signal is output to a control substrate 34 (which will be described later). The control substrate 34 actuates an electromagnetic valve 32 (which will be described later) by using the operation signal as a trigger.

An inside of the grip housing 25 is formed as a space as shown in FIG. 3. By the space, a main chamber 26 in which the compressed air is stored is formed. The compressed air supplied from an outside is stored in the main chamber 26 and is used to strike out the nail, for example.

Also, a grip end member 30 for closing the main chamber 26 is attached to a rear end portion of the grip housing 25 (an end portion on an opposite side to the body housing 12). The grip end member 30 is detachably mounted to the grip housing 25. The grip end member 30 is provided with a tube joint 30*a* to which a plug 56 of a hose 55 is detachably mounted. The hose 55 connected to an external air supply source (an air compressor or the like) is connected to the tube joint 30*a*, so that the compressed air can be supplied to the main chamber 26.

In the present embodiment, a control unit 31 is integrally attached to the grip end member 30. The control unit 31 is to control the drive mechanism 13, and includes an electromagnetic valve 32, a valve stem 33, a control substrate 34, a power supply terminal 35, and an electric connecting rod 38, as shown in FIG. 3. In the meantime, the control unit 31 may include at least the electromagnetic valve 32, the control substrate 34 and the power supply terminal 35, and the other configurations may be changed as appropriate, considering arrangement of components, and the like.

Figure 2A:
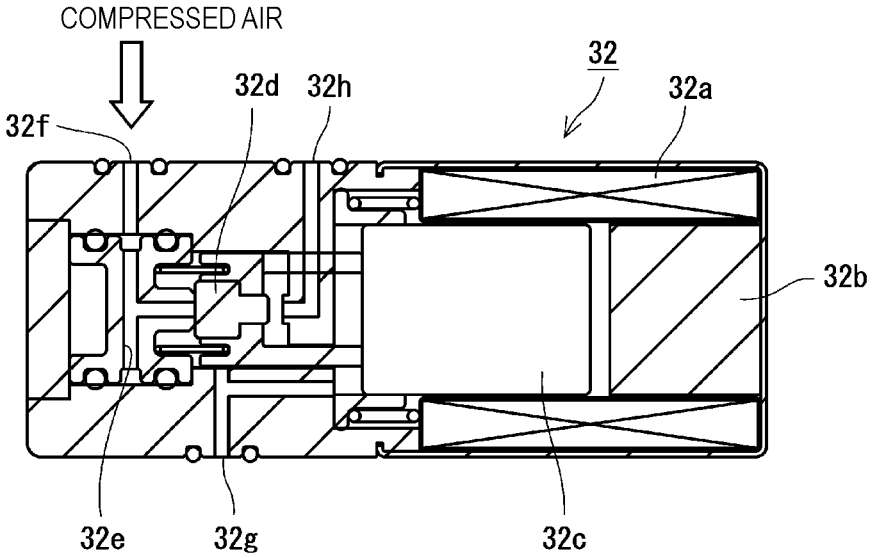
Figure 2B:
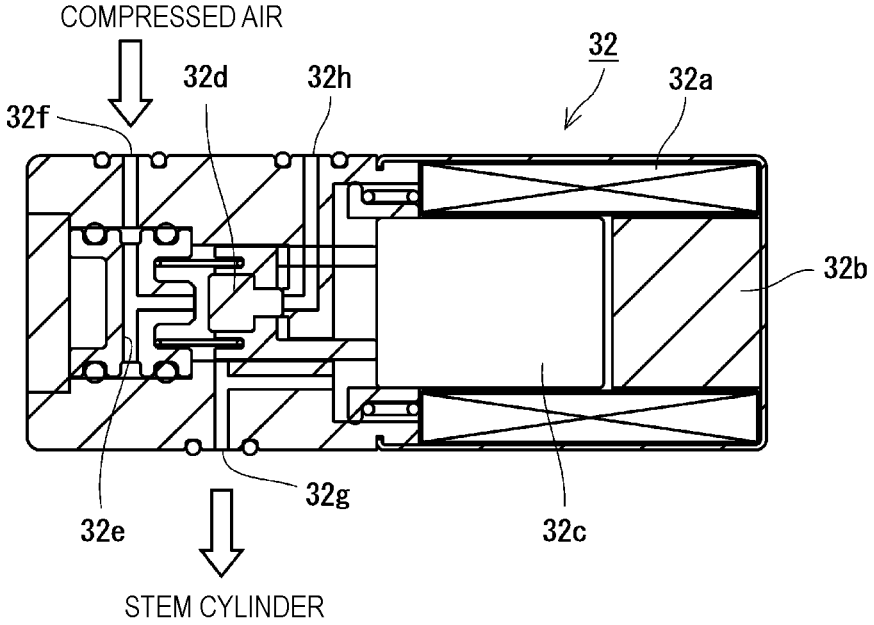

The electromagnetic valve 32 is to control supply of the compressed air to the drive mechanism 13. As shown in FIGS. 2A and 2B, the electromagnetic valve 32 has a coil 32*a*, a fixed iron core 32*b*, a movable iron core 32*c*, and an air flow path 32*e*.

The air flow path 32*e* is to cause the compressed air to pass through an inside of the electromagnetic valve 32. An air inlet 32*f* that is an opening upstream of the air flow path 32*e* communicates with the main chamber 26. For this reason, the compressed air stored in the main chamber 26 is always supplied to the air inlet 32*f*. Also, an air outlet 32*g* that is an opening downstream of the air flow path 32*e* communicates with a stem cylinder 33*b*, which will be described later. Also, a path that is branched from the air flow path 32*e* and communicates with an exhaust port 32*h* is formed. The exhaust port 32*h* is formed to communicate with an outside (atmosphere) of the pneumatic tool 10.

In a state in which no current flows through the coil 32*a*, the movable iron core 32*c* is urged away from the fixed iron core 32*b* by a spring, as shown in FIG. 2A, so that a valve body 32*d* configured to operate in conjunction with the movable iron core 32*c* sets the air flow path 32*e* to a closed state. In the closed state, the compressed air supplied from the air inlet 32*f* on the upstream side is not supplied to the air outlet 32*g* on the downstream side.

On the other hand, when current flows through the coil 32*a*, the movable iron core 32*c* is moved toward the fixed iron core 32*b* against the urging force of the spring, as shown in FIG. 2B. Thereby, the valve body 32*d* is moved in conjunction with the movable iron core 32*c*, thereby shifting the air flow path 32*e* to an opened state. In the opened state, the compressed air supplied from the air inlet 32*f* on the upstream side is supplied to the air outlet 32*g* on the downstream side. The air outlet 32*g* communicates with the stem cylinder 33*b*, which will be described later, and the compressed air supplied from the air outlet 32*g* to the stem cylinder 33*b* is used so as to move the valve stem 33.

In the meantime, when the current does not flow through the coil 32*a* any more and the air flow path returns from the opened state to the closed state, the movable iron core 32*c* is returned away from the fixed iron core 32*b* by the spring, as shown in FIG. 2A. Thereby, the air flow path 32*e* is closed and the air outlet 32*g* and the exhaust port 32*h* communicate with each other. For this reason, the compressed air supplied to the stem cylinder 33*b* is exhausted from the exhaust port 32*h*. Thereby, the atmospheric pressure in the stem cylinder 33*b* is lowered, and the valve stem 33 that is slid by the pressure of the compressed air is returned to its original position.

The valve stem 33 is a rod-shaped member protruding from the grip end member 30. When the grip end member 30 is attached to the grip housing 25, the valve stem 33 is arranged inside of the grip housing 25 along the extension direction D1 of the grip housing 25. The valve stem 33 is supported to be slidable in a longitudinal direction of the grip housing 25, and is configured to be actuated in conjunction with the electromagnetic valve 32, depending on whether or not the compressed air to be supplied from the electromagnetic valve 32.

Specifically, the valve stem 33 in accordance with the present embodiment has a stem piston 33*a* on a rear end side (the grip end member 30-side). The stem piston 33*a* is arranged to be slidable inside of a stem cylinder 33*b* fixed to the grip end member 30. As described above, when the electromagnetic valve 32 becomes on (opened state) and the compressed air is supplied into the stem cylinder 33*b*, the stem piston 33*a* is pressed by the pressure of the compressed air and the valve stem 33 is slid toward the body housing 12. On the other hand, when the electromagnetic valve 32 becomes off (closed state), i.e., the compressed air is not supplied into the stem cylinder 33*b*, the pressure by the compressed air is not applied, so that the valve stem 33 is urged by the spring and stands by on the grip end member 30-side.

On the tip end-side (the body housing 12-side) of the valve stem 33, an air switching part 33*c* functioning as a valve for switching the supply path of the compressed air is provided. As described above, the valve stem 33 is moved in the extension direction D1 of the grip housing 25, so that the air switching part 33*c* is moved from a standby position shown in FIGS. 3 and 4 to an actuation position shown in FIGS. 5 and 6. The air switching part 33*c* is moved in this way, so that the actuation of the head valve 17 is controlled.

Specifically, the pneumatic tool 10 in accordance with the present embodiment includes a pilot valve 42 for controlling movement of the head valve 17. The pilot valve 42 is configured to be actuated in conjunction with the electromagnetic valve 32 so as to switch the flow path of the compressed air, and is provided between an upper space P2 of the head valve 17 and the main chamber 26.

As shown in FIG. 4, when the air switching part 33*c* is located in the standby position, a lower space P4 of the pilot valve 42 communicates with the main chamber 26 in a position denoted with P5. Therefore, the compressed air is caused to flow into the lower space P4 of the pilot valve 42 and the pilot valve 42 is moved upward by the pressure of the compressed air (although the compressed air is supplied to the upper and lower parts of the pilot valve 42, a force of pushing up the pilot valve 42 is set higher by a difference between pressure-receiving areas). In the state in which the pilot valve 42 is moved upward in this way, the upper space P2 of the head valve 17 and the main chamber 26 communicate with each other and the upper space P2 of the head valve 17 and the exhaust path P1 are disconnected from each other, in a position denoted with P3. For this reason, the compressed air is caused to flow into the upper space P2 of the head valve 17, and the head valve 17 is moved downward by the pressure of the compressed air (although the compressed air is supplied to the upper and lower parts of the head valve 17, a force of pushing down the head valve 17 is set higher by a difference between pressure-receiving areas). In the state in which the head valve 17 is moved downward, the inflow of the compressed air into the upper part of the piston 15 is blocked, so that the drive mechanism 13 is not actuated.

In the meantime, as shown in FIG. 6, when the air switching part 33*c* is moved to the actuation position, the lower space P4 of the pilot valve 42 is disconnected from the main chamber 26 and the lower space P4 of the pilot valve 42 communicates with the exhaust path P6, in the position P5. For this reason, the compressed air in the lower space P4 of the pilot valve 42 is exhausted from the exhaust path P6, so that the atmospheric pressure in the lower space P4 of the pilot valve 42 is lowered. When the atmospheric pressure in the lower space P4 of the pilot valve 42 is lowered, the pilot valve 42 is moved downward by a pressure difference between the upper and lower parts of the pilot valve 42. When the pilot valve 42 is moved downward in this way, the upper space P2 of the head valve 17 and the main chamber 26 are disconnected from each other and the upper space P2 of the head valve 17 and the exhaust path P1 communicate with each other, as shown in a position P3. For this reason, the compressed air in the upper space P2 of the head valve 17 is exhausted from the exhaust path P1, so that the atmospheric pressure in the upper space P2 of the head valve 17 is lowered. When the atmospheric pressure in the upper space P2 of the head valve 17 is lowered, the head valve 17 is moved upward by a pressure difference between the upper and lower parts of the head valve 17. When the head valve 17 is moved upward, the compressed air is caused to rapidly flow into the upper part of the piston 15, so that the drive mechanism 13 is actuated.

Like this, in the present embodiment, when the electromagnetic valve 32 is actuated, the valve stem 33, the pilot valve 42 and the head valve 17 are accordingly actuated sequentially, so that the drive mechanism 13 is actuated. Also, the valve stem 33 is moved in the longitudinal direction of the grip housing 25, so that the supply of the compressed air to the drive mechanism 13 is executed. For this reason, even when the electromagnetic valve 32 and the drive mechanism 13 are respectively arranged at both ends of the grip housing 25, an actuation timing of the drive mechanism 13 can be controlled by the electromagnetic valve 32.

The control substrate 34 is to control actuations of electric components such as the electromagnetic valve 32. The control substrate 34 has a circuit for executing processing by using an input of an electric signal as a trigger. In the present embodiment, a switch 41 for an electromagnetic valve and a contact switch 43 are connected to an input-side of the control substrate 34. Also, the electromagnetic valve 32 is connected to an output-side of the control substrate 34. When it is detected that both the switch 41 for an electromagnetic valve and the contact switch 43 become on, the control substrate 34 executes control of switching the electromagnetic valve 32 to an on state by causing current to flow through the coil 32*a* of the electromagnetic valve 32.

The power supply terminal 35 is a terminal for receiving power, and is provided to connect a power supply for feeding power to the electric components such as the control substrate 34 and the electromagnetic valve 32. Since the pneumatic tool 10 in accordance with the present embodiment is driven by a battery 36, the power supply terminal 35 in accordance with the present embodiment is configured as a terminal for connecting the battery 36. For example, as shown in FIG. 3, the power supply terminal 35 may be provided inside of a case configured to accommodate the battery 36, and a terminal of the battery 36 and the power supply terminal 35 may be electrically connected to each other when the battery 36 is accommodated in the case. In the meantime, the shape of the power supply terminal 35 is not limited to the aspect as shown in FIG. 3, and a variety of shapes of the related art can also be used.

The electric connecting rod 38 is a rod-shaped member that is provided to protrude from the grip end member 30 in substantially parallel to the valve stem 33. The electric connecting rod 38 is arranged inside of the grip housing 25 along the extension direction D1 of the grip housing 25 when the grip end member 30 is attached to the grip housing 25.

Figure 7:
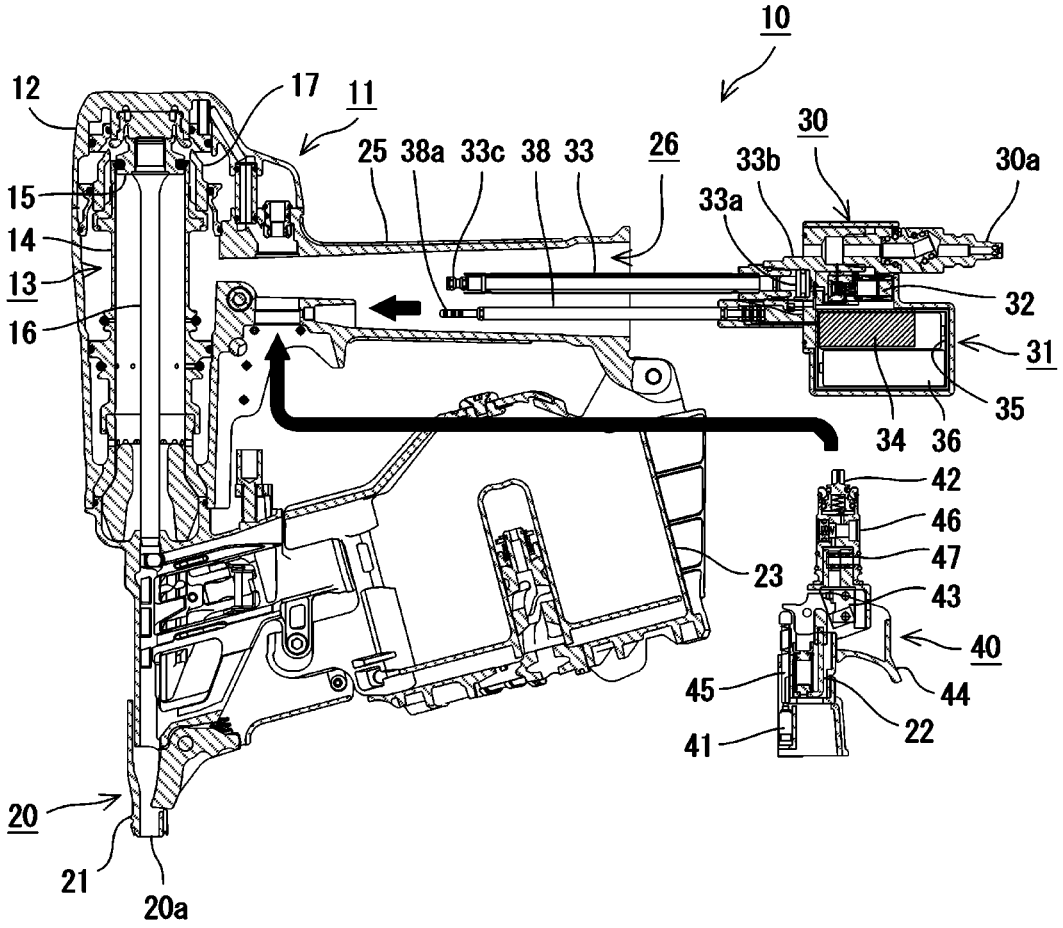
FIG. 7 is a sectional view of the pneumatic tool from which a control unit and an activation unit are detached.

The electric connecting rod 38 can conduct electricity, and is electrically connected to the battery 36 and the control substrate 34 at a rear end. Also, as shown in FIG. 7, a tip end of the electric connecting rod 38 is provided with a contact point portion 38*a*. The contact point portion 38*a* is a terminal that can be used for power feeding to an activation unit 40, which will be described later, and transmission and reception of an electric signal to and from the activation unit 40. The contact point portion 38*a* is connected to the activation unit 40, so that the switch 41 for an electromagnetic valve and the contact switch 43 are electrically connected to the battery 36 and the control substrate 34. That is, the control substrate 34 can detect that the switch 41 for an electromagnetic valve and the contact switch 43 are pushed. In this way, in the present embodiment, the electric components can be interconnected without a wiring.

As shown in FIG. 7, the components such as the electromagnetic valve 32, the valve stem 33, the control substrate 34, the power supply terminal 35, the electric connecting rod 38 and the like are unitized to configure the control unit 31, and the control unit 31 can be detachably mounted integrally to the tool main body 11. That is, the control unit 31 can be mounted to the tool main body 11 simply by attaching the grip end member 30 to an end portion of the grip housing 25.

In the meantime, in the present embodiment, the activation unit 40 in which components relating to the operation part 44 are unitized is provided separately from the control unit 31. As shown in FIG. 7, the activation unit 40 in accordance with the present embodiment includes the switch 41 for an electromagnetic valve, the pilot valve 42, the contact switch 43, and the operation part 44. In the meantime, the activation unit 40 may include at least the switch 41 for an electromagnetic valve and the pilot valve 42, and the other configurations may be changed as appropriate, considering arrangement of components, and the like.

The switch 41 for an electromagnetic valve and the contact switch 43 are micro switches for switching the opened and closed states of the electromagnetic valve 32. As described above, when both the switch 41 for an electromagnetic valve and the contact switch 43 become on, the electromagnetic valve 32 becomes on (opened state).

As shown in FIG. 4, the operation part 44 in accordance with the present embodiment is provided to be swingable about a swinging shaft 44*a* in the activation unit 40. The operation part 44 is configured so that it swings to press the switch 41 for an electromagnetic valve when it is pulled by the operator. Specifically, as shown in FIG. 6, when the operator pulls the operation part 44 with a finger, a pressing portion 44*b* of the tip end of the operation part 44 pushes down a rod-shaped driven member 45. Since the driven member 45 is arranged so that a tip end thereof faces toward the switch 41 for an electromagnetic valve, the switch 41 for an electromagnetic valve is pushed by the tip end of the driven member 45.

As shown in FIG. 7, the activation unit 40 is provided with a stem connection part 46 and a rod connection part 47, The stem connection part 46 is to insert and connect a tip end of the valve stem 33. The tip end (the air switching part 33*c*) of the valve stem 33 is inserted into the stem connection part 46, so that the air switching part 33*c* can be incorporated to an air path in the activation unit 40. Thereby, the valve stem 33 can be incorporated on the drive mechanism 13-side without using a screw and the like. Also, even though the electromagnetic valve 32 is arranged on the grip end member 30-side, the drive mechanism 13 can be actuated in conjunction with the electromagnetic valve 32. Also, when detaching the control unit 31, the valve stem 33 has only to be taken out from the stem connection part 46. That is, it is possible to easily perform a maintenance operation.

Also, the rod connection part 47 is to insert and connect a tip end of the electric connecting rod 38. The tip end (the contact point portion 38*a*) of the electric connecting rod 38 is inserted into the rod connection part 47, so that the activation unit 40 and the control unit 31 can be electrically connected to each other. Thereby, the electric components such as the switch 41 for an electromagnetic valve can be connected to the power supply and the control substrate 34 without using a wiring. Also, even though the control substrate 34 and the power supply terminal 35 are arranged on the grip end member 30-side, the electromagnetic valve 32 can be actuated by using push signals of the switch 41 for an electromagnetic valve and the contact switch 43 as a trigger. Also, when detaching the control unit 31, the electric connecting rod 38 has only to be taken out from the rod connection part 47. That is, it is possible to easily perform a maintenance operation.

The activation unit 40 is detachably mounted integrally to the tool main body 11. That is, when the activation unit 40 is just attached to an opening formed in a lower part of the grip housing 25, all components configuring the activation unit 40 are attached to the tool main body 11. In the meantime, an attaching direction of the activation unit 40 is orthogonal to an attaching direction of the control unit 31 (the extension direction D1 of the grip housing 25). After the activation unit 40 is attached to the tool main body 11, the control unit 31 is attached to the tool main body 11, so that the tip end of the valve stem 33 and the tip end of the electric connecting rod 38 are inserted into the stem connection part 46 and the rod connection part 47.

In this way, in the present embodiment, the control unit 31 and the activation unit 40 can be individually attached to the tool main body 11 and can be interconnected inside of the tool main body 11. Also, since the control unit 31 and the activation unit 40 can be easily interconnected, the attaching and detaching operations can be easily performed.

As described above, in the pneumatic tool 10 in accordance with the present embodiment, the electromagnetic valve 32 is arranged on the opposite side to the body housing 12, as seen in the extension direction D1 of the grip housing 25. For this reason, the electromagnetic valve 32 can be arranged in a position distant from the drive mechanism 13 from which impact is generated. Also, since the electromagnetic valve 32 is arranged on a front side (an opposite side to the drive mechanism 13) of a hand gripping the grip housing 25, the impact from the drive mechanism 13 is buffered by the hand gripping the grip housing 25 before the impact is transmitted to the electromagnetic valve 32. Therefore, even when the impact is generated upon the actuation of the drive mechanism 13, it is possible to reduce an influence of the impact on the electromagnetic valve 32.

In the meantime, the electromagnetic valve 32 is preferably arranged in a position closer to the grip end member 30 than the body housing 12 (so that a distance from the grip end member 30 to the electromagnetic valve 32 is closer than a distance from the body housing 12 to the electromagnetic valve 32), as seen in the extension direction D1 of the grip housing 25.

More preferably, the electromagnetic valve 32 is arranged on a further opposite side to the body housing 12 than a grip part of the grip housing 25 (a part that is assumed to be gripped by the operator), as seen in the extension direction D1 of the grip housing 25. For example, when the electromagnetic valve 32 is attached to the end portion (the grip end member 30) of the grip housing 25, like the present embodiment, the electromagnetic valve 32 can be arranged at the rear of the grip part of the grip housing 25. With this arrangement, it is possible to reduce an influence of impact on the electromagnetic valve 32.

In the meantime, in the present embodiment, the electromagnetic valve 32 is attached to the grip end member 30. However, the present invention is not limited thereto. For example, the electromagnetic valve 32 may be attached to any place inasmuch as the place is located on the opposite side to the body housing 12, as seen in the extension direction D1 of the grip housing 25. For example, the pneumatic tool 10 in accordance with the present embodiment can reduce an influence of impact on the electromagnetic valve 32 even though the electromagnetic valve 32 is arranged at a rear part of the magazine 23 (an end portion opposite to the body housing 12).

Also, as shown in FIG. 3, a moving direction D2 of the movable iron core 32*c* of the electromagnetic valve 32 in accordance with the present embodiment is arranged to be different from an occurrence direction D3 (a striking-out direction of the nail) of impact when the drive mechanism 13 is actuated. Specifically, in the present embodiment, the moving direction D2 of the movable iron core 32*c* of the electromagnetic valve 32 is arranged to be orthogonal to the occurrence direction D3 (the striking-out direction of the nail) of the impact when the drive mechanism 13 is actuated. According to this configuration, even though the impact is generated upon actuation of the drive mechanism 13, the movable iron core 32*c* cannot be moved in the impact direction, so that it is possible to prevent a malfunction caused due to movement of the movable iron core 32*c* as a result of the impact. From another point of view, since it is possible to reduce a spring load of pressing the movable iron core 32*c*, a magnetic force for actuating the movable iron core 32*c* can be set small. Therefore, it is possible to implement miniaturization of the electromagnetic valve 32 (coil 32*a*) and suppression of the power consumption by reducing a number of turns of the coil 32*a* and lowering a current value.

Also, in the present embodiment, the control substrate 34 and the power supply terminal 35 are also arranged on the opposite side to the body housing 12, as seen in the extension direction D1 of the grip housing 25. According to this configuration, even though the impact is generated upon actuation of the drive mechanism 13, it is possible to reduce an influence of the impact on the control substrate 34 and the power supply terminal 35.

In the meantime, in the present embodiment, the control substrate 34 and the power supply terminal 35 are attached to the grip end. However, the present invention is not limited thereto. For example, even when the control substrate 34 and the power supply terminal 35 are attached to the magazine 23, they can be made more difficult to receive the impact by arranging the same on the opposite side to the body housing 12.

Also, although not specifically shown, in order to relieve the impact upon actuation of the drive mechanism 13, the electronic component (the electromagnetic valve 32, the control substrate 34, the power supply terminal 35 and the like) may be attached to the tool main body 11 via a buffer material formed of an elastic material such as rubber.

As described above, the pneumatic tool 10 in accordance with the present embodiment includes the electromagnetic valve 32 for controlling supply of the compressed air to the drive mechanism 13. Therefore, since the supply of the compressed air is electrically controlled by the electromagnetic valve 32, it is possible to easily perform timing control on the drive mechanism 13.

In the meantime, in the present embodiment, the electromagnetic valve 32 for switching on and off states of the supply of the compressed air to the drive mechanism 13 is provided. However, the present invention is not limited thereto. For example, the electromagnetic valve 32 (a proportional valve) capable of controlling the valve body 32*d* may also be used in an intermediate position of the on and off positions. When the electromagnetic valve 32 is used, a flow rate can be regulated. Therefore, it is possible to regulate an output by adjusting a filling rate of the compressed air.

Also, the electromagnetic valve 32, the control substrate 34 and the power supply terminal 35 are unitized to configure the control unit 31, and the control unit 31 is detachably mounted integrally to the tool main body 11. For this reason, since the electric components can be unitized and detachably mounted, it is possible to improve the attaching property and the maintenance property. For example, since it is not necessary to wire the electric components in the main body, it is possible to avoid troublesome of the attaching and disconnection.

Also, since the control unit 31 is attached to the grip end member 30, the control unit 31 can be detachably mounted integrally with the grip end member 30, so that it is possible to improve the attaching property and the maintenance property.

Also, the switch 41 for an electromagnetic valve for switching opened and closed states of the electromagnetic valve 32 and the pilot valve 42 configured to be actuated in conjunction with the electromagnetic valve 32 so as to switch the flow path of the compressed air are unitized to configure the activation unit 40, and the activation unit 40 is detachably mounted integrally to the tool main body 11, so that it is possible to improve the attaching property and the maintenance property.

First Modified Example of First Embodiment

A first modified example of the first embodiment is described with reference to FIGS. 8 and 9. In the meantime, since the basic configurations of the present modified example are not different from the above embodiment, the overlapping descriptions are avoided and only different parts are described.

In the above embodiment, the switch 41 for an electromagnetic valve is arranged in the vicinity of the operation part 44. However, the present invention is not limited. The switch 41 for an electromagnetic valve may be arranged on the opposite side to the body housing 12, as seen in the extension direction D1 of the grip housing 25. For example, as shown in FIG. 8, the switch 41 for an electromagnetic valve may be attached to the grip end member 30. In the present modified example, the contact switch 43 is not provided. Therefore, the switch 41 for an electromagnetic valve is arranged on the grip end-side, so that the electric components are all unitized on the grip end-side.

Figure 8:
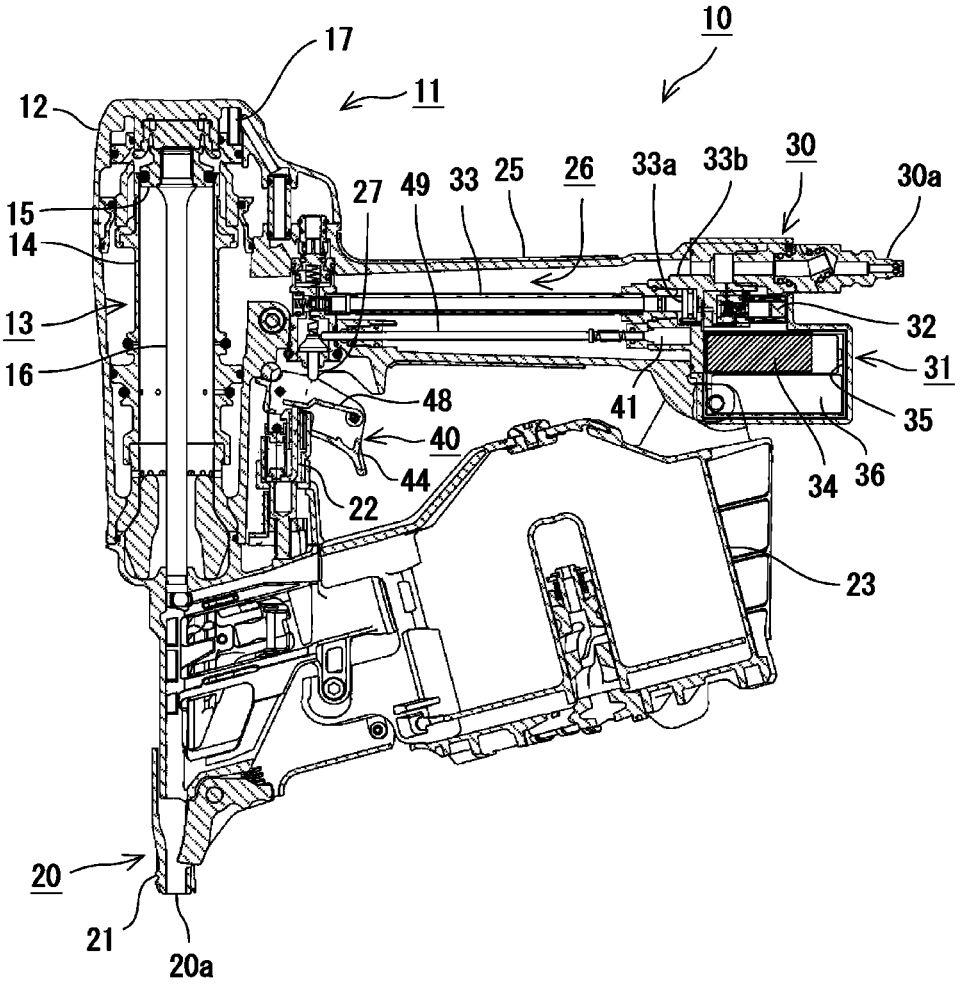
FIG. 8 is a sectional view of a tool main body in accordance with a first modified example of the first embodiment.

In the present modified example, as shown in FIG. 8, the operation part 44 is swingably attached to the tool main body 11. Also, a contact lever 48 is attached inside of the operation part 44, and a slider 27 is attached toward the contact lever 48.

Figure 9A:
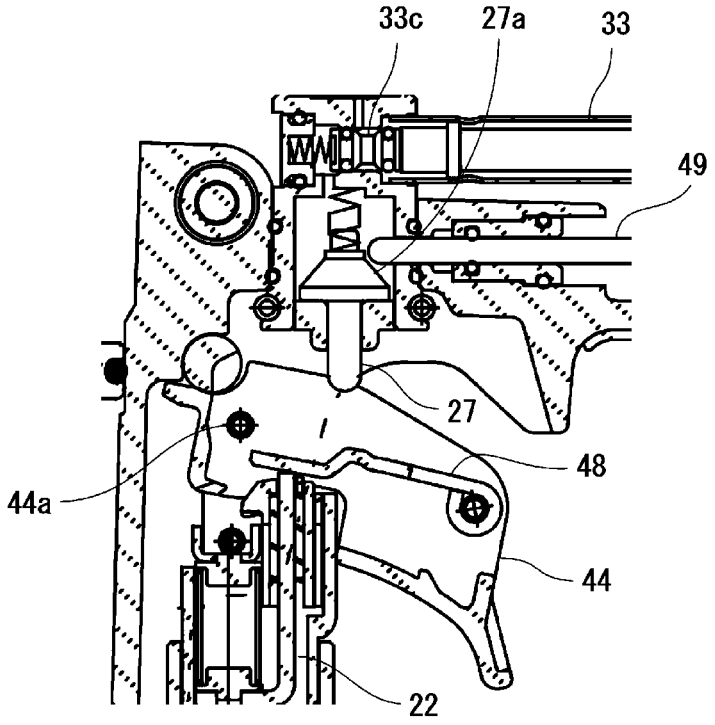
Figure 9B:
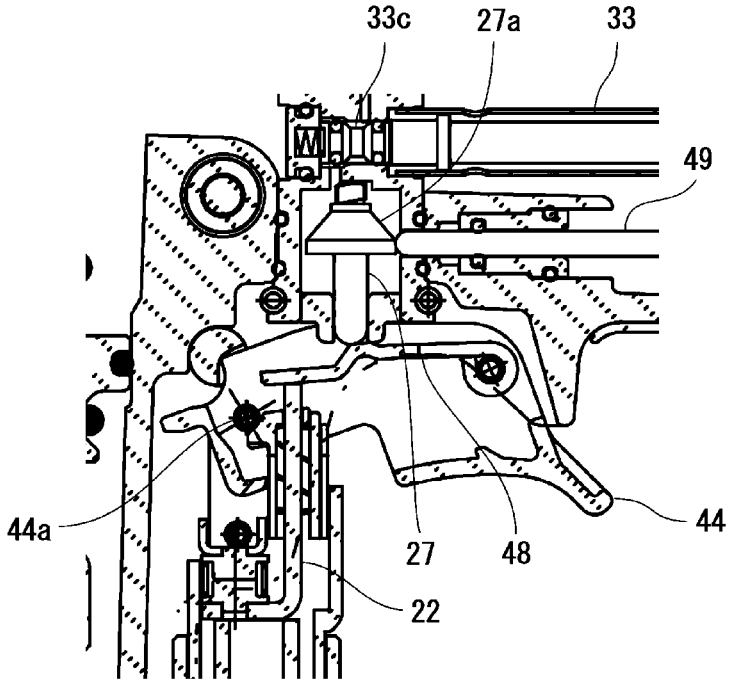

The contact lever 48 is a member attached to be swingable inside of the operation part 44. As shown in FIGS. 9A and 9B, the contact lever 48 has one end swingably attached to the operation part 44 and the other end arranged toward a tip end of the contact arm 22. For this reason, when the operation part 44 is moved upward as a result of a pulling operation and the contact member 21 is pushed in to move up the contact arm 22, both ends of the contact lever 48 are lifted. Both ends of the contact lever 48 are lifted in this way, so that the slider 27 (which will be described later) is pushed in at an intermediate part.

The slider 27 is attached to be slidable upward and downward toward an intermediate part of the contact lever 48. As shown in FIG. 9A, the slider 27 is urged to protrude downward by a spring or the like, in a natural state. Also, as shown in FIG. 9B, the slider 27 is pushed in and moved upward by the contact lever 48 only when the operation part 44 and the contact member 21 are operated at the same time. The slider 27 has a tapered portion 27*a* protruding obliquely in a slide direction. The tapered portion 27*a* is a portion for pushing and actuating a switch stem 49, which will be described later.

Also, in the present modified example, as shown in FIG. 8, the switch stem 49 is arranged, instead of the electric connecting rod 38. The switch stem 49 is a rod-shaped member protruding from the grip end member 30. The switch stem 49 is arranged in the extension direction D1 of the grip housing 25 inside of the grip housing 25 when the grip end member 30 is attached to the grip housing 25. The switch stem 49 is supported to be slidable in the longitudinal direction of the grip housing 25, and is configured to be actuated in conjunction with the slider 27.

Specifically, the switch stem 49 in accordance with the present embodiment has a front end portion facing toward the tapered portion 27*a* of the slider 27. In a state before the slider 27 is moved upward, as shown in FIG. 9A, the switch stem 49 and the tapered portion 27*a* are not in contact with each other, and the switch stem 49 protrudes forward by an urging force of the spring or the like.

When the slider 27 is moved upward from this state, the tapered portion 27*a* of the slider 27 pushes in the switch stem 49, as shown in FIG. 9B. Thereby, the switch stem 49 is slid backward against the urging force of the spring or the like. Since a rear end portion of the switch stem 49 is arranged to be press the switch 41 for an electromagnetic valve, the switch 41 for an electromagnetic valve is pressed by the switch stem 49 slid backward.

That is, when the operation part 44 and the contact member 21 are operated at the same time, the slider 27 is moved upward to push the switch stem 49 backward and the switch 41 for an electromagnetic valve is pressed by the switch stem 49 pushed backward. When the switch 41 for an electromagnetic valve is pressed, the electromagnetic valve 32 is actuated and the pilot valve 42 and the head valve 17 are actuated, like the above embodiment, so that the drive mechanism 13 is actuated to execute the striking operation.

According to the above configuration, the switch 41 for an electromagnetic valve can also be arranged on the opposite side to the body housing 12, as seen in the extension direction D1 of the grip housing 25. Therefore, even when the impact is generated upon actuation of the drive mechanism 13, it is possible to reduce an influence of the impact on the switch 41 for an electromagnetic valve.

Also, since the electric components can be all arranged on the grip end-side, there is no troublesome of the wiring and the attaching property and the maintenance property can be improved.

Second Modified Example of First Embodiment

A second modified example of the first embodiment is described with reference to FIGS. 10 to 13. In the meantime, since the basic configurations of the present modified example are not different from the above embodiment, the overlapping descriptions are avoided and only different parts are described.

In the above embodiment, the activation unit 40 is provided separately from the control unit 31. However, the present invention is not limited thereto. For example, the activation unit 40 may not be provided (or the control unit 31 may be configured to have the functions of the activation unit 40).

Figure 10:
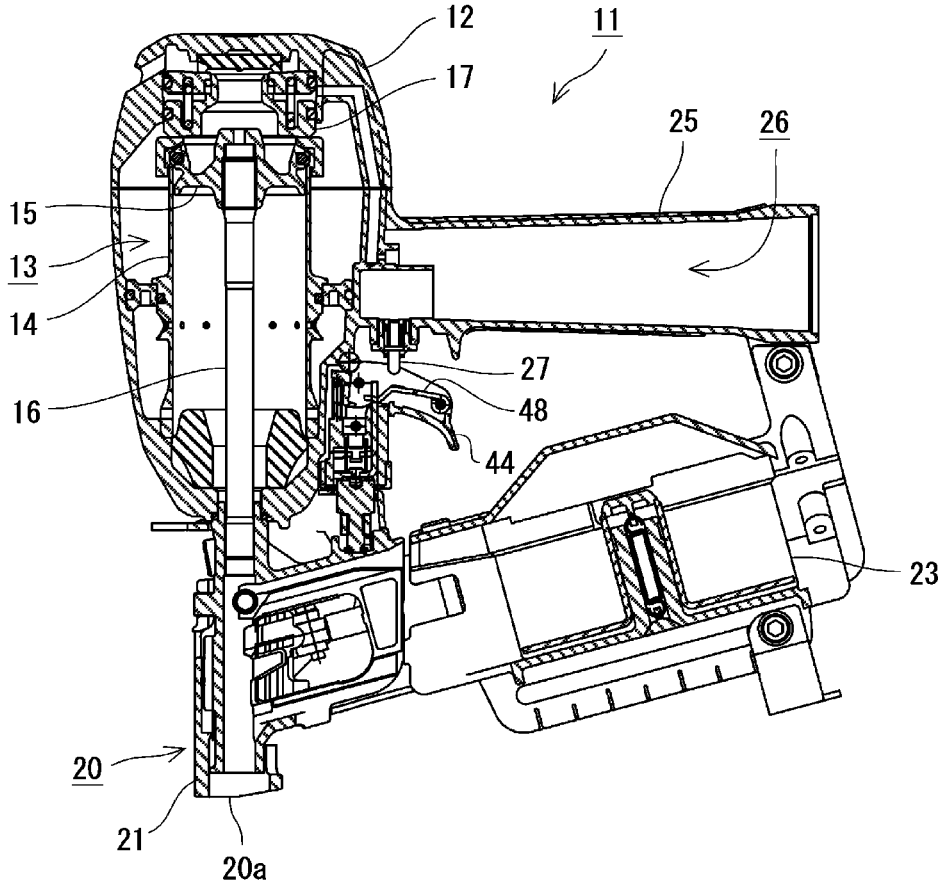
FIG. 10 is a sectional view of a tool main body in accordance with a second modified example of the first embodiment.

Specifically, in the present modified example, as shown in FIG. 10, the operation part 44 is swingably attached to the tool main body 11. Also, the contact lever 48 is attached inside of the operation part 44, and the slider 27 is attached with facing toward the contact lever 48.

The contact lever 48 is a member swingably attached inside of the operation part 44. The contact lever 48 has one end swingably attached to the operation part 44 and the other end arranged facing toward the tip end of the contact arm 22. For this reason, when the operation part 44 is moved upward as a result of a pulling operation and the contact member 21 is pushed in to move up the contact arm 22, both ends of the contact lever 48 are lifted. Both ends of the contact lever 48 are lifted in this way, so that the slider 27 (which will be described later) is pushed in at an intermediate part.

The slider 27 is attached to be slidable upward and downward toward the intermediate part of the contact lever 48. The slider 27 is urged to protrude downward by a spring or the like, in a natural state, and is pushed in and moved upward by the contact lever 48 only when the operation part 44 and the contact member 21 are operated at the same time.

Figure 11A:
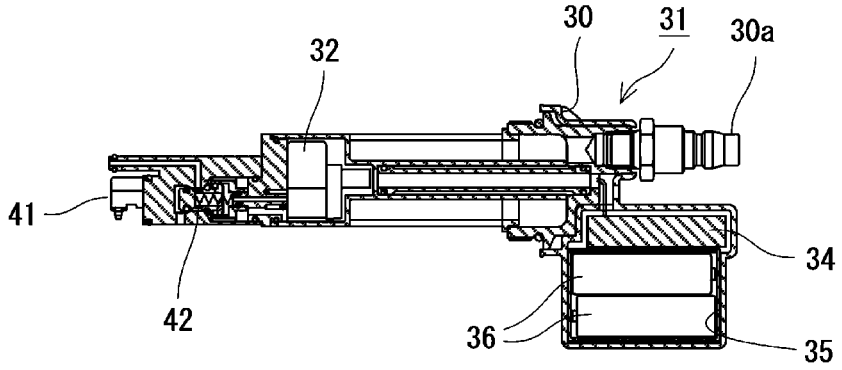

FIG. 11A depicts the control unit 31 that can be detachably mounted to the tool main body 11. The control unit 31 includes the electromagnetic valve 32, the control substrate 34, the power supply terminal 35, the switch 41 for an electromagnetic valve, and the pilot valve 42. When the control unit 31 is attached to the tool main body 11, the pneumatic tool 10 as shown in FIG. 12 is configured.

Figure 12:
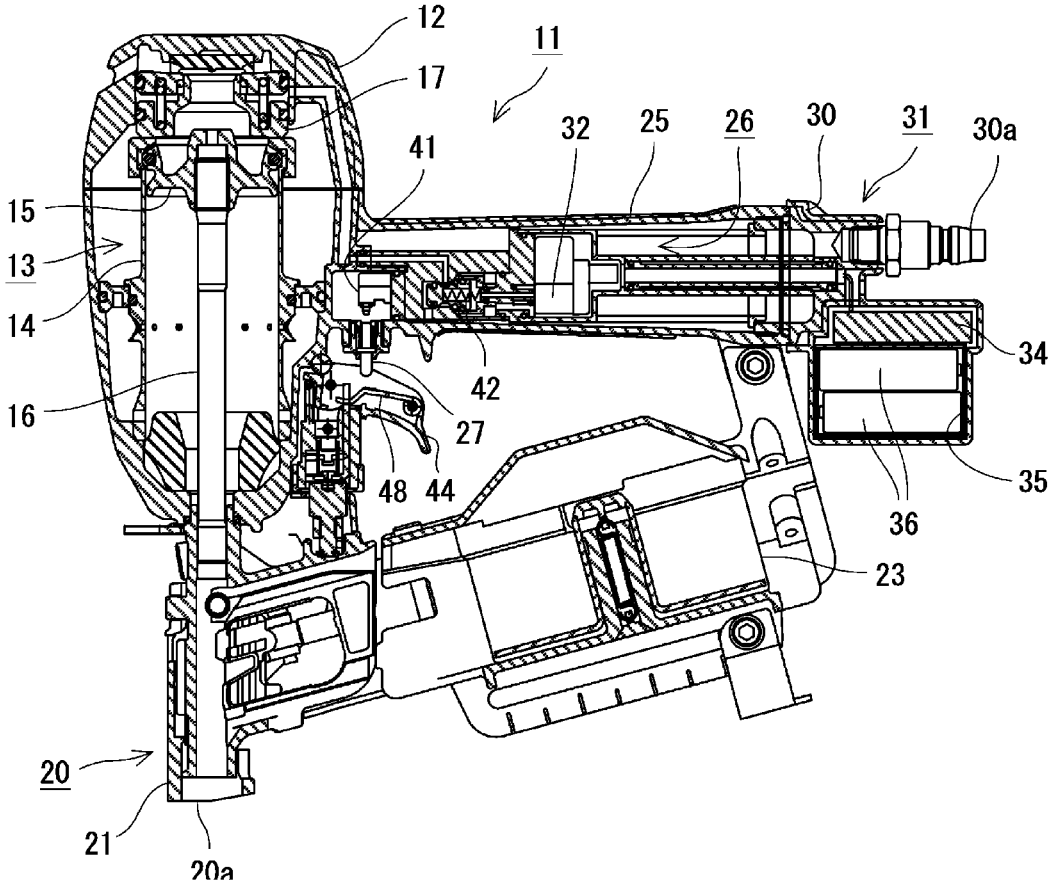
FIG. 12 is a sectional view of the pneumatic tool having the control unit attached thereto in accordance with the second modified example.

In the pneumatic tool 10 shown in FIG. 12, the switch 41 for an electromagnetic valve is arranged above the slider 27. For this reason, when the slider 27 is moved upward as a result of operations on the contact member 21 and the operation part 44, the switch 41 for an electromagnetic valve is pressed by the slider 27 slid upward. When the control substrate 34 detects that the switch 41 for an electromagnetic valve is pressed, the control substrate 34 actuates the electromagnetic valve 32 by supplying current to the same. The electromagnetic valve 32 is actuated, so that the pilot valve 42 and the head valve 17 are actuated, like the above embodiment. As a result, the drive mechanism 13 is actuated to perform the striking operation.

Also in the above configuration, it is possible to improve the attaching property and the maintenance property, like the above embodiment.

Figure 11B:
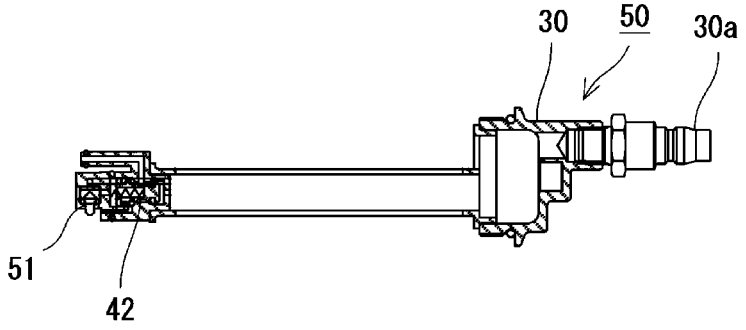
Figure 13:
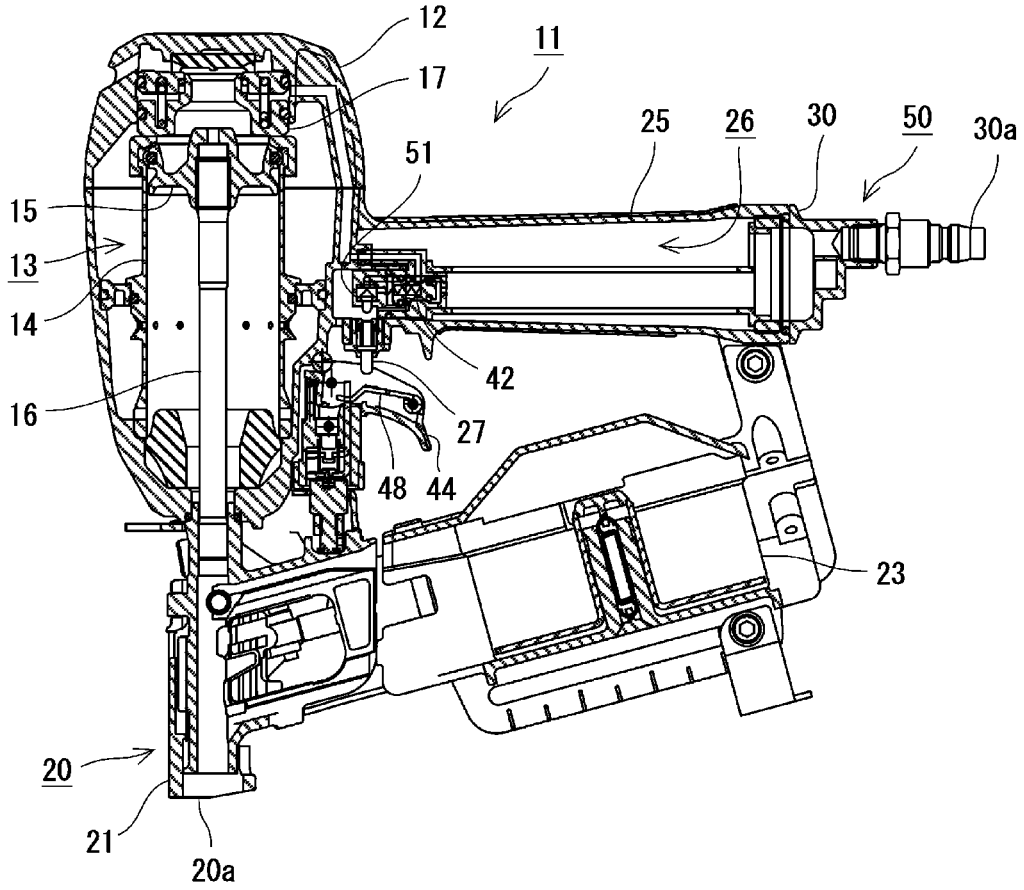
FIG. 13 is a sectional view of the pneumatic tool having the air-type control unit attached thereto in accordance with the second modified example.

In the meantime, the pneumatic tool 10 in accordance with the present modified example includes an air-type control unit 50 that is a substitute for the control unit 31, as shown in FIG. 11B. The air-type control unit 50 includes a trigger valve 51 that is configured to be mechanically actuated, instead of the electromagnetic valve 32. The air-type control unit 50 is attached to the tool main body 11, instead of the control unit 31, so that the pneumatic tool 10 as shown in FIG. 13 is configured. The pneumatic tool 10 shown in FIG. 13 is configured to actuate the drive mechanism 13 without using the electricity.

That is, in the pneumatic tool 10 shown in FIG. 13, the trigger valve 51 is arranged above the slider 27. For this reason, when the slider 27 is moved upward as a result of operations of the contact member 21 and the operation part 44, the trigger valve 51 is pushed up by the slider 27 slid upward. When the trigger valve 51 is pushed up, the compressed air pressing the pilot valve 42 is exhausted, so that the pilot valve 42 is actuated. The pilot valve 42 is actuated to actuate the head valve 17, so that the drive mechanism 13 is actuated to perform the striking operation.

Like this, according to the present embodiment, the different type of the control unit 31 is attached to the same tool main body 11, so that the pneumatic tool 10 which does not use the electricity can be configured and the pneumatic tool 10 which uses the electricity can also be configured. Therefore, when manufacturing the two different types of the pneumatic tools 10, it is possible to commonly use the components, so that it is possible to improve the production efficiency and to save the cost.

Third Modified Example of First Embodiment

In the above embodiment, the aspect in which the pneumatic tool 10 is driven by the battery 36 has been described. However, the present invention is not limited thereto. For example, the pneumatic tool 10 may be configured to be actuated by an external power supply.

Figure 14:
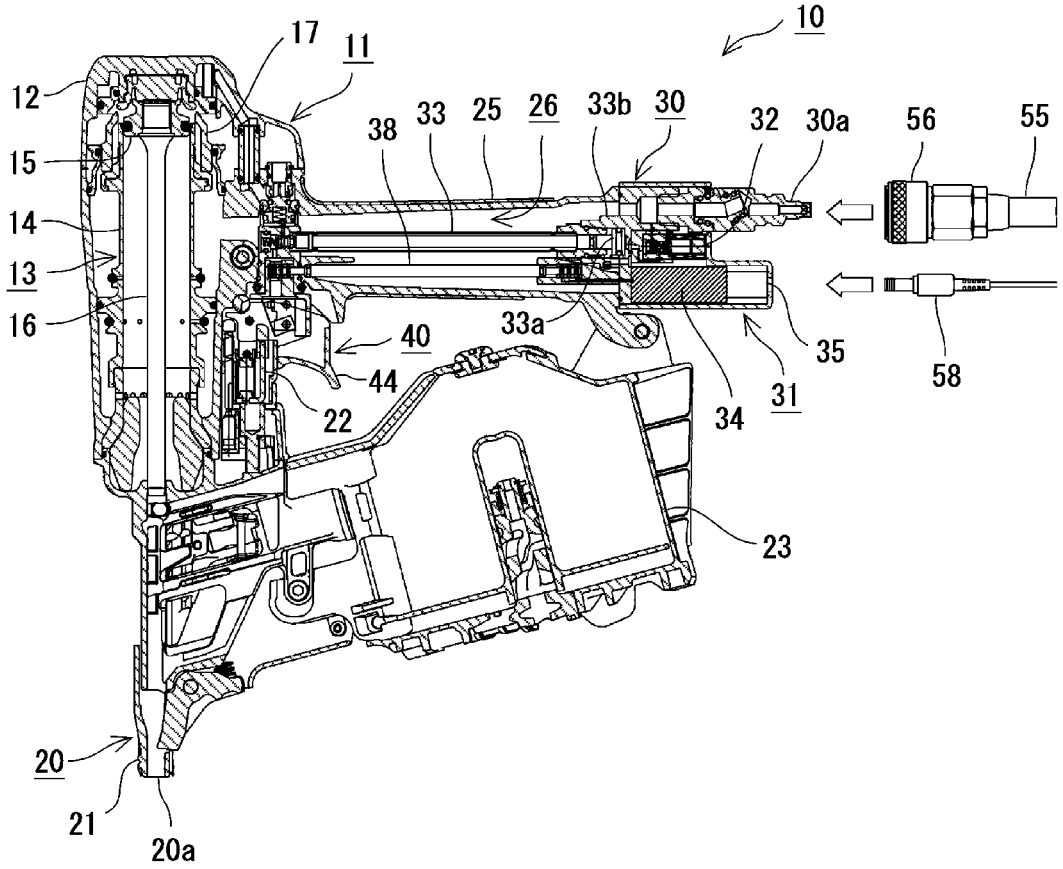
FIG. 14 is a sectional view of a pneumatic tool for which an external power supply is used, in accordance with a third modified example of the first embodiment.

That is, the power supply terminal 35 in accordance with the above embodiment is provided so as to connect the battery 36. Instead, however, the power supply terminal 35 to which a power supply cable 58 connected to the external power supply can be connected may be provided, as shown in FIG. 14.

Second Embodiment

A second embodiment of the present invention is described with reference to FIGS. 15 to 22.

A pneumatic tool 110 in accordance with the present embodiment is a nailing machine configured to be actuated by a pneumatic pressure of compressed air supplied from an outside, for example. In the meantime, in the present embodiment, the nailing machine is exemplified as the pneumatic tool 110. However, the pneumatic tool 110 is not limited to the nailing machine, and other tools may also be possible. For example, a tool such as a screw fastener configured to be actuated by compressed air is also possible.

The pneumatic tool 110 has a tool main body 111 of which a grip housing 125 is substantially perpendicularly coupled to a body housing 112.

The body housing 112 is a tubular member having a drive mechanism 113 accommodated therein. A tip end portion of the body housing 112 is provided with a nose part 120 that is to be pressed to a material to be struck. The nose part 120 is connected to a magazine 123 in which coupled nails are accommodated, and a head nail of the coupled nails loaded in the magazine 123 is supplied to the nose part 120 by a supply device. The nail supplied to the nose part 120 is struck out from an ejection port 120*a* provided to a tip end of the nose part 120 by a driver 116 (which will be described later) at the time when the drive mechanism 113 is actuated.

Figure 16:
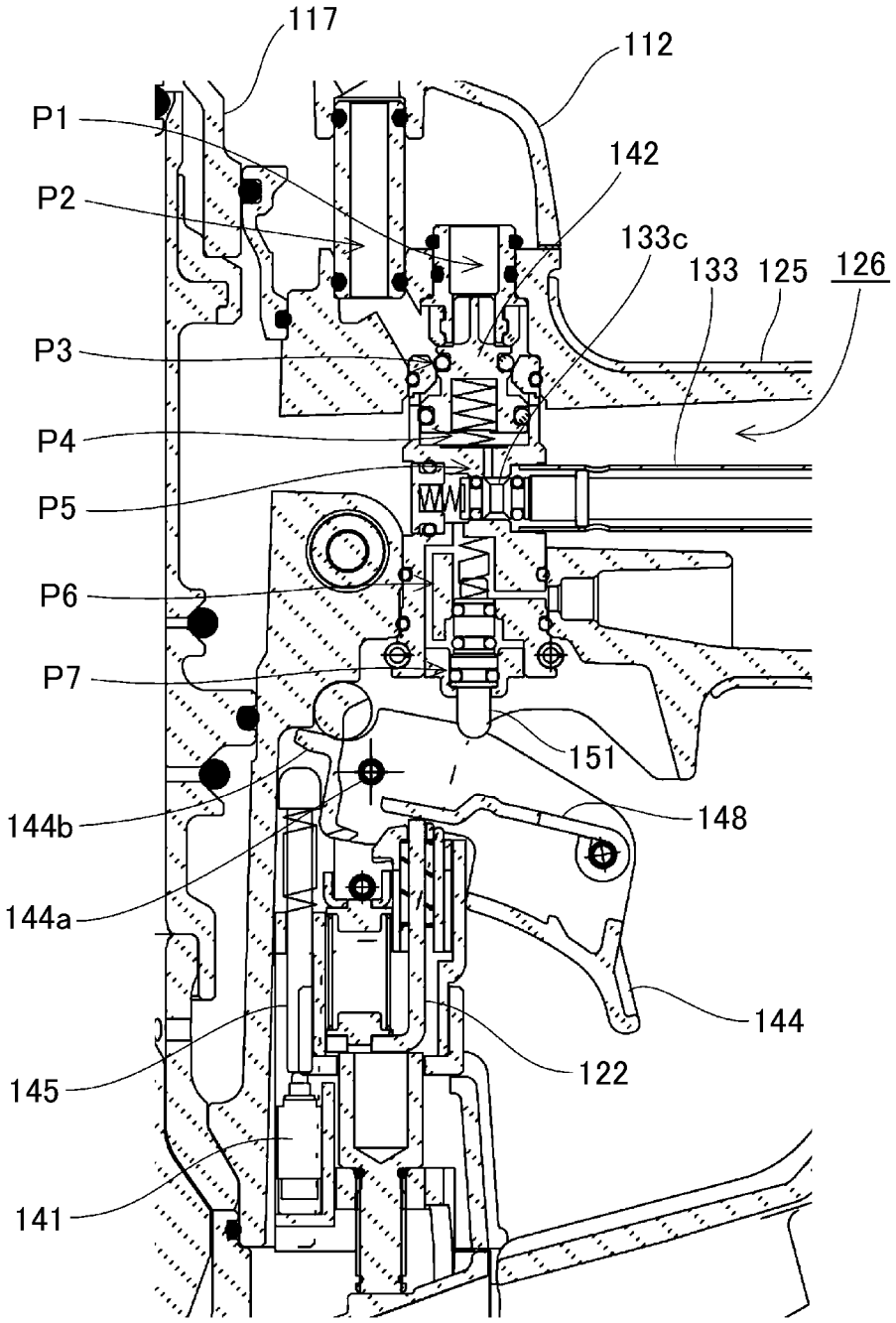
FIG. 16 is a partially enlarged sectional view of the pneumatic tool before the drive mechanism is actuated.
Figure 18:
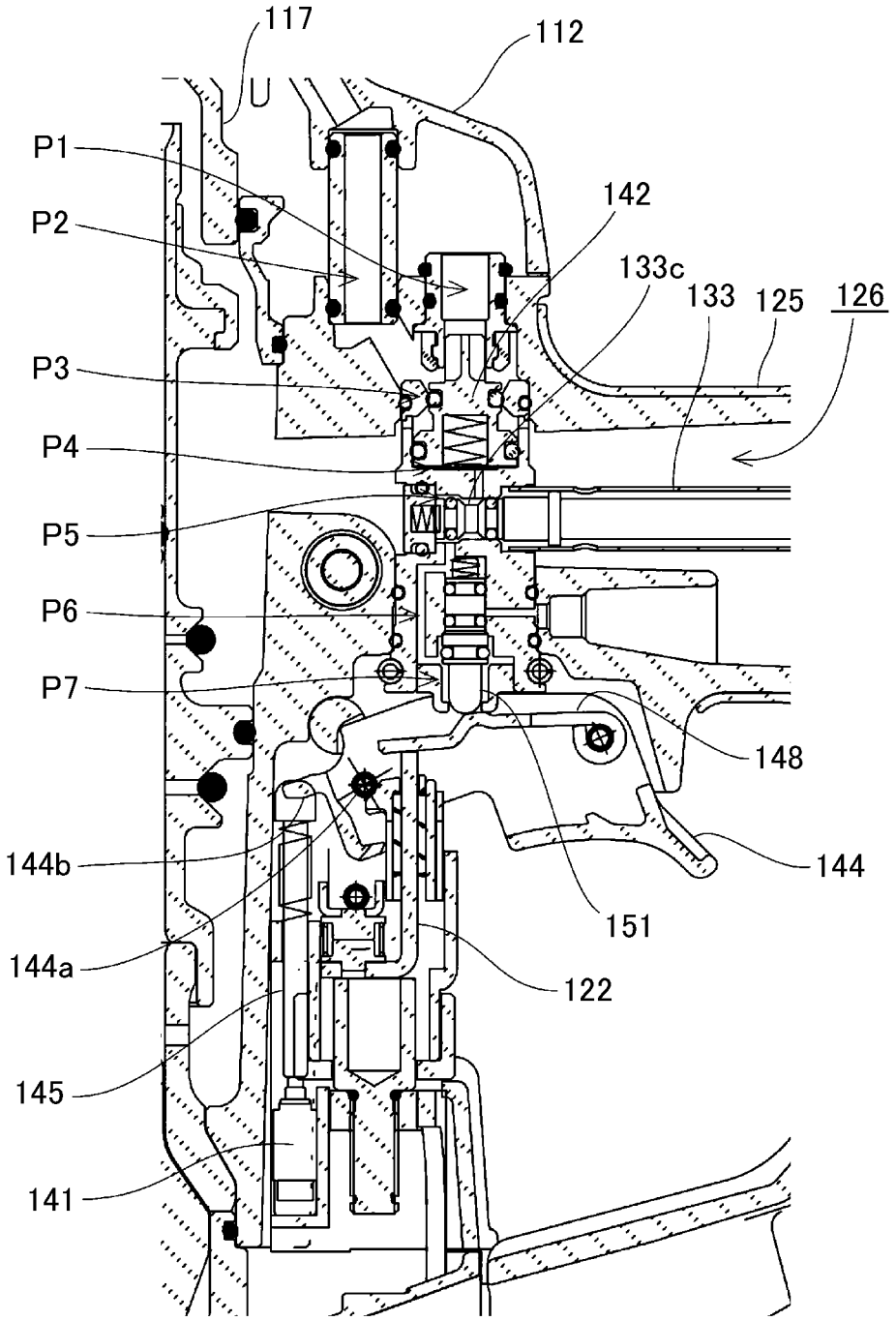
FIG. 18 is a partially enlarged sectional view of the pneumatic tool while the drive mechanism is being actuated.
Figure 20:
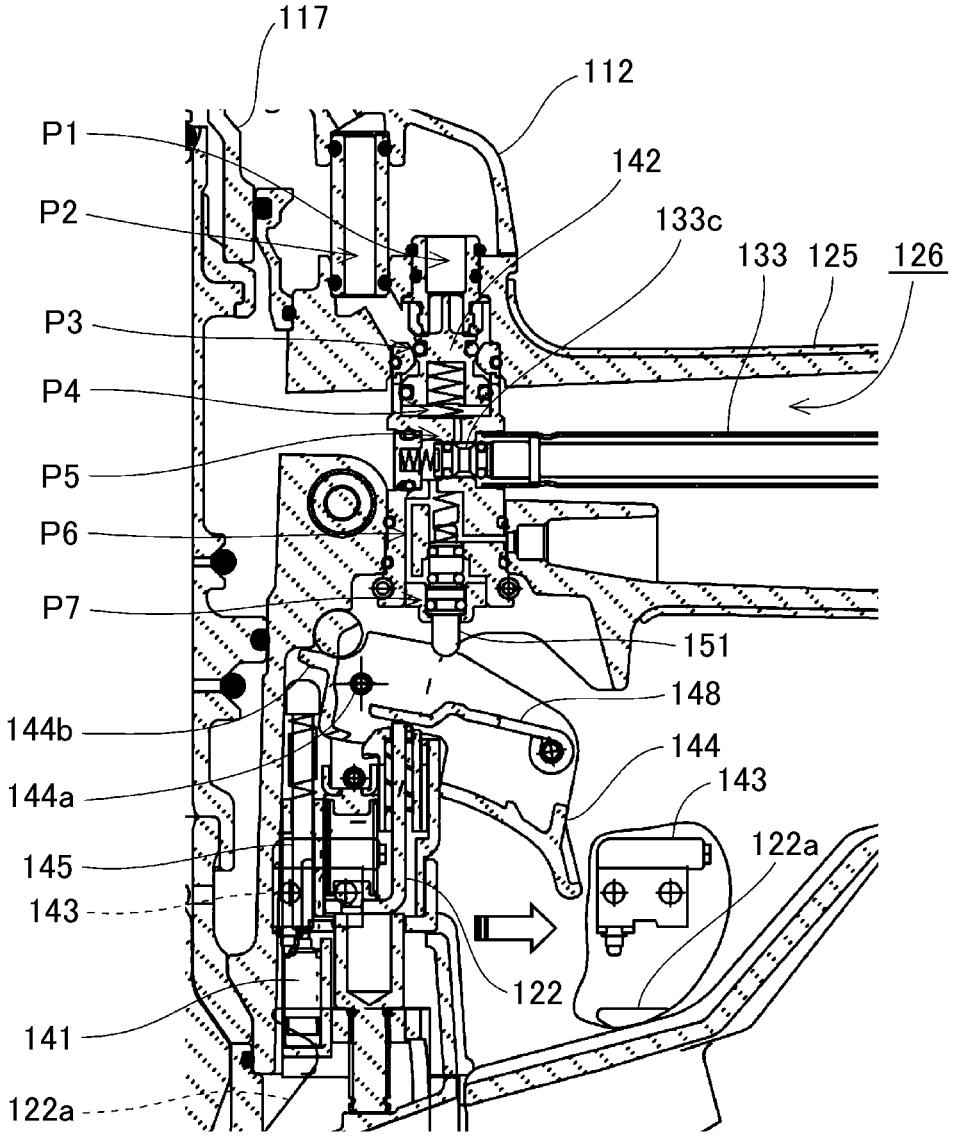
FIG. 20 is a partially enlarged sectional view before operation, depicting a pushing timing of a contact switch.
Figure 21:
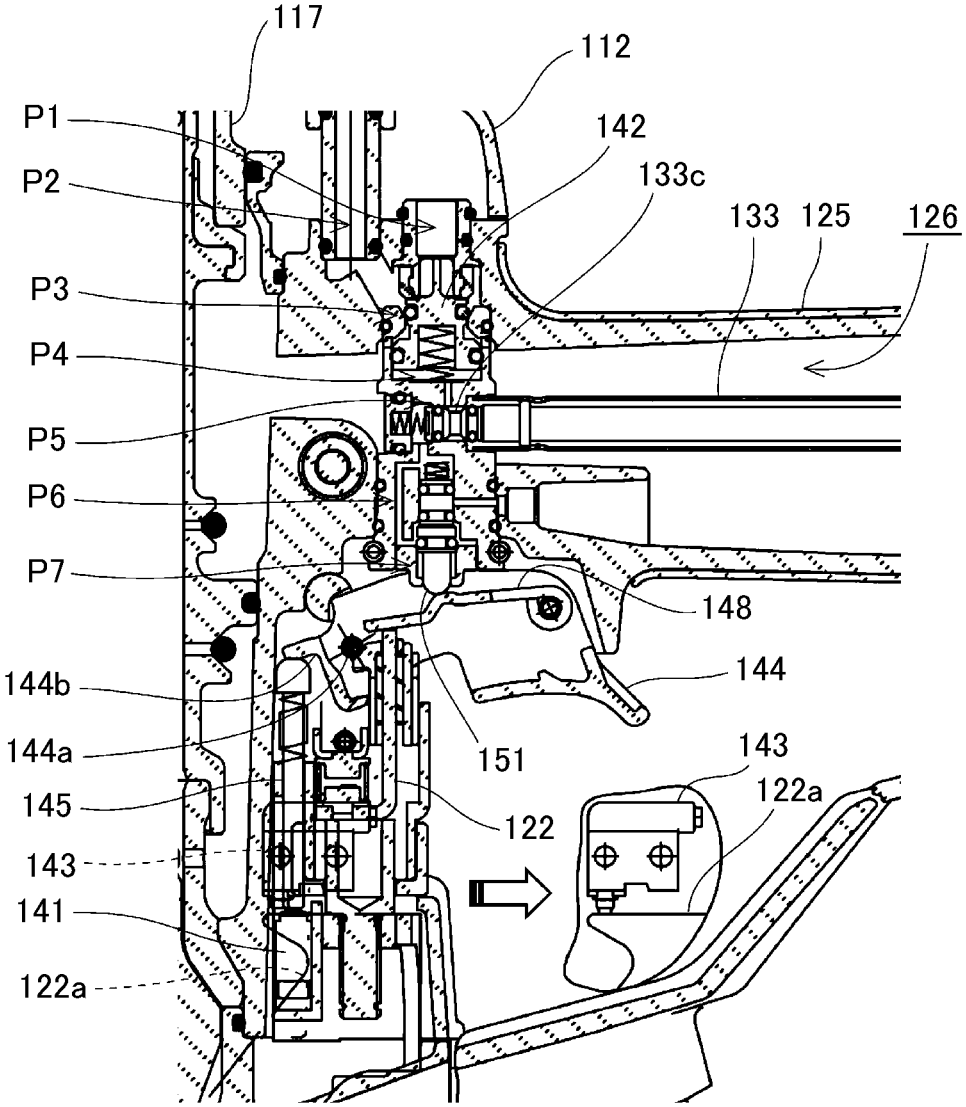
FIG. 21 is a partially enlarged sectional view while the contact arm is moving, depicting the pushing timing of the contact switch.
Figure 22:
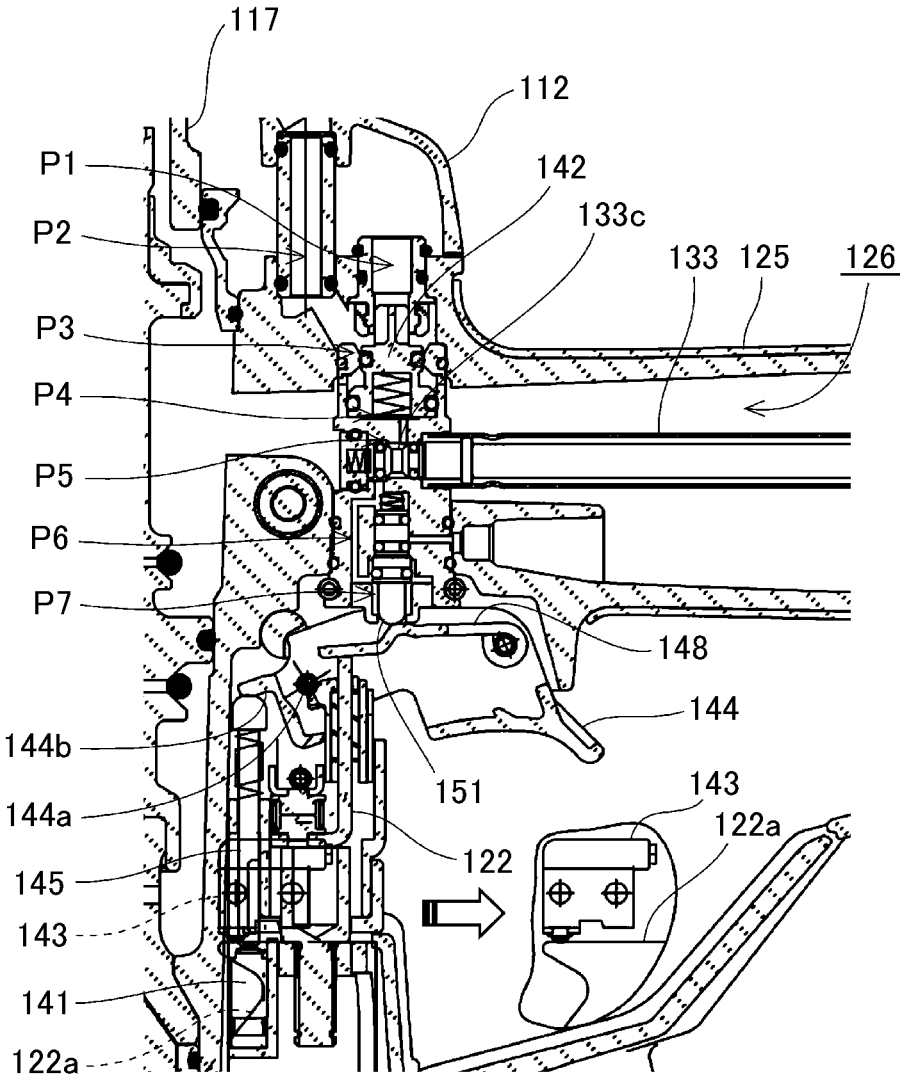
FIG. 22 is a partially enlarged sectional view at the time when the contact arm is moved to an inner side, depicting the pushing timing of the contact switch.

A contact member 121 that can be slid in a striking-out direction of the nail is attached to the nose part 120. The contact member 121 is urged to protrude from the nose part 120 in a natural state, and is pushed and slid inward when the nose part 120 is pressed to the material to be struck. When the contact member 121 is slid, a contact arm 122 coupled to the contact member 121 is integrally slid. As shown in FIGS. 16 and 18, the contact arm 122 extends to a position in which a contact switch 148 (which will be described later) can be pushed up. Also, as shown in FIGS. 20 to 22, the contact arm 122 has a switch pressing portion 122*a* capable of pressing the contact switch 143. In the meantime, the contact switch 143 is a switch for detecting that the nose part 120 is pressed to the material to be struck.

By the above configuration, when the contact member 121 is pushed in and the contact arm 122 is thus slid, the contact arm 122 pushes up an end portion of the contact lever 148 and the switch pressing portion 122*a* presses the contact switch 143.

Figure 15:
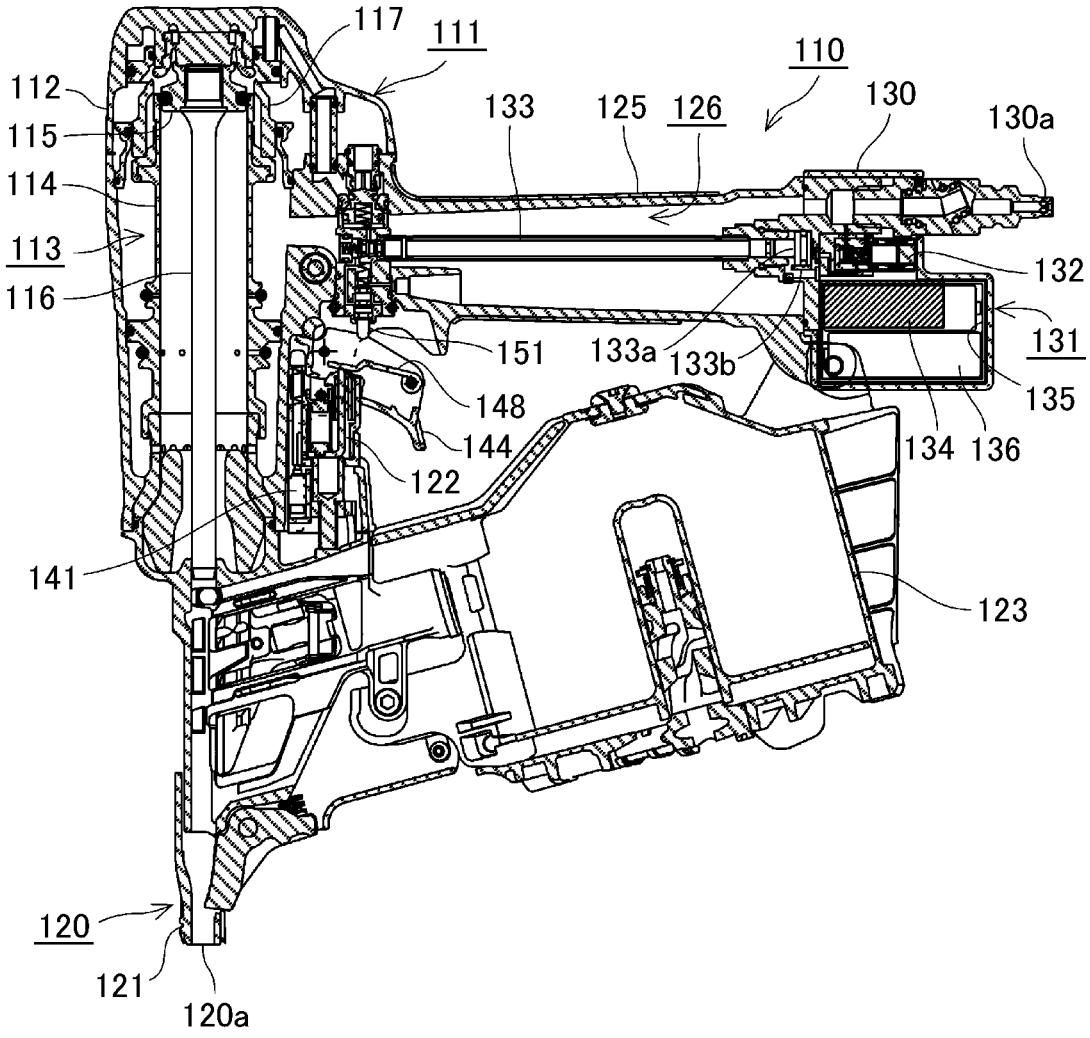
FIG. 15 is a sectional view of a pneumatic tool in accordance with a second embodiment of the present invention before the drive mechanism is actuated.
Figure 17:
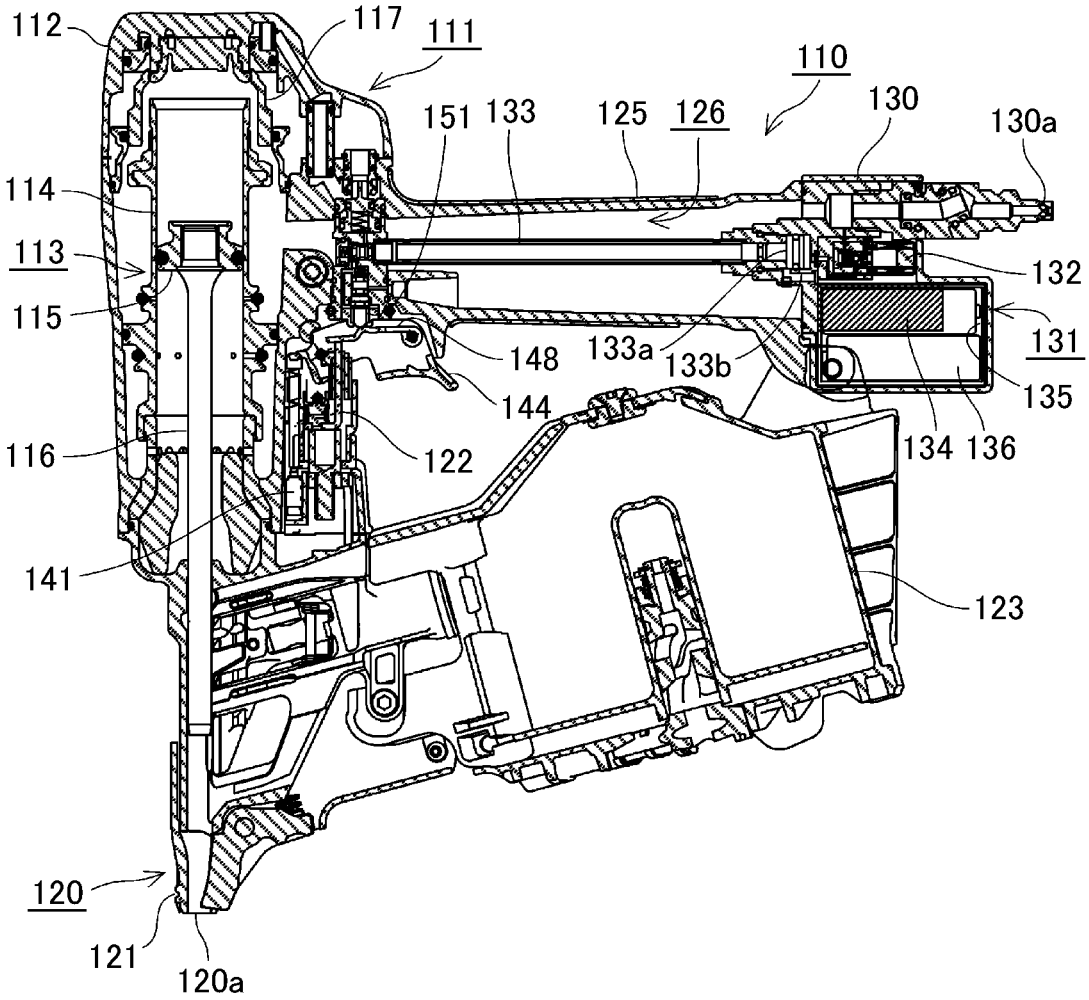
FIG. 17 is a sectional view of the pneumatic tool while the drive mechanism is being actuated.

As shown in FIGS. 15 and 17, the drive mechanism 113 in accordance with the present embodiment is actuated while sliding a piston 115 by the pneumatic pressure of the compressed air. The piston 115 is slidably arranged inside of a cylinder 114, and is impulsively slid toward the nose part 120 when the compressed air is caused to flow into an upper part of the piston 115. A driver 116 configured to slide integrally with the piston 115 is coupled to a lower part of the piston 115. The driver 116 is slidably arranged in the nose part 120, and can strike out the nail standing by in the nose part 120 toward the ejection port 120*a*.

The inflow of the compressed air for actuating the piston 115 is controlled by a head valve 117 arranged to cover an upper opening of the cylinder 114. As shown in FIG. 15, in a state in which the drive mechanism 113 is not actuated, the head valve 117 is located below, so that the inflow of the compressed air into the upper part of the piston 115 is prevented. On the other hand, as shown in FIG. 17, when the drive mechanism 113 is actuated, the head valve 117 is moved upward to communicate the cylinder 114 and a main chamber 126 (which will be described later) each other, so that the inflow of the compressed air into the upper part of the piston 115 is permitted. When the compressed air is caused to flow into the upper part of the piston 115, the piston 115 is impulsively slid downward by the pressure of the compressed air, so that the nail is struck out by the driver 116 coupled to the piston 115.

The grip housing 125 connected to the body housing 112 has a rod shape that can be gripped by the operator. Also, an operation part 144 that can be pulled with an index finger of the operator is provided in a position in which the index finger is put when the operator grips the grip housing 125. When the operation part 144 is operated, a switch 141 for an electromagnetic valve attached to the drive mechanism 113 becomes on, so that an operation signal is output to a control substrate 134 (which will be described later). The control substrate 134 actuates an electromagnetic valve 132 (which will be described later) by using the operation signal as a trigger.

An inside of the grip housing 125 is formed as a space as shown in FIG. 15. By the space, a main chamber 126 in which the compressed air is stored is formed. The compressed air supplied from an outside is stored in the main chamber 126 and is used to strike out the nail, for example.

Also, a grip end member 130 for closing the main chamber 126 is attached to a rear end portion of the grip housing 125 (an end portion on an opposite side to the body housing 112). The grip end member 130 is detachably mounted to the grip housing 125. The grip end member 130 is provided with a joint 130*a* to which a plug of a hose is detachably mounted. The hose connected to an external air supply source (an air compressor or the like) is connected to the joint 130*a*, so that the compressed air can be supplied to the main chamber 126.

In the present embodiment, a control unit 131 is integrally attached to the grip end member 130. The control unit 131 is to control the drive mechanism 113, and includes an electromagnetic valve 132, a valve stem 133, a control substrate 134, and a power supply terminal 35, as shown in FIG. 15. The electromagnetic valve 132 has configurations that are similar to those of the electromagnetic valve 32 (refer to FIGS. 2A and 2B).

The valve stem 133 is a rod-shaped member protruding from the grip end member 130. When the grip end member 130 is attached to the grip housing 125, the valve stem 133 is arranged inside of the grip housing 25 along a longitudinal direction of the grip housing 125. The valve stem 133 is supported to be slidable in the longitudinal direction of the grip housing 125, and is configured to be actuated in conjunction with the electromagnetic valve 132, depending on whether or not the compressed air to be supplied from the electromagnetic valve 132.

Specifically, the valve stem 133 in accordance with the present embodiment has a stem piston 133*a* on a rear end side (the grip end member 130-side). The stem piston 133*a* is arranged to be slidable in a stem cylinder 133*b* fixed to the grip end member 130. As described above, when the electromagnetic valve 132 becomes on (opened state) and the compressed air is supplied into the stem cylinder 133*b*, the stem piston 133*a* is pressed by the pressure of the compressed air and the valve stem 133 is slid toward the body housing 112. On the other hand, when the electromagnetic valve 132 becomes off (closed state), i.e., the compressed air is not supplied into the stem cylinder 133*b*, the pressure by the compressed air is not applied, so that the valve stem 133 is urged by the spring and stands by on the grip end member 130-side.

On the tip end-side (the body housing 112-side) of the valve stem 133, an air switching part 133*c* functioning as a valve for switching the supply path of the compressed air is provided. As described above, the valve stem 133 is moved in the extension direction of the grip housing 125, so that the air switching part 133*c* is moved from a standby position shown in FIGS. 15 and 16 to an actuation position shown in FIGS. 17 and 18. The air switching part 133*c* is moved in this way, so that the actuation of the head valve 117 is controlled.

Specifically, the pneumatic tool 110 in accordance with the present embodiment includes a pilot valve 142 for controlling movement of the head valve 117. The pilot valve 142 is configured to be actuated in conjunction with the electromagnetic valve 132 so as to switch the flow path of the compressed air, and is provided between an upper space P2 of the head valve 117 and the main chamber 126.

As shown in FIG. 16, when the air switching part 133*c* is located in the standby position, a lower space P4 of the pilot valve 142 communicates with the main chamber 126 in a position denoted with P5. Therefore, the compressed air is caused to flow into the lower space P4 of the pilot valve 142 and the pilot valve 142 is moved upward by the pressure of the compressed air (although the compressed air is supplied to the upper and lower parts of the pilot valve 142, a force of pushing up the pilot valve 142 is set higher by a difference between pressure-receiving areas). In the state in which the pilot valve 142 is moved upward in this way, the upper space P2 of the head valve 117 and the main chamber 126 communicate with each other and the upper space P2 of the head valve 117 and the exhaust path P1 are disconnected from each other, in a position denoted with P3. For this reason, the compressed air is caused to flow into the upper space P2 of the head valve 117, and the head valve 117 is moved downward by the pressure of the compressed air (although the compressed air is supplied to the upper and lower parts of the head valve 117, a force of pushing down the head valve 117 is set higher by a difference between pressure-receiving areas). In the state in which the head valve 117 is moved downward, the inflow of the compressed air into the upper part of the piston 115 is blocked, so that the drive mechanism 113 is not actuated.

In the meantime, as shown in FIG. 18, when the air switching part 133*c* is moved to the actuation position, the lower space P4 of the pilot valve 142 is disconnected from the main chamber 126 and the lower space P4 of the pilot valve 142 communicates with the exhaust path P6, in the position P5. For this reason, the compressed air in the lower space P4 of the pilot valve 142 is exhausted from the exhaust path P6, so that the atmospheric pressure in the lower space P4 of the pilot valve 142 is lowered. When the atmospheric pressure in the lower space P4 of the pilot valve 142 is lowered, the pilot valve 142 is moved downward by a pressure difference between the upper and lower parts of the pilot valve 142. When the pilot valve 142 is moved downward in this way, the upper space P2 of the head valve 117 and the main chamber 126 are disconnected from each other and the upper space P2 of the head valve 117 and the exhaust path P1 communicate with each other, as shown in a position P3. For this reason, the compressed air in the upper space P2 of the head valve 117 is exhausted from the exhaust path P1, so that the atmospheric pressure in the upper space P2 of the head valve 117 is lowered. When the atmospheric pressure in the upper space P2 of the head valve 117 is lowered, the head valve 117 is moved upward by a pressure difference between the upper and lower parts of the head valve 117. When the head valve 117 is moved upward, the compressed air is caused to rapidly flow into the upper part of the piston 115, so that the drive mechanism 113 is actuated.

Like this, in the present embodiment, when the electromagnetic valve 132 is actuated, the valve stem 133, the pilot valve 142 and the head valve 117 are accordingly actuated sequentially, so that the drive mechanism 113 is actuated. However, since the pneumatic tool 110 in accordance with the present embodiment includes a safety mechanism, even when the electromagnetic valve 132 is actuated, the pilot valve 142 is not actuated until the safety mechanism is released. The safety mechanism will be described in detail later.

The control substrate 134 is to control actuations of electric components such as the electromagnetic valve 132. The control substrate 134 has a circuit for executing processing by using an input of an electric signal as a trigger. In the present embodiment, a switch 141 for an electromagnetic valve and a contact switch 143 are connected to an input-side of the control substrate 134. Also, the electromagnetic valve 132 is connected to an output-side of the control substrate 134. When it is detected that both the switch 141 for an electromagnetic valve and the contact switch 143 become on, the control substrate 134 executes control of switching the electromagnetic valve 132 to an on state by causing current to flow through a coil 132*a* of the electromagnetic valve 132.

The power supply terminal 135 is a terminal for receiving power, and is provided to connect a power supply for feeding power to the electric components such as the control substrate 134 and the electromagnetic valve 132. Since the pneumatic tool 110 in accordance with the present embodiment is driven by a battery 136, the power supply terminal 135 in accordance with the present embodiment is configured as a terminal for connecting the battery 136. For example, as shown in FIG. 15, the power supply terminal 135 may be provided inside of a case configured to accommodate the battery 136, and a terminal of the battery 136 and the power supply terminal 135 may be electrically connected to each other when the battery 136 is accommodated in the case. In the meantime, the shape of the power supply terminal 135 is not limited to the aspect as shown in FIG. 15, and a variety of shapes of the related art can also be used. Also, an external power supply can be connected to the power supply terminal 135, so that the pneumatic tool 110 can use the external power supply, instead of the battery 136.

Also, the pneumatic tool 110 in accordance with the present embodiment includes the switch 141 for an electromagnetic valve and the contact switch 143, in the vicinity of the operation part 144. The switch 141 for an electromagnetic valve and the contact switch 143 are micro switches for switching the opened and closed states of the electromagnetic valve 132. As described above, when both the switch 141 for an electromagnetic valve and the contact switch 143 become on, the electromagnetic valve 132 becomes on (opened state).

As shown in FIG. 16, the operation part 144 in accordance with the present embodiment is provided to be swingable about a swinging shaft 144*a* in the vicinity of a connection part of the body housing 112 and the grip housing 125. The operation part 144 is configured so that it swings to press the switch 141 for an electromagnetic valve when it is pulled by the operator. Specifically, as shown in FIG. 18, when the operator pulls the operation part 144 with a finger, a pressing portion 144*b* of the tip end of the operation part 144 pushes down a rod-shaped driven member 145. The driven member 145 is arranged so that a tip end thereof faces toward the switch 141 for an electromagnetic valve. For this reason, when the driven member 145 is pushed down by the pressing portion 144*b*, the switch 141 for an electromagnetic valve is pressed by the tip end of the driven member 145.

Also, a contact lever 148 is attached to be swingable inside of the operation part 144. The contact lever 148 has one end swingably attached to the operation part 144 and the other end arranged toward a tip end of the contact arm 122. For this reason, as shown in FIG. 18, when the operation part 144 is moved up as a result of a pulling operation and the contact member 121 is pushed in to move up the contact arm 122, both ends of the contact lever 148 are lifted.

On an upper part of the contact lever 148, a trigger stem 151 that is mechanically actuated when the operation part 144 is operated is arranged. The trigger stem 151 configures a safety mechanism for preventing an unintentional operation. That is, the trigger stem 151 is provided so that the compressed air is not supplied to the drive mechanism 113 until the operation part 144 is operated. The trigger stem 151 is actuated in conjunction with the operation part 144 when the operation part 144 is operated, and is configured to switch an ineffective state in which the compressed air cannot be supplied to the drive mechanism 113 and an effective state in which the compressed air can be supplied to the drive mechanism 113.

As shown in FIG. 16, the trigger stem 151 in accordance with the present embodiment is a shaft-shaped member attached to the grip housing 125 so as to be slidable vertically. A lower end portion of the trigger stem 151 is arranged so as to face toward an intermediate part of the contact lever 148. Also, the trigger stem 151 is urged to protrude downward by a spring or the like, in a natural state. When the operation part 144 and the contact member 121 are operated at the same time, the trigger stem 151 is actuated in conjunction with the operation part 144 and the contact member 121.

That is, while at least one of the operation part 144 and the contact member 121 is not operated, the ineffective state in which the trigger stem 151 protrudes downward is formed, as shown in FIG. 16. In the ineffective state, the exhaust path P6 for exhausting the compressed air in the lower space P4 of the pilot valve 142 is closed by the trigger stem 151, as denoted with P7. For this reason, in the ineffective state, the pilot valve 142 cannot be actuated, irrespective of the operating states of the electromagnetic valve 132, so that the compressed air cannot be supplied to the drive mechanism 113.

On the other hand, while the operation part 144 and the contact member 121 are operated at the same time, the effective state in which the trigger stem 151 is pushed in and moved up by the contact lever 148 is formed, as shown in FIG. 18. In the effective state, the exhaust path P6 for exhausting the compressed air in the lower space P4 of the pilot valve 142 is opened by the trigger stem 151, as denoted with P7. For this reason, in the effective state, when the electromagnetic valve 132 is actuated, the pilot valve 142 is actuated, so that the compressed air can be supplied to the drive mechanism 113.

Figure 19:
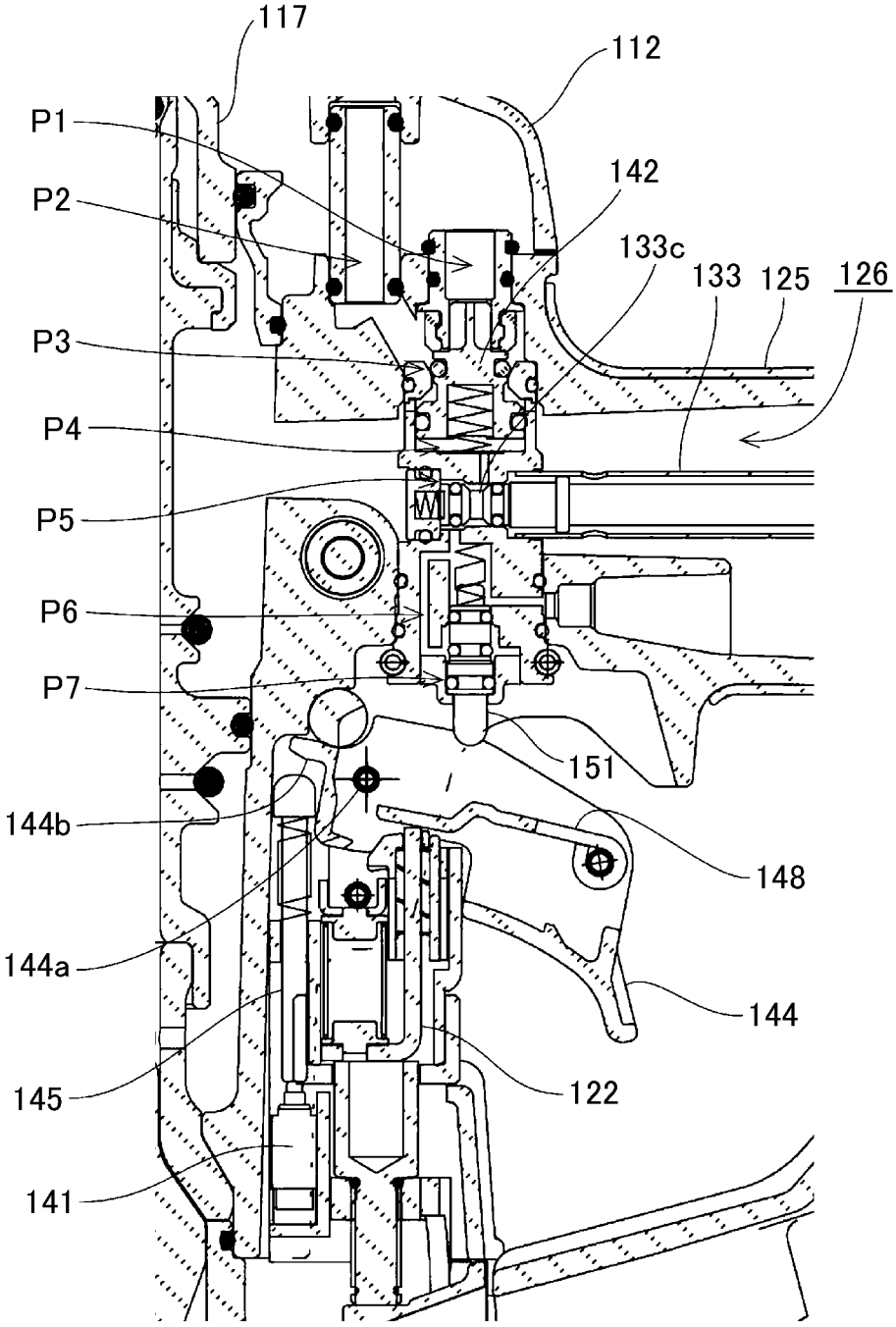
FIG. 19 is a partially enlarged sectional view of the pneumatic tool when the electromagnetic valve malfunctions.

According to the above configuration, for example, as shown in FIG. 19, even when the electromagnetic valve 132 malfunctions due to any cause, a pressure change for actuating the pilot valve 142 is not generated in a state in which the operation part 144 is not operated, so that the drive mechanism 113 is not actuated. Therefore, it is possible to prevent the actuation of the drive mechanism 113 at an unintentional timing.

Also, in the present embodiment, when both the operation part 144 and the contact member 121 are operated, the trigger stem 151 shifts from the ineffective state to the effective state. For this reason, the safety mechanism by the trigger stem 151 is provided, in addition to the safety mechanism by the contact member 121, so that a double safety mechanism is configured. Therefore, it is possible to provide the safer pneumatic tool 110.

In the present embodiment, when the contact member 121 is slid, the safety mechanism (the trigger stem 151) becomes in the effective state before the contact switch 143 becomes on. In this configuration, for example, when the operator performs contact driving, it is possible to control timing so that the nail is struck at the time when the contact member 121 is pushed to a predetermined position. That is, in the case of the contact driving, the electromagnetic valve 132 is actuated at the timing at which the contact switch 143 becomes on. At this time, however, the safety mechanism is released in advance, so that the timing control by the electromagnetic valve 132 is not obstructed.

Specifically, as shown in FIG. 20, in a state in which the contact member 121 is not pushed in, the contact arm 122 configured to move upward integrally with the contact member 121 also stands by. In this state, the switch pressing portion 122*a* of the contact arm 122 does not press the contact switch 143. Also, the trigger stem 151 configuring the safety mechanism is not also pushed up and is in the ineffective state.

From this state, the operation part 144 is first operated (at this time, the switch 141 for an electromagnetic valve becomes on), and the contact member 121 is then pressed to the member to be struck, so that the contact driving can be executed. When the contact driving is executed, both ends of the contact lever 148 are lifted to push up the trigger stem 151 by the operation part 144 and the contact arm 122 at the time when the contact arm 122 is moved upward to the predetermined position, as shown in FIG. 21. Thereby, the trigger stem 151 configuring the safety mechanism is in the effective state. At this timing, it is set that the switch pressing portion 122*a* of the contact arm 122 does not press the contact switch 43.

When the contact member 121 is further pressed to the member to be struck from the position of FIG. 21, the switch pressing portion 122*a* of the contact arm 122 presses the contact switch 143, as shown in FIG. 22. Thereby, both the switch 141 for an electromagnetic valve and the contact switch 143 become on, so that the electromagnetic valve 132 is actuated. When the electromagnetic valve 132 is actuated, the safety mechanism is released already and is thus in the effective state, so that the compressed air is supplied to the drive mechanism 113 and the drive mechanism 113 is thus actuated.

In this way, after the safety mechanism is first released, the contact switch 143 is pressed. Therefore, it is possible to actuate the drive mechanism 113 without delay at the timing at which the contact switch 143 is pushed. Accordingly, it is possible to easily control the actuation timing of the drive mechanism 113 in an electrical control manner.

As described above, the pneumatic tool 110 in accordance with the present embodiment includes the safety mechanism for performing control so that the compressed air is not supplied to the drive mechanism 113 until the operation part 144 is operated, and the safety mechanism can shift from the ineffective state in which the compressed air cannot be supplied to the drive mechanism 113 to the effective state in which the compressed air can be supplied to the drive mechanism 113, in conjunction with the operation part 144 when the operation part 144 is operated. That is, while the safety mechanism is in the ineffective state, even when the electronic component such as the electromagnetic valve 132 malfunctions, the compressed air is not supplied to the drive mechanism 113. According to this configuration, even when the electronic component malfunctions due to any cause, the compressed air is not supplied to the drive mechanism 113 until the operation part 144 is operated and the safety mechanism is thus released. Therefore, it is possible to increase the safety by preventing the unintentional actuation.

In the meantime, in the present embodiment, when both the operation part 144 and the contact member 121 are operated, the trigger stem 151 is moved. However, the present invention is not limited thereto. That is, the trigger stem 151 may be moved when only the operation part 144 is operated. For example, the contact lever 148 may not be provided, and the trigger stem 151 may be directly pushed up by the operation part 144.

Third Embodiment

A third embodiment of the present invention is described with reference to FIGS. 23 to 27. In the meantime, since the basic configurations of the present embodiment are not different from the second embodiment, the overlapping descriptions are avoided and only different parts are described.

A pneumatic tool 110 in accordance with the present embodiment has also the trigger stem 151, like the second embodiment. The trigger stem 151 configures the safety mechanism for performing control so that the compressed air is not supplied to the drive mechanism 113 until the operation part 144 is operated.

Figure 24:
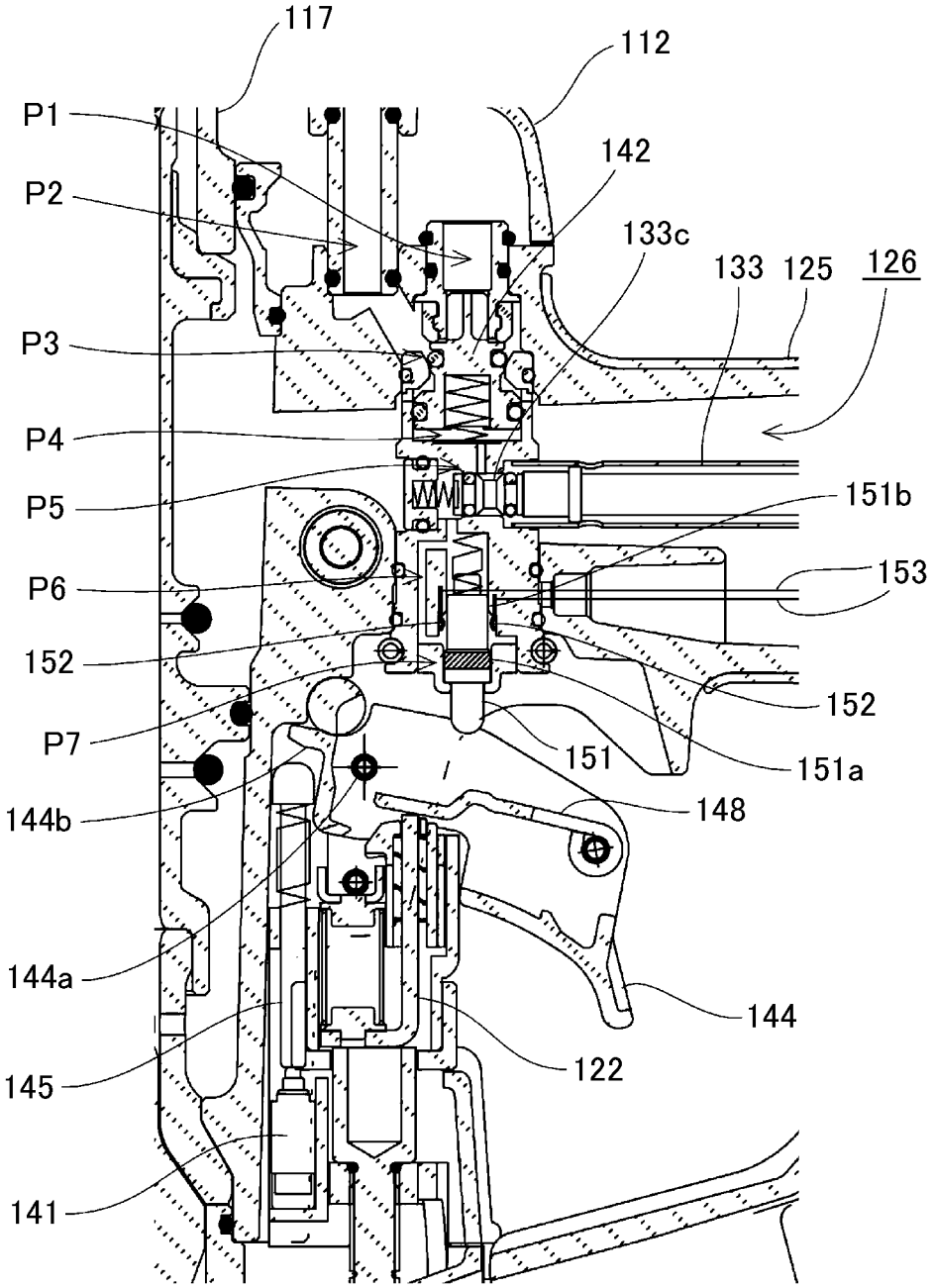
FIG. 24 is a partially enlarged sectional view of the pneumatic tool before the drive mechanism is actuated.

As shown in FIG. 24, the trigger stem 151 in accordance with the present embodiment is a shaft-shaped member attached to the grip housing 125 so as to be slidable vertically. A lower end portion of the trigger stem 151 is arranged so as to face toward an intermediate part of the contact lever 148. Also, the trigger stem 151 is urged to protrude downward by a spring or the like, in a natural state. When the operation part 144 and the contact member 121 are operated at the same time, the trigger stem 151 is actuated in conjunction with the operation part 144 and the contact member 121.

Also, the trigger stem 151 has a conductive portion 151*a* and a non-conductive portion 151*b* provided on a circumferential surface. The conductive portion 151*a* is formed of a conductive material, and can electrically connect two contact points 152, which will be described later. The non-conductive portion 151*b* is a portion except the conductive portion 151*a*, and cannot electrically connect the two contact points 152, which will be described later. In the meantime, the non-conductive portion 151*b* may be formed of a non-conductive material, and may be formed to have a shape that cannot contact the contact points 152. The conductive portion 151*a* and the non-conductive portion 151*b* are provided side by side in the longitudinal direction of the trigger stem 151.

On an inner peripheral surface of a hole in which the trigger stem 151 is slidably held, the contact points 152 facing the conductive portion 151*a* or the non-conductive portion 151*b* are provided. The contact points 152 are arranged on both sides of the trigger stem 151. When the two contact points 152 are electrically connected, the electromagnetic valve 132 and the control substrate 134 are in an energization state. That is, as shown in FIG. 15, the two contact points 152 are provided on the way of an energization path 153 for electrically connecting the electromagnetic valve 132 and the control substrate 134 each other, and the two contact points 152 are respectively connected to both ends of the energization path 153. The trigger stem 151 is slid vertically to switch a state in which the conductive portion 151*a* is in contact with the contact points 152 on both sides (a state in which the electromagnetic valve 132 and the control substrate 134 are energized to each other) and a state in which the conductive portion 151*a* is not in contact with the contact points 152 (a state in which the electromagnetic valve 132 and the control substrate 134 are electrically disconnected from each other).

Figure 23:
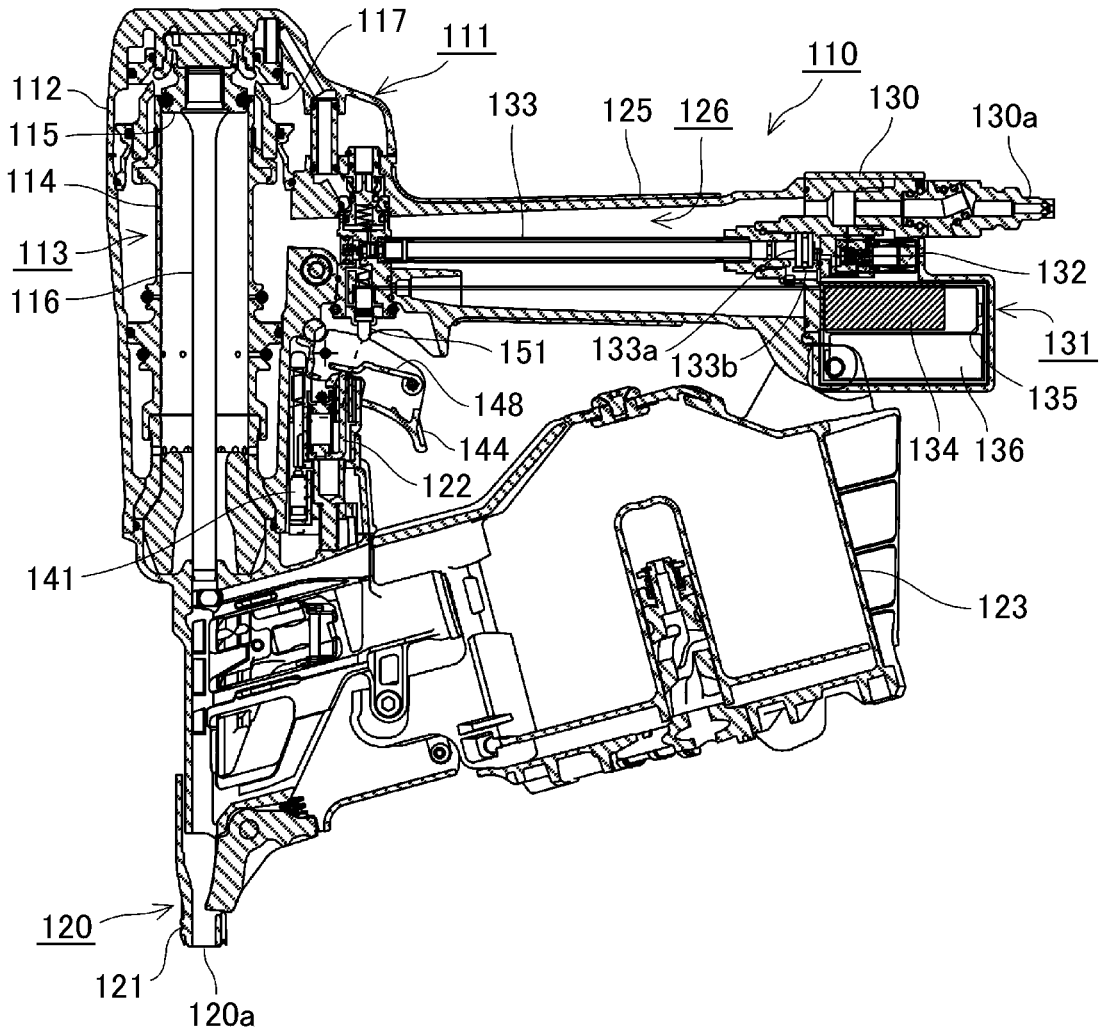
FIG. 23 is a sectional view of a pneumatic tool in accordance with a third embodiment of the present invention before the drive mechanism is actuated.
Figure 27A:
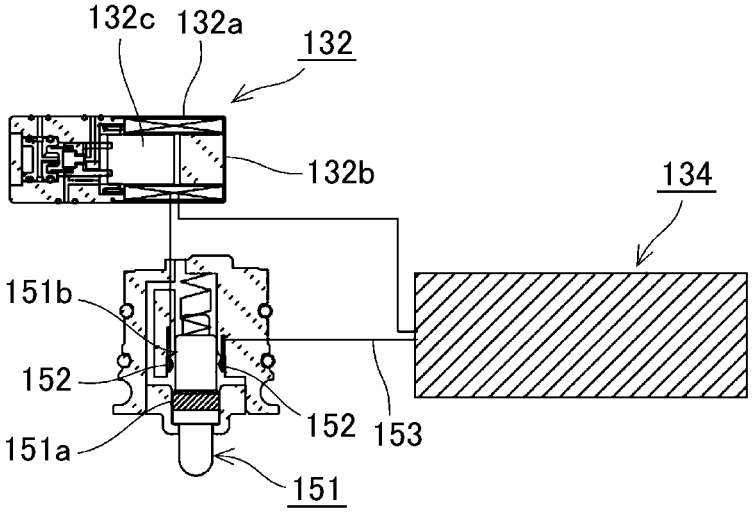
FIG. 27A is a pictorial view depicting a state in which a safety mechanism is actuated.

That is, as shown in FIGS. 23 and 24, while at least one of the operation part 144 and the contact member 121 is not operated, the ineffective state in which the trigger stem 151 protrudes downward is formed. In the ineffective state, the conductive portion 151*a* of the trigger stem 151 is not in contact with the contact points 152. That is, since the two contact points 152 are not electrically connected, the electromagnetic valve 132 and the control substrate 134 are electrically disconnected, as shown in FIG. 27A. For this reason, in the ineffective state, the electromagnetic valve 132 is not fed with power and the electromagnetic valve 132 cannot be thus actuated, so that the compressed air cannot be supplied to the drive mechanism 113.

Figure 25:
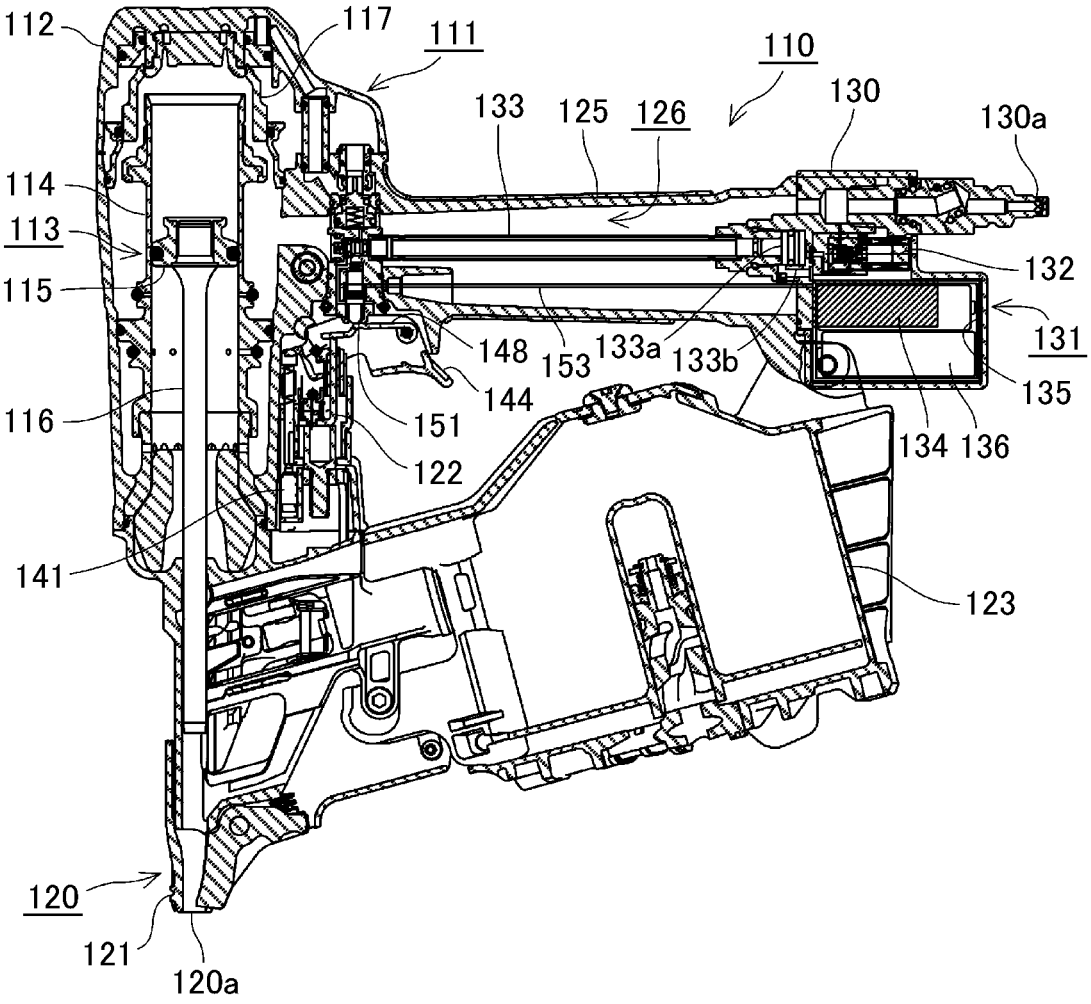
FIG. 25 is a sectional view of the pneumatic tool while the drive mechanism is being actuated.
Figure 26:
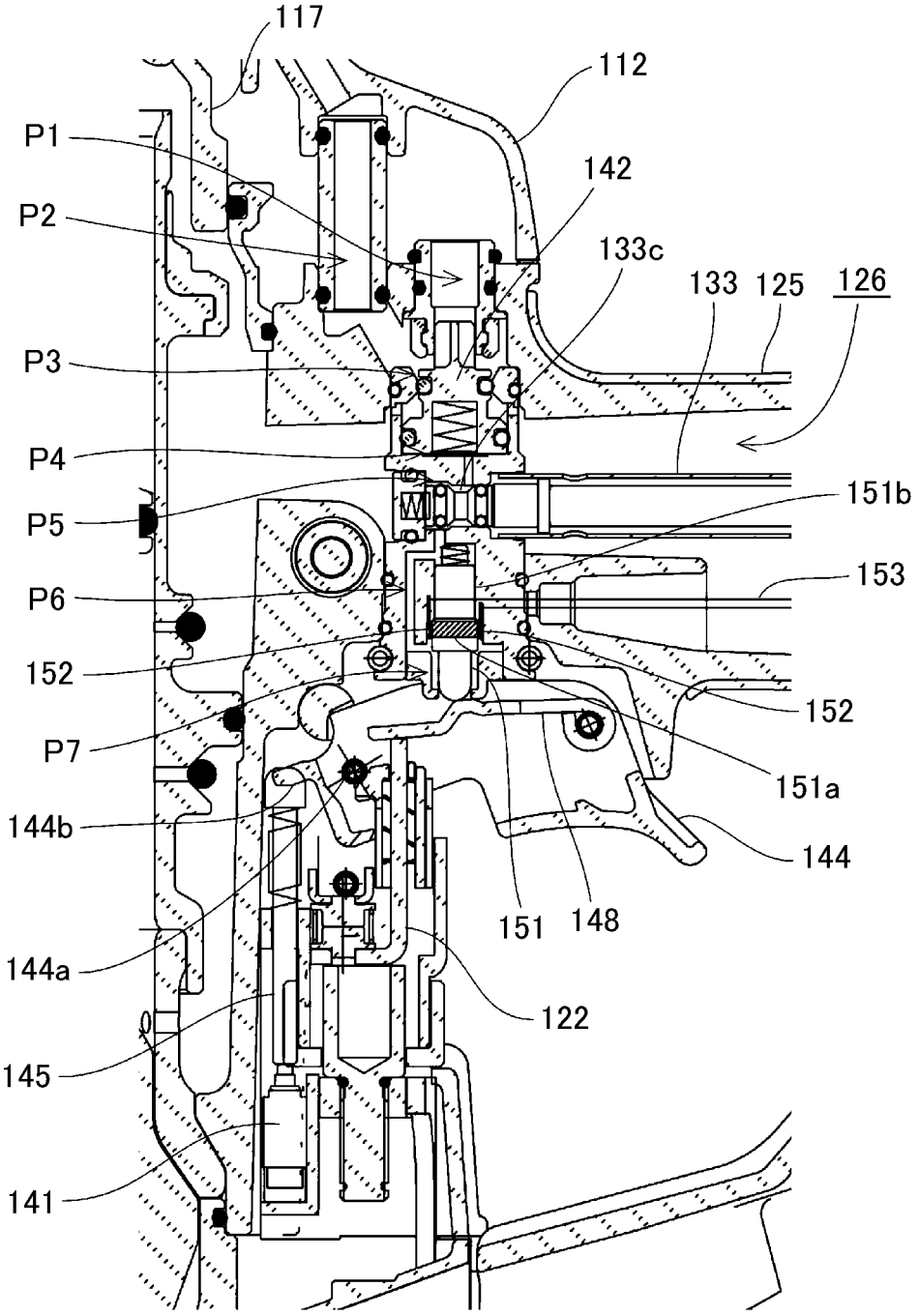
FIG. 26 is a partially enlarged sectional view of the pneumatic tool while the drive mechanism is being actuated.
Figure 27B:
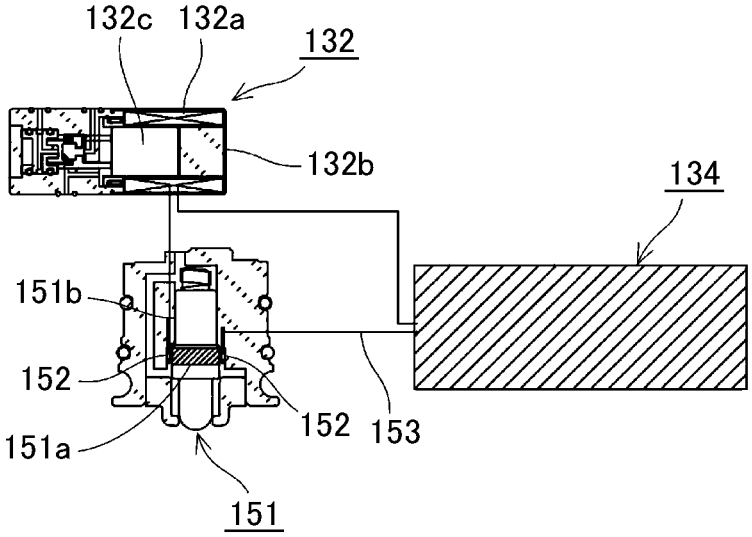
FIG. 27B is a pictorial view depicting a state in which the safety mechanism is released.

On the other hand, while the operation part 144 and the contact member 121 are operated at the same time, as shown in FIGS. 25 and 26, the effective state in which the trigger stem 151 is pushed in and moved up by the contact lever 148 is formed. In the effective state, the conductive portion 151*a* of the trigger stem 151 is in contact with both the contact points 152. Thereby, since the two contact points 152 are electrically connected, the electromagnetic valve 132 and the control substrate 134 are energized to each other, as shown in FIG. 27B. For this reason, in the effective state, the electromagnetic valve 132 can be fed with power from the control substrate 134 via the energization path 153 and the electromagnetic valve 132 can be thus actuated, so that the compressed air can be supplied to the drive mechanism 113.

According to the above configuration, the electromagnetic valve 132 is not fed with power until the safety mechanism is released, so that the electromagnetic valve 132 is prevented from electrically malfunctioning. Therefore, it is possible to prevent the actuation of the drive mechanism 113 at an unintentional timing.

Also in the present embodiment, the trigger stem 151 shifts from the ineffective state to the effective state when both the operation part 144 and the contact member 121 are operated, like the second embodiment. For this reason, the safety mechanism by the trigger stem 151 is provided, in addition to the safety mechanism by the contact member 121, so that a double safety mechanism is configured. Therefore, it is possible to prevent the actuation of the drive mechanism 113 at an unintentional timing, further securely.

In the meantime, the safety mechanism for cutting off the energization path 153 between the electromagnetic valve 132 and the control substrate 134 may be used in combination with the safety mechanism as described in the second embodiment.

That is, as shown in FIG. 24, when the trigger stem 151 is in the ineffective state, the exhaust path P6 for exhausting the compressed air in the lower space P4 of the pilot valve 142 may be closed by the trigger stem 151, as denoted with P7. As shown in FIG. 26, when the trigger stem 151 is in the effective state, the exhaust path P6 for exhausting the compressed air in the lower space P4 of the pilot valve 142 may be opened by the trigger stem 151, as denoted with P7. According to this configuration, in the ineffective state, the electrical connection between the electromagnetic valve 132 and the control substrate 134 is disconnected and the compressed air in the lower space P4 of the pilot valve 142 cannot be exhausted, so that the safety can be further increased.

Fourth Embodiment

A fourth embodiment of the present invention is described with reference to FIGS. 28 to 32.

A pneumatic tool 210 in accordance with the present embodiment is a nailing machine configured to be actuated by a pneumatic pressure of compressed air supplied from an outside, for example. In the meantime, in the present embodiment, the nailing machine is exemplified as the pneumatic tool 210. However, the pneumatic tool 210 is not limited to the nailing machine, and other tools may also be possible. For example, a tool such as a screw fastener configured to be actuated by compressed air is also possible.

Figure 28:
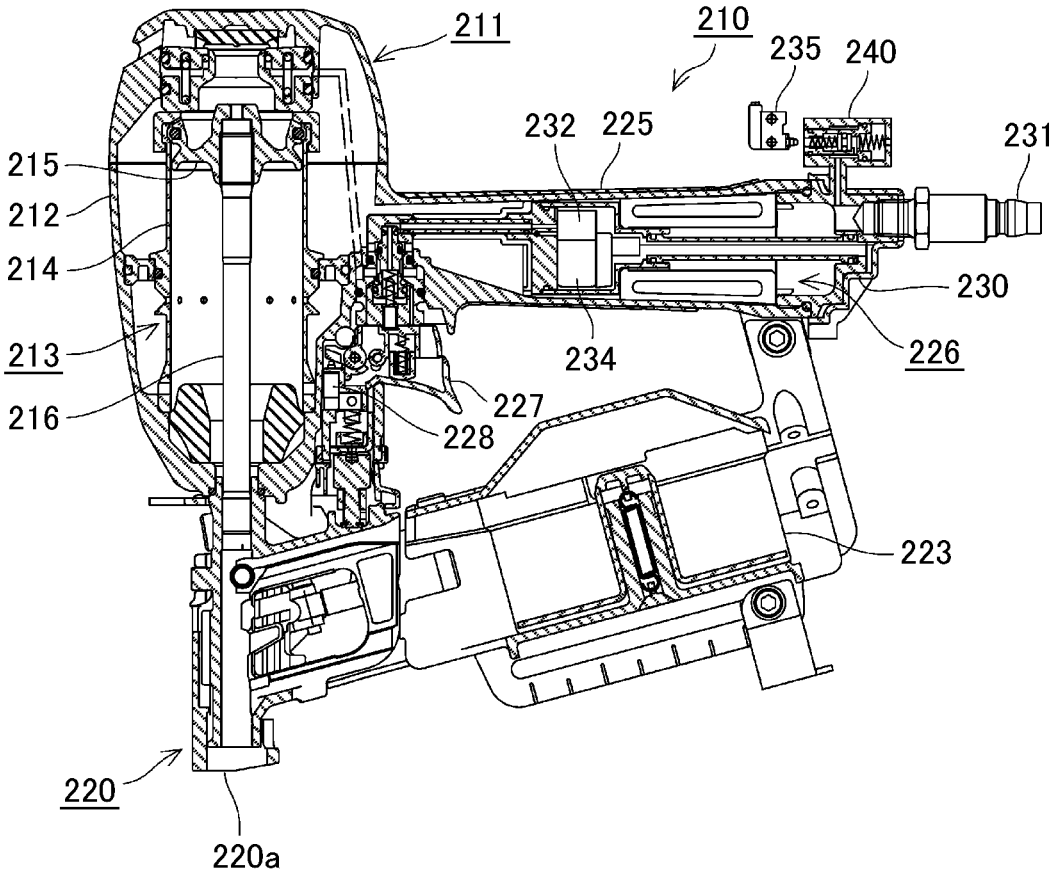
FIG. 28 is a sectional view of a pneumatic tool in accordance with a fourth embodiment of the present invention.

As shown in FIG. 28, the pneumatic tool 210 has a tool main body 211 of which a grip housing 225 is substantially perpendicularly coupled to a body housing 212.

The body housing 212 is a tubular member having a drive mechanism 213 accommodated therein. A tip end portion of the body housing 212 is provided with a nose part 220 that is to be pressed to a material to be struck. The nose part 220 is connected to a magazine 223 in which coupled nails are accommodated, and a head nail of the coupled nails loaded in the magazine 223 is supplied to the nose part 220 by a supply device. The nail supplied to the nose part 220 is struck out from an ejection port 220*a* provided to a tip end of the nose part 220 by a driver 216 (which will be described later) at the time when the drive mechanism 213 is actuated.

As shown in FIG. 28, the drive mechanism 213 in accordance with the present embodiment is actuated while sliding a piston 215 by the pneumatic pressure of the compressed air. The piston 215 is slidably arranged inside of a cylinder 214, and is impulsively slid toward the nose part 220 when the compressed air is caused to flow into an upper part of the piston 215. A driver 216 configured to slide integrally with the piston 215 is coupled to a lower part of the piston 215. The driver 216 is slidably arranged in the nose part 220, and can strike out the nail standing by in the nose part 220 toward the ejection port 220*a*.

The grip housing 225 connected to the body housing 212 has a rod shape that can be gripped by the operator. Also, an operation part 227 that can be pulled with an index finger of the operator is provided in a position in which the index finger is put when the operator grips the grip housing 225. When the operation part 227 is operated, a switch 228 for an electromagnetic valve attached to the drive mechanism 213 becomes on, so that an operation signal is output to a control substrate 234 (which will be described later). The control substrate 234 actuates an electromagnetic valve 232 (which will be described later) by using the operation signal as a trigger.

An inside of the grip housing 225 is formed as a space as shown in FIG. 28. By the space, a main chamber 226 in which the compressed air is stored is formed. The compressed air supplied from an outside is stored in the main chamber 226 and is used to strike out the nail, for example.

Also, a grip end member 230 for closing the main chamber 226 is attached to a rear end portion of the grip housing 225 (an end portion on an opposite side to the body housing 212). The grip end member 230 is detachably mounted to the grip housing 225. The grip end member 230 is provided with a joint 231 to which a plug 256 of a hose 255 is detachably mounted. The hose 255 connected to an external air supply source (an air compressor or the like) is connected to the joint 231, so that the compressed air can be supplied to the main chamber 226.

Also, an electromagnetic valve 232 and a control substrate 234 for controlling the drive mechanism 213 are arranged inside of the main chamber 226.

The electromagnetic valve 232 is to control supply of the compressed air to the drive mechanism 213. The electromagnetic valve 232 is actuated to switch a flow path of the compressed air when current is supplied from the control substrate 234. The electromagnetic valve 232 is actuated, so that a valve inside of the pneumatic tool 210 is accordingly actuated and the compressed air is caused to rapidly flow into the upper part of the piston 215. The compressed air is caused to rapidly flow into the upper part of the piston 215 in this way, so that the drive mechanism 213 is actuated and the nail is struck out from the ejection port 220*a*.

The control substrate 234 is to control actuations of electric components such as the electromagnetic valve 232. The control substrate 234 has a circuit for executing processing by using an input of an electric signal as a trigger. In the present embodiment, a switch 228 for an electromagnetic valve and the like are connected to an input-side of the control substrate 234. Also, the electromagnetic valve 232 and the like are connected to an output-side of the control substrate 234. When it is detected that both the switch 228 for an electromagnetic valve becomes on, the control substrate 234 executes control of switching the electromagnetic valve 232 to an on state by supplying current to a coil of the electromagnetic valve 232.

Also, the pneumatic tool 210 in accordance with the present embodiment includes a main power supply switch 235, and a switch pushing mechanism 240. In the meantime, it is shown in FIG. 28 that the main power supply switch 235 and the switch pushing mechanism 240 protrude outside of the grip housing 225. However, FIG. 28 is a drawing for convenience sake. The main power supply switch 235 and the switch pushing mechanism 240 may be arranged in any places, and, for example, may be arranged at the grip end member 230, on a side surface or inside of the grip housing 225, or on a side surface or inside of the body housing 212.

The main power supply switch 235 is a switch for switching on and off states of supply of power to the control substrate 234. The main power supply switch 235 has a button 235*a* protruding from a main body so that it can be pressed, and power can be fed to the control substrate 234 in a pressed state of the button 235*a*. In contrast, the power is not fed to the control substrate 234 in a non-pressed state of the button 235*a*. In this way, in a state in which the main power supply switch 235 is off, the power is not consumed.

The switch pushing mechanism 240 is to switch on and off states of the main power supply switch 235, and is configured to press the button 235*a* of the main power supply switch 235. The switch pushing mechanism 240 is configured to switch on and off states of the main power supply switch 235 by an operation of detachably connecting the hose 255 to the joint 231.

Figure 29A:
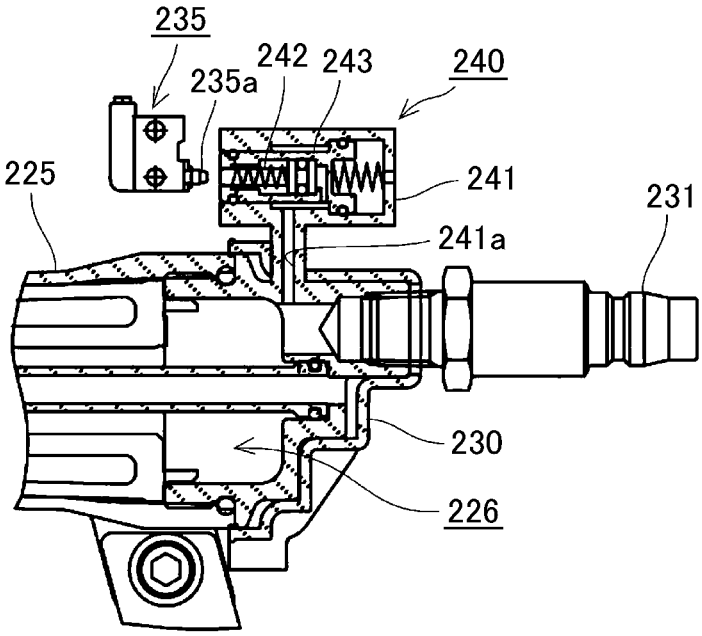
FIG. 29A is a partially enlarged sectional view of the pneumatic tool.
Figure 29B:
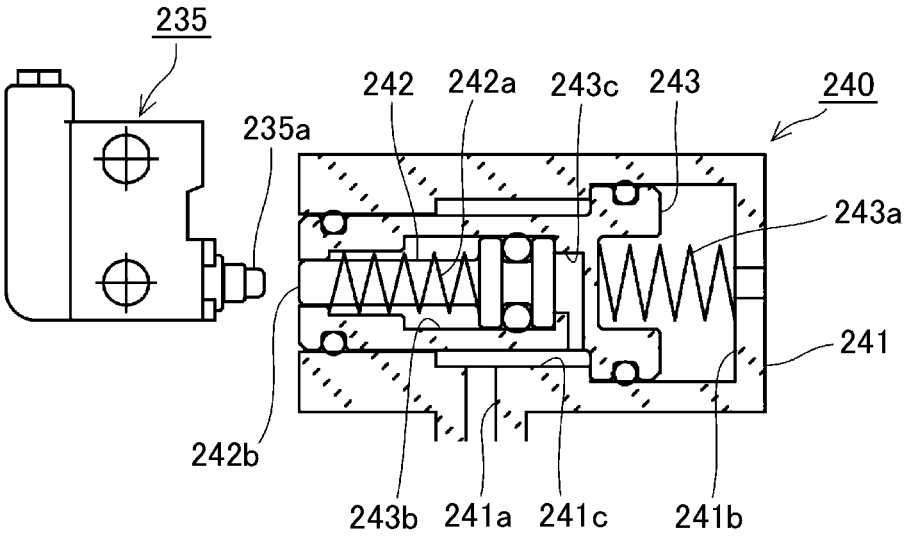
FIG. 29B is a further enlarged view of a switch pushing mechanism, before a plug is mounted or in a low-pressure state.

Specifically, as shown in FIGS. 29A and 29B, the switch pushing mechanism 240 in accordance with the present embodiment is arranged to face toward the button 235*a* of the main power supply switch 235, and includes a piston accommodation part 241, a first piston 242, and a second piston 243.

The piston accommodation part 241 is to telescopically accommodate the first piston 242 and the second piston 243. An inside of the piston accommodation part 241 is hollow, and forms a second slide chamber 241*b* in which the second piston 243 is slidably accommodated, and a second pressure chamber 241*c* in which the compressed air to be applied to the second piston 243 is caused to flow. The second pressure chamber 241*c* communicates with the main chamber 226 through an air inflow path 241*a*. For this reason, when the compressed air is supplied to the main chamber 226, the compressed air in the main chamber 226 flows into the second pressure chamber 241*c* through the air inflow path 241*a*.

The second piston 243 is a position that is slidably accommodated in the second slide chamber 241*b*. The second piston 243 is supported to be slidable in parallel to a pressing direction of the button 235*a* of the main power supply switch 235, in the second slide chamber 241*b*. Also, the second piston 243 is urged toward the main power supply switch 235 by a spring 243*a* for a second piston. The second piston 243 is pressed in an opposite direction to the main power supply switch 235 (in an opposite direction to the urging direction of the spring 243*a* for a second piston) by a pneumatic pressure in the second pressure chamber 241*c*. For this reason, when the atmospheric pressure in the second pressure chamber 241*c* is increased and exceeds the urging force of the spring 243*a* for a second piston, the second piston 243 is slid in the opposite direction to the main power supply switch 235 against the urging force of the spring 243*a* for a second piston.

In the second piston 243, a first slide chamber 243*b* in which the first piston 242 is slidably accommodated and a first pressure chamber 243*c* in which the compressed air to apply to the first piston 242 is to flow are formed. The first pressure chamber 243*c* communicates with the main chamber 226 via the second pressure chamber 241*c*. For this reason, when the compressed air is supplied to the main chamber 226, the compressed air in the main chamber 226 flows into the first pressure chamber 243*c* through the air inflow path 241*a* and the second pressure chamber 241*c*. The main chamber 226 and the first pressure chamber 243*c* and second pressure chamber 241*c* communicate with each other in this way, so that the respective atmospheric pressures therein are the same.

The first piston 242 is a piston that is slidably accommodated in the first slide chamber 243*b*. The first piston 242 is supported to be slidable in parallel to the pressing direction of the button 235*a* of the main power supply switch 235, in the first slide chamber 243*b*. Also, the first piston 242 is urged in the opposite direction to the main power supply switch 235 by a spring 242*a* for a first piston. The first piston 242 is pressed toward the main power supply switch 235 (in an opposite direction to the urging direction of the spring 242*a* for a first piston) by a pneumatic pressure in the first pressure chamber 243*c*. For this reason, when the atmospheric pressure in the first pressure chamber 243*c* is increased and exceeds the urging force of the spring 242*a* for a first piston, the first piston 242 is slid toward the main power supply switch 235 against the urging force of the spring 242*a* for a first piston.

Also, the first piston 242 has a protrusion 242*b* that can protrude outside of the piston accommodation part 241. The button 235*a* of the main power supply switch 235 is arranged in a direction of a tip end of the protrusion 242*b*.

When the first piston 242 is slid by the pneumatic pressure of the compressed air supplied from the hose 255, the button 235*a* of the main power supply switch 235 can be pressed by the protrusion 242*b*.

As described above, the first piston 242 and the second piston 243 are urged in opposite directions by the springs. Also, when the atmospheric pressure in the main chamber 226 increases, the first piston 242 and the second piston 243 are slid in the opposite directions. However, an atmospheric pressure at which the first piston 242 starts to slide is set lower than an atmospheric pressure at which the second piston 243 starts to slide. Specifically, when the atmospheric pressure in the main chamber 226 is an atmospheric pressure within a preset predetermined range (a proper pressure in the pneumatic tool 210), only the first piston 242 is slid and the second piston 243 is not slid. On the other hand, when the atmospheric pressure in the main chamber 226 is lower than the proper pressure, neither the first piston 242 nor the second piston 243 is slid. Also, when the atmospheric pressure in the main chamber 226 is higher than the proper pressure, both the first piston 242 and the second piston 243 are slid.

The switch pushing mechanism 240 operates, as follows.

First, as shown in FIGS. 29A and 29B, when the atmospheric pressure in the main chamber 226 is low, for example, when the plug 256 of the hose 255 is not mounted, when the pressure of the compressed air to be supplied from the outside is within the predetermined range (proper pressure), and the like, the atmospheric pressures in the first pressure chamber 243*c* and the second pressure chamber 241*c* are not sufficiently increased, so that both the first piston 242 and the second piston 243 are not slid. In this state, since the button 235*a* of the main power supply switch 235 is not pressed, the power supply is kept in the off state.

Figure 30A:
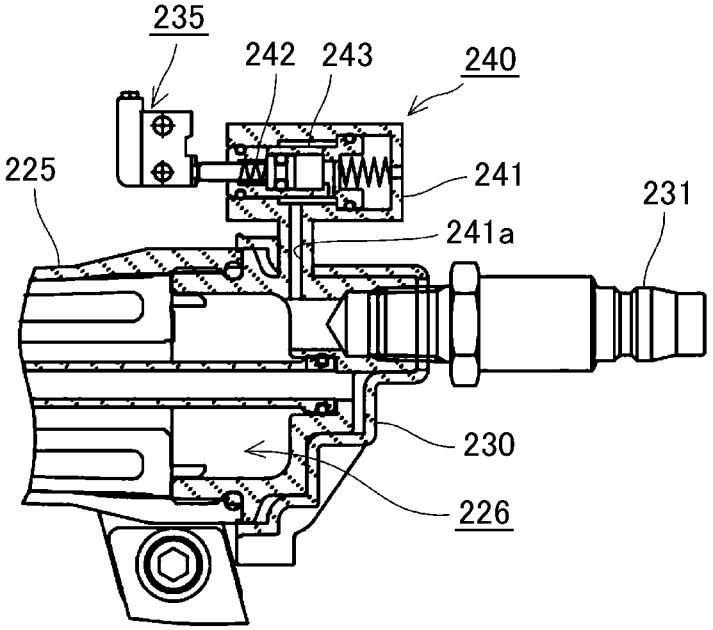
FIG. 30A is a partially enlarged sectional view of the pneumatic tool.
Figure 30B:
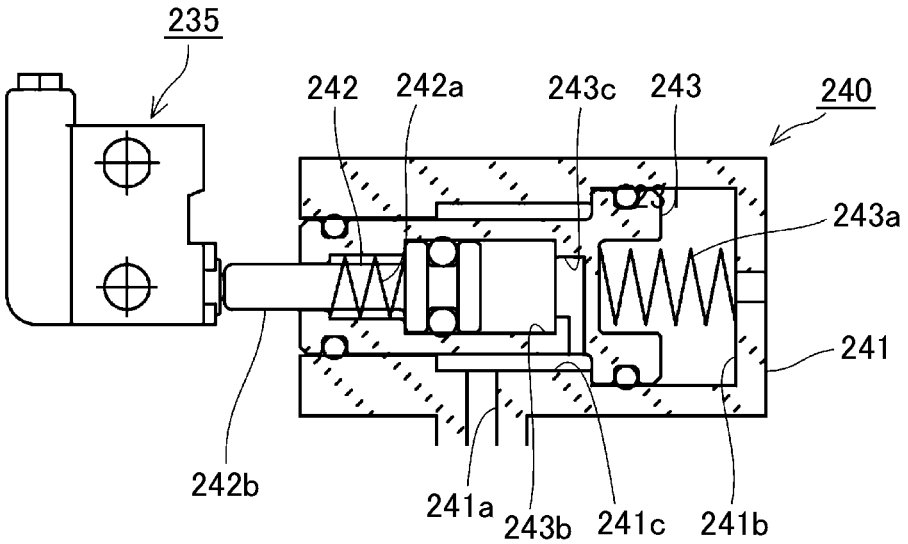
FIG. 30B is a further enlarged view of the switch pushing mechanism, in a proper pressure state.

On the other hand, when the plug 256 of the hose 255 is mounted to the joint 231 and the compressed air within the predetermined range (proper pressure) is supplied from the outside, only the first piston 242 is slid in the direction of the main power supply switch 235, as shown in FIGS. 30A and 30B, and the button 235*a* of the main power supply switch 235 is pressed. Thereby, the power supply becomes on and the control substrate 234 becomes in the energization state, so that the pneumatic tool 210 can be used.

Figure 31A:
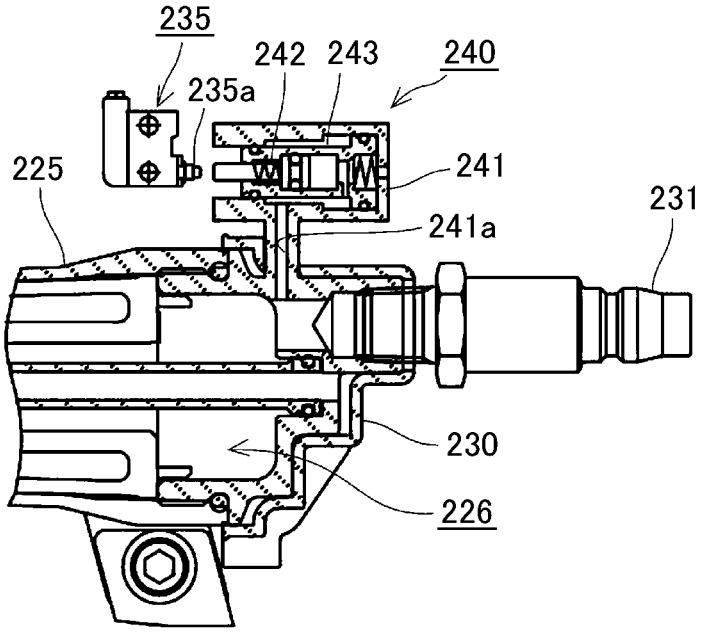
FIG. 31A is a partially enlarged sectional view of the pneumatic tool.
Figure 31B:
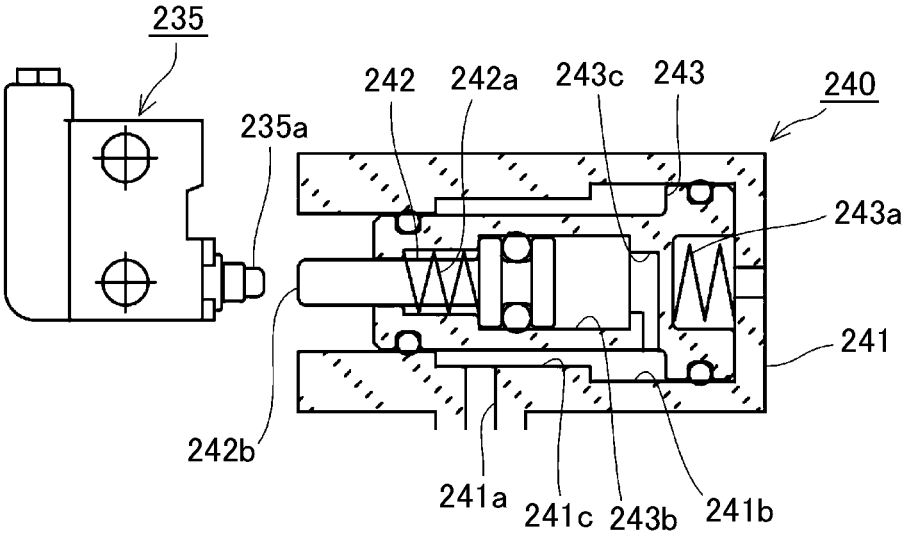
FIG. 31B is a further enlarged view of the switch pushing mechanism, in a high-pressure state.

As shown in FIGS. 31A and 31B, when the pressure of the compressed air to be supplied from the outside exceeds the predetermined range (proper pressure), the first piston 242 is slid and the second piston 243 in which the first piston 242 is accommodated is also slid in an opposite direction to the slide direction of the first piston 242. For this reason, the slide of the first piston 242 is cancelled by the slide of the second piston 243, so that the button 235*a* of the main power supply switch 235 is not pressed. Therefore, the power supply becomes off.

As described above, according to the present embodiment, the main power supply switch 235 is configured to be switched between the on and off states by the operation of detachably connecting the hose 255 to the joint 231. According to this configuration, since the on and off states of the main power supply switch 235 are switched, depending on whether the hose 255 for supplying the compressed air is connected, it is possible to suppress the useless energization when not in-use, thereby saving the power.

Also, the first piston 242 that is actuated by the pneumatic pressure of the compressed air supplied from the hose 255 is provided, and the main power supply switch 235 is arranged so that it can be pressed by the first piston 242. According to this configuration, since the main power supply switch 235 can be pressed by the piston that is actuated by the pneumatic pressure, a useable state is formed as the air is supplied, and the power supply is automatically turned on at the same time.

Also, the second piston 243 configured to slidably hold the first piston 242 is provided, and when the pneumatic pressure of the compressed air supplied from the hose 255 is within the predetermined range, only the first piston 242 is slid to press the main power supply switch 235, and when the pneumatic pressure of the compressed air supplied from the hose 255 exceeds the predetermined range, the second piston 243 is slid in the opposite direction to the slide direction of the first piston 242, so that the main power supply switch 235 is not pressed. According to this configuration, the power supply is turned on only when the compressed air of the proper pressure in the pneumatic tool 210 is supplied.

In the meantime, a notification device that, when the compressed air of the proper pressure is supplied and the main power supply is thus turned on, notifies the operator that the main power supply is turned on may be provided. For example, visual information such as an LED may be used to notify that the main power supply is turned on, a sound by a speaker may be used to notify that the main power supply is turned on or vibrations by a vibration motor may be used to notify that the main power supply is turned on. Also, when the main power supply is not turned on because the pneumatic pressure of the compressed air supplied from the hose 255 is not within the predetermined range even though the hose 255 is connected, an error may be notified.

Also, in the above embodiment, the first piston 242 is slidably held by the second piston 243. However, the present invention is not limited thereto. For example, the second piston 243 may be omitted. That is, the piston accommodation part 241 may be configured to slidably hold the first piston 242, and the main power supply switch 235 may be pressed by the first piston 242. According to this configuration, as compared to the above embodiment, while the function of not pressing the button 235*a* of the main power supply switch 235 when the supply pressure from the outside is significantly high is lost, the number of components can be reduced.

Modified Examples of Fourth Embodiment

Also, in the above embodiment, the piston is actuated to press the main power supply switch 235 by the pressure of the compressed air. However, the present invention is not limited thereto. For example, a configuration as shown in FIGS. 32A and 32B is also possible.

Figure 32A:
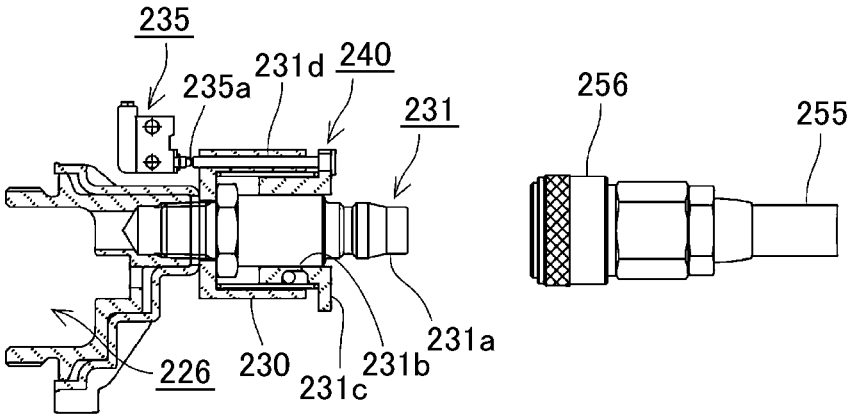
Figure 32B:
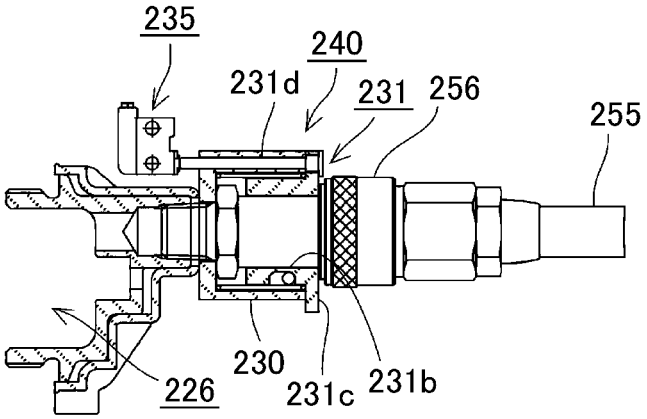

A joint 231 in accordance with a modified example shown in FIGS. 32A and 32B has a socket main body 231*a*, and a sleeve member 231*b* slidably provided on an outer periphery of the socket main body 231*a*.

The socket main body 231*a* is a tubular member to which the plug 256 attached to the tip end of the hose 255 can be detachably mounted. The socket main body 231*a* has a hollow air flow path therein, and is formed so that the compressed air can be introduced into the main chamber 226 from the outside through the air flow path. The socket main body 231*a* is provided to protrude in a direction of the rear end of the grip housing 225, and can be inserted inside of the plug 256.

The sleeve member 231*b* is a tubular member that is provided to be slidable in an axis direction of the socket main body 231*a*. The sleeve member 231*b* is urged in a direction of a tip end of the socket main body 231*a* by a spring or the like, and an end portion in the direction of the tip end is formed with a flange portion 231*c*. When the plug 256 is mounted to the socket main body 231*a*, the flange portion 231*c* contacts a front end portion of the plug 256 and is thus pressed. When the socket main body 231*a* is inserted into the plug 256 and both are completely connected, the front end portion of the plug 256 presses the flange portion 231*c*, thereby pushing the sleeve member 231*b* toward the inside against the urging force of the spring.

Also, a stem 231*d* capable of pressing the button 235*a* of the main power supply switch 235 is attached to the sleeve member 231*b*. The stem 231*d* is arranged not to press the button 235*a* of the main power supply switch 235 before the sleeve member 231*b* is slid (before the plug 256 is mounted to the socket main body 231*a*), as shown in FIG. 32A. Also, the stem 231*d* is arranged to press the button 235*a* of the main power supply switch 235 after the sleeve member 231*b* is slid (after the plug 256 is mounted to the socket main body 231*a*), as shown in FIG. 32B.

In this way, when the plug 256 is mounted to the socket main body 231*a*, the sleeve member 231*b* may be pushed in by the plug 256, and the main power supply switch 235 may be pressed by the pushed-in sleeve member 231*b*. Even with the configuration, since the on and off states of the main power supply switch 235 are switched, depending on whether the hose 255 for supplying the compressed air is connected, it is possible to suppress the useless energization when not in-use, thereby saving the power.

Fifth Embodiment

Figure 33:
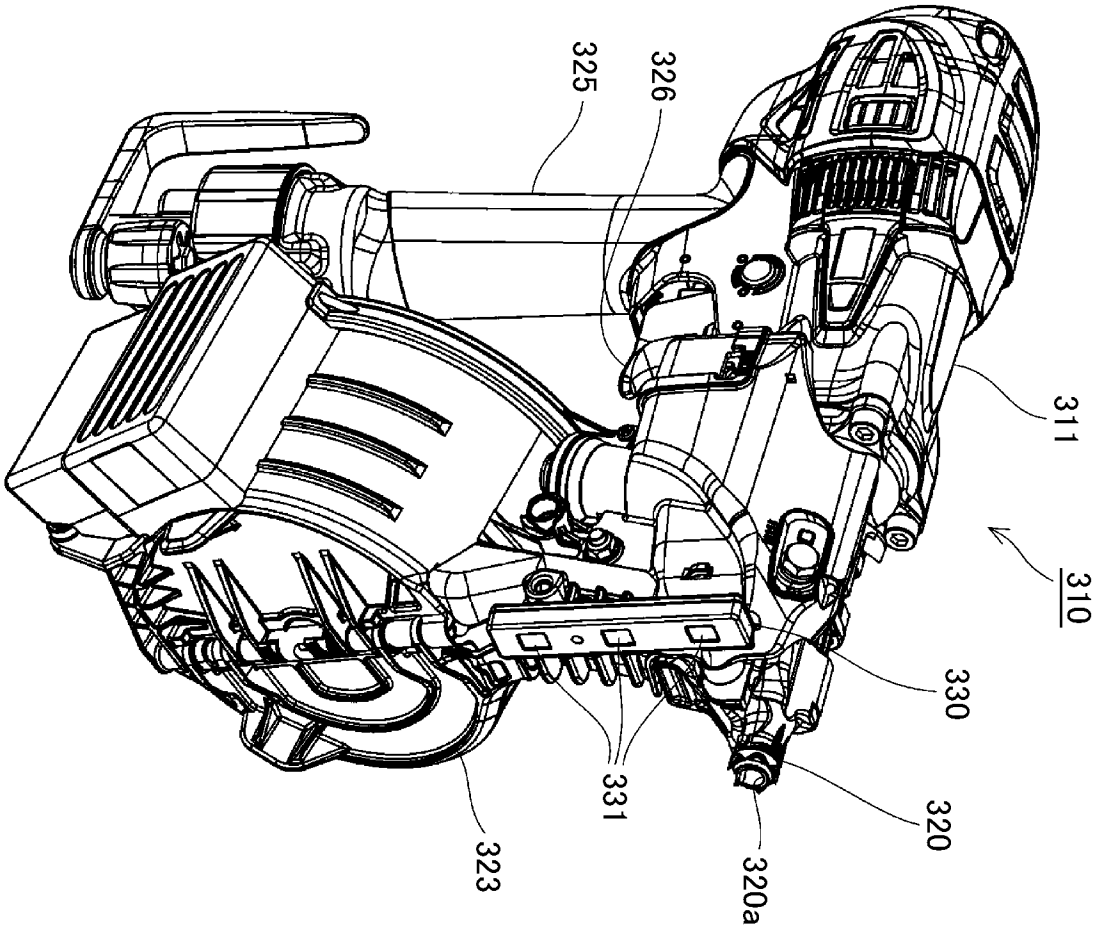
FIG. 33 depicts an outer appearance of a portable power-driven tool in accordance with a fifth embodiment of the present invention, as seen from front.
Figure 34:
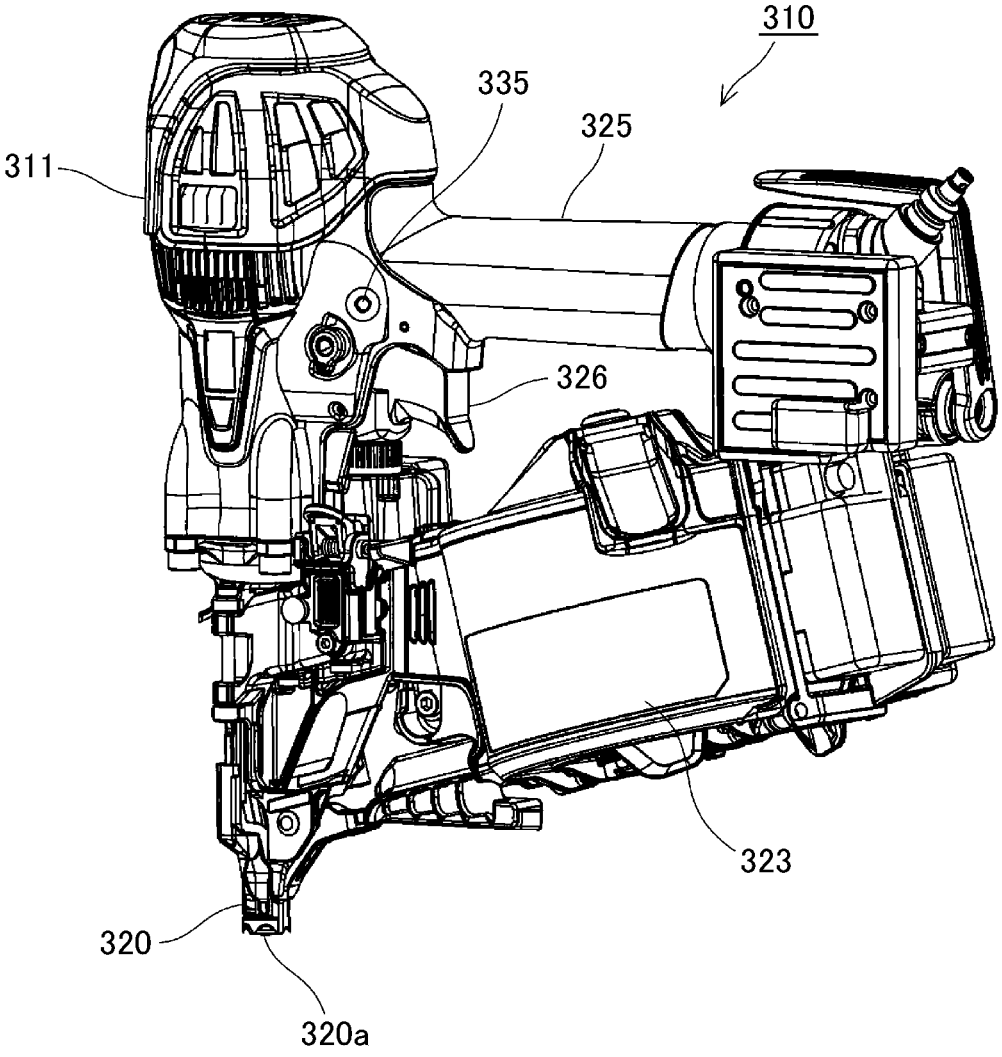
FIG. 34 depicts an outer appearance of the portable power-driven tool, as seen from a side.

A portable power-driven tool 310 in accordance with a fifth embodiment of the present invention is a tool configured to operate in a hand-held state on an operation site. For example, the portable power-driven tool is a nailing machine configured to be actuated by the pneumatic pressure of the compressed air supplied from the outside, as shown in FIGS. 33 and 34. In the meantime, in the present embodiment, the pneumatic pressure-type tool is exemplified as the portable power-driven tool 310. However, the portable power-driven tool 310 is not limited to the air driving tool, and may be a tool that is driven by the related-art power such as an electric type tool, a gas type tool and the like. Also, the type of the tool is not limited to the nailing machine, and any type tool is possible inasmuch as it is a hand-held portable power-driven tool 310.

As shown in FIGS. 33 and 34, the portable power-driven tool 310 has such a configuration that a grip housing 325 is substantially perpendicularly coupled to a body housing 311.

The body housing 311 is a tubular member in which a drive mechanism is accommodated. A tip end portion of the body housing 311 is provided with a nose part 320 that is to be pressed to a material to be struck. The nose part 320 is connected to a magazine 323 in which coupled nails are accommodated, and a head nail of the coupled nails loaded in the magazine 323 is supplied to the nose part 320 by a supply device. The nail supplied to the nose part 320 is struck out from an ejection port 320*a* provided to a tip end of the nose part 320 when the drive mechanism is actuated.

In the meantime, although not specifically shown, the drive mechanism in accordance with the present embodiment is actuated while sliding a piston by the pneumatic pressure of the compressed air. A driver configured to slide integrally with the piston is coupled to a lower part of the piston. The driver is slidably arranged in the nose part 320, and can strike out the nail standing by in the nose part 320 toward the ejection port 320*a*.

The grip housing 325 connected to the body housing 311 has a rod shape that can be gripped by the operator. Also, an operation part 326 that can be pulled with an index finger of the operator is provided in a position in which the index finger is put when the operator grips the grip housing 325. When the operation part 326 is operated, the drive mechanism is actuated.

The portable power-driven tool 310 in accordance with the present embodiment has an illumination device including lights 331 and a brightness sensor 335.

The light 331 is to irradiate an operation place, and for example, an LED can be used. The light 331 is arranged to irradiate light in a direction of the tip end of the body housing 311. In the present embodiment, a plurality of lights 331 is provided in parallel to face toward an operation surface.

As shown in FIG. 33, the light 331 is embedded in an illumination accommodation part 330 arranged on a side part of the nose part 320. The illumination accommodation part 330 accommodates the plurality of lights 331 in the longitudinal direction. For example, a substrate on which the plurality of lights 331 is linearly provided in parallel is accommodated in the illumination accommodation part 330, and the illumination accommodation part 330 is provided as a case that covers the substrate.

The brightness sensor 335 is a sensor configured to detect a surrounding brightness. The brightness sensor 335 is to detect an amount of light that is incident on a light-receiving surface 335*a*, and is configured to output an electric signal indicative of whether the amount of light exceeds a preset predetermined threshold value. The light 331 is turned on or off depending on the electric signal output from the brightness sensor 335. Specifically, when the brightness detected by the brightness sensor 335 exceeds the preset predetermined threshold value, the light 331 is not turned on, and when the brightness detected by the brightness sensor 335 does not reach the preset predetermined threshold value, the light 331 is turned on.

Figure 35A:
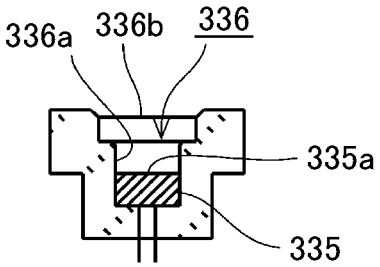

As shown in FIG. 35A, the brightness sensor 335 is accommodated in a sensor accommodation part 336 provided on a side surface of the body housing 311. The sensor accommodation part 336 is a hole recessed from a surface of the body housing 311, and the brightness sensor 335 is arranged on a bottom of the sensor accommodation part 336. The sensor accommodation part 336 has a peripheral wall 336*a* that forms the hole, and an upper end portion of the peripheral wall 336*a* is formed as an opening portion 336*b*. The brightness sensor 335 is arranged so that the light-receiving surface 335*a* faces toward the opening portion 336*b* of the sensor accommodation part 336, and can detect the light that is incident from the opening portion 336*b*.

In the meantime, in the present embodiment, the sensor accommodation part 336 is formed as a step hole shape. For this reason, even when the sensor accommodation part 336 is formed deep and the brightness sensor 335 is arranged on an inner side thereof, the opening portion 336*b* is formed large, so that the light can be easily incident on the brightness sensor 335. The brightness sensor 335 is arranged on the inner side, so that even when the opening portion 336*b* is blocked with a finger, as described later, the finger is not contacted to the brightness sensor 335. Also, a cover 337 that will be described later can be attached using the step hole shape.

Figure 35B:
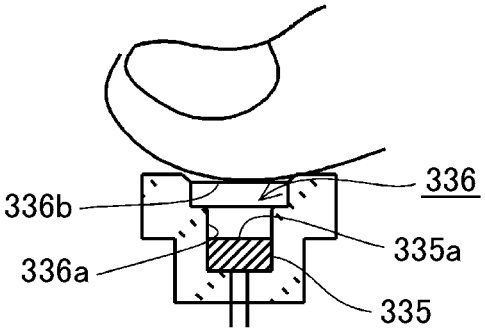

As shown in FIG. 34, the brightness sensor 335 in accordance with the present embodiment is arranged in the vicinity of the grip housing 325, and is also arranged within a range in which it can be covered with a finger of the operator who grips the grip housing 325. Specifically, the brightness sensor 335 is arranged in a position in which it can be covered with a thumb when the grip housing 325 is gripped with a right hand. For this reason, as shown in FIG. 35B, when the opening portion 336*b* of the sensor accommodation part 336 is covered with a finger, the light is prevented from being incident on the light-receiving surface 335*a* of the brightness sensor 335. By this configuration, it is possible to turn on or off the light 331, irrespective of the surrounding brightness. That is, the brightness sensor 335 is covered with a finger, so that the finger can be used as an alternative to a manual switch.

Figure 35C:
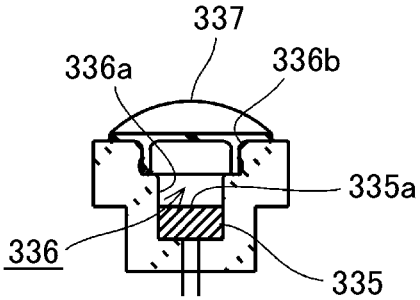

Also, as shown in FIG. 35C, the portable power-driven tool 310 in accordance with the present embodiment includes a cover 337 that can be fixed to the sensor accommodation part 336 so as to prevent the light from being incident on the brightness sensor 335. The cover 337 can be attached to the sensor accommodation part 336 in a cap shape. The cover 337 is attached, so that the light can be prevented from being incident on the light-receiving surface 335*a* of the brightness sensor 335. The cover 337 can be attached, so that it is possible to turn on or off the light 331, irrespective of the surrounding brightness. That is, the brightness sensor 335 is covered with the cover 337, so that the cover can be used as an alternative to a manual switch.

In the meantime, the cover 337 in accordance with the present embodiment is configured to have a cap shape, but the aspect of the cover 337 is not limited thereto. That is, any shape/material can be used inasmuch as it is possible to invalidate the brightness sensor 335. For example, a configuration in which a slide or rotary type cover 337 is attached in the vicinity of the sensor accommodation part 336 and the cover 337 is moved to switch validation/invalidation of the brightness sensor 335 is also possible.

As described above, according to the present embodiment, the brightness sensor 335 configured to detect the surrounding brightness and the light 331 that is turned on or off depending on a detection result of the brightness sensor 335 are provided. For this reason, the light 331 is automatically turned on when it is intended to perform an operation in a dark place. Therefore, the on/off operation of the illumination is automatically performed even though a manual operation is not performed, and the illumination can be safely turned on even before the operation starts.

First Modified Example of Fifth Embodiment

In the meantime, the present invention is not limited to the above aspect, and a light amount regulating part for regulating an amount of light to be incident on the brightness sensor 335 may be provided. When the light amount regulating part is provided, sensitivity of the brightness sensor 335 can be regulated. Therefore, it is possible to regulate an amount of light so that the light 331 is automatically turned on at darkness desired by the operator.

Figure 36A:
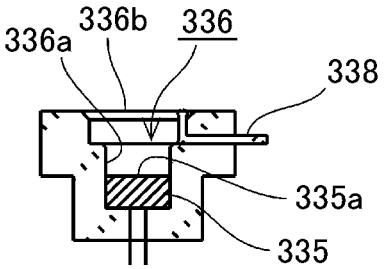
Figure 36B:
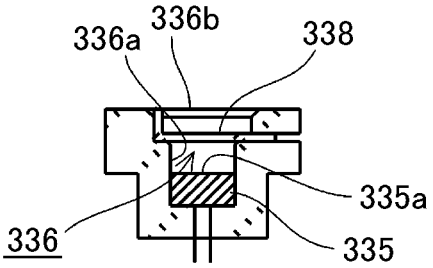

As the light amount regulating part, for example, a slide member 338 as shown in FIGS. 36A and 36B may be provided. The slide member 338 is provided so as to be slidable in a direction of covering the light-receiving surface 335*a* of the brightness sensor 335. Specifically, the slide member is configured to be slidable between a position in which the light-receiving surface 335*a* of the brightness sensor 335 is completely opened, as shown in FIG. 36A, and a position in which the light-receiving surface 335*a* of the brightness sensor 335 is completely shielded, as shown in FIG. 36B. The slide member 338 can be fixed in any position between the position shown in FIG. 36A and the position shown in FIG. 36B, so that an exposed amount of the light-receiving surface 335*a* of the brightness sensor 335 can be regulated in a stepless manner. When the light amount regulating part is used, the sensitivity of the brightness sensor 335 can be freely regulated by the operator.

Second Modified Example of Fifth Embodiment

Figure 37A:
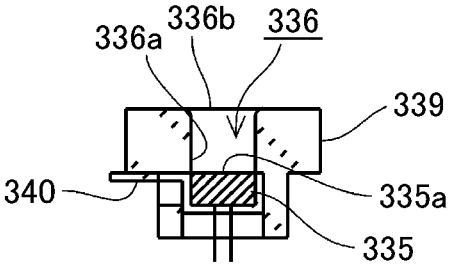
Figure 37B:
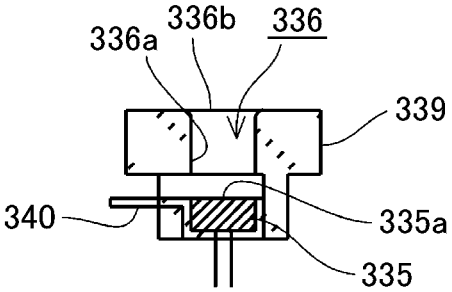

Also, as another example of the light amount regulating part, a configuration as shown in FIGS. 37A and 37B is also possible. A light amount regulating part shown in FIGS. 37A and 37B is configured so that relative positions of the opening portion 336*b* of the sensor accommodation part 336 and the brightness sensor 335 can be changed. For example, a sensor holding member 340 configured to hold the brightness sensor 335 inside of the sensor accommodation part 336 may be provided. The sensor holding member 340 is configured to be movable toward or away from the opening portion 336*b*. By manually moving the sensor holding member 340, the brightness sensor 335 may be moved toward the opening portion 336*b*, as shown in FIG. 37A or the brightness sensor 335 may be moved away from the opening portion 336*b*, as shown in FIG. 37B. According to this configuration, as the brightness sensor 335 is moved, it is easy or difficult for the light to reach the brightness sensor 335. Therefore, the sensitivity of the brightness sensor 335 can be freely regulated by the operator.

In the meantime, in the descriptions above, the brightness sensor 335 is configured to be movable. However, the present invention is not limited thereto. For example, a height of the peripheral wall 336*a* of the sensor accommodation part 336 may be configured to be changeable. That is, a wall forming member 339 forming the peripheral wall 336*a* of the sensor accommodation part 336 may be provided, and the wall forming member 339 may be configured to be movable relative to the brightness sensor 335. By manually moving the wall forming member 339, the brightness sensor 335 may be moved toward the opening portion 336*b*, as shown in FIG. 37A or the brightness sensor 335 may be moved away from the opening portion 336*b*, as shown in FIG. 37B. Even with the configuration, since it is easy or difficult for the light to reach the brightness sensor 335, the sensitivity of the brightness sensor 335 can be freely regulated by the operator.

Also, not only the light 331 is turned on or off depending on a detection result of the brightness sensor 335, but also an output (brightness) of the light 331 may be automatically regulated in accordance with the detection result of the brightness sensor 335. That is, the brightness of the light 331 may be changed in accordance with the detection result of the brightness sensor 335. For example, when the surrounding is dark, the light 331 is turned on to improve the operability, and when the surrounding is not dark so much (the surrounding is slightly bright), the output of the light 331 is reduced to the minimum brightness, so that it is possible to reduce the power consumption while securing the predetermined brightness.

In the meantime, the fifth embodiment can be applied to the first to fourth embodiments.

The specification discloses at least following inventions.

(1) A pneumatic tool comprising:

a drive mechanism configured to be actuated by a pneumatic pressure of compressed air, a body housing having the drive mechanism embedded therein, a grip housing connected to the body housing, and an electromagnetic valve configured to control supply of the compressed air to the drive mechanism, wherein the electromagnetic valve is arranged on an opposite side to the body housing, as seen in an extension direction of the grip housing.

According to the invention (1), the electromagnetic valve is arranged on the opposite side to the body housing, as seen in the extension direction of the grip housing. According to this configuration, the electromagnetic valve can be arranged in a position distant from the drive mechanism from which impact is generated. Also, since the electromagnetic valve is arranged on a front side of a hand gripping the grip housing, the impact is buffered by the hand gripping the grip housing before the impact of the drive mechanism is transmitted to the electromagnetic valve. Therefore, even when the impact is generated upon actuation of the drive mechanism, it is possible to reduce an influence of the impact on the electromagnetic valve.

(2) The pneumatic tool according to the invention (1), wherein the electromagnetic valve is arranged on a further opposite side to the body housing than a grip part of the grip housing, as seen in the extension direction of the grip housing.

(3) The pneumatic tool according to the invention (1) or (2), wherein the electromagnetic valve is attached to an end portion of the grip housing.

(4) The pneumatic tool according to any one of the inventions (1) to (3), further comprising a switch for the electromagnetic valve, configured to switch opened and closed states of the electromagnetic valve, wherein the switch for the electromagnetic valve is arranged on the opposite side to the body housing, as seen in the extension direction of the grip housing.

(5) The pneumatic tool according to any one of the inventions (1) to (4), further comprising a control substrate configured to control an actuation of the electromagnetic valve, wherein the control substrate is arranged on the opposite side to the body housing, as seen in the extension direction of the grip housing.

(6) The pneumatic tool according to any one of the inventions (1) to (5), wherein a moving direction of a movable iron core of the electromagnetic valve is arranged so as to be different from an occurrence direction of impact that is generated when the drive mechanism is actuated.

(7) The pneumatic tool according to any one of the inventions (1) to (6), wherein a moving direction of a valve body of the electromagnetic valve is arranged in the extension direction of the grip housing.

(8) The pneumatic tool according to any one of the inventions (1) to (7), wherein a valve stem configured to be actuated in conjunction with the electromagnetic valve is arranged inside of the grip housing, and wherein the valve stem is moved in a longitudinal direction of the grip housing, so that supply of the compressed air to the drive mechanism is executed.

(9) A pneumatic tool comprising:

a drive mechanism configured to be actuated by a pneumatic pressure of compressed air, an electromagnetic valve configured to control supply of the compressed air to the drive mechanism, a control substrate configured to control actuations of the electromagnetic valve, and a power supply terminal configured to receive supply of power, wherein the electromagnetic valve and the control substrate are unitized to configure a control unit, and the control unit is detachably mounted integrally to the tool main body.

According to the invention (9), the electromagnetic valve for controlling supply of the compressed air to the drive mechanism is provided. Therefore, since the supply of the compressed air is electrically controlled by the electromagnetic valve, it is possible to easily perform timing control on the drive mechanism. Also, the electromagnetic valve and the control substrate are unitized to configure a control unit, and the control unit is detachably mounted integrally to the tool main body. For this reason, since the electric components can be unitized and detachably mounted, it is possible to improve the attaching property and the maintenance property. For example, since it is not necessary to wire the electric components in the main body, it is possible to avoid troublesome of the attaching and disconnection.

(10) The pneumatic tool according to the invention (9), further comprising a grip housing that can be gripped by an operator, wherein a main chamber configured to store therein the compressed air is formed inside of the grip housing, and a grip end member configured to close the main chamber is attached to an end portion of the grip housing, and wherein the control unit is attached to the grip end member.

(11) The pneumatic tool according to the invention (9) or (10), wherein a switch for the electromagnetic valve, configured to switch opened and closed states of the electromagnetic valve, and a pilot valve configured to be actuated in conjunction with the electromagnetic valve so as to switch a flow path of the compressed air are unitized to configure an activation unit, and the activation unit is detachably mounted integrally to the tool main body.

(12) The pneumatic tool according to the invention (11), wherein the control unit and the activation unit can be individually attached to the tool main body, and can be interconnected inside of the tool main body.

(13) The pneumatic tool according to any one of the inventions (9) to (12), further comprising an air-type control unit as an alternative to the control unit, wherein the air-type control unit includes a trigger valve configured to be mechanically actuated, instead of the electromagnetic valve, and wherein the air-type control unit is attached to the tool main body, instead of the control unit, so that the drive mechanism can be actuated without using electricity.

(14) A pneumatic tool comprising:

a drive mechanism configured to be actuated by a pneumatic pressure of compressed air, an electromagnetic valve configured to control supply of the compressed air to the drive mechanism, a switch for the electromagnetic valve, configured to switch opened and closed states of the electromagnetic valve, an operation part provided to be operable by an operator so as to press the switch for the electromagnetic valve, and a safety mechanism for performing control so that the compressed air is not supplied to the drive mechanism until the operation part is operated, wherein the safety mechanism is actuated in conjunction with the operation part when the operation part is operated and thus shifts from an ineffective state in which the compressed air cannot be supplied to the drive mechanism to an effective state in which the compressed air can be supplied to the drive mechanism.

According to the invention (14), the safety mechanism for performing control so that the compressed air is not supplied to the drive mechanism until the operation part is operated is provided, and the safety mechanism is actuated in conjunction with the operation part when the operation part is operated and thus shifts from the ineffective state in which the compressed air cannot be supplied to the drive mechanism to the effective state in which the compressed air can be supplied to the drive mechanism. That is, when the safety mechanism is in the ineffective state, even though the electronic component such as the electromagnetic valve malfunctions, the compressed air is not supplied to the drive mechanism. According to this configuration, even when the electronic component malfunctions due to any cause, the compressed air is not supplied to the drive mechanism until the operation part is operated to release the safety mechanism. Therefore, it is possible to prevent an unintentional actuation, thereby increasing the safety.

(15) The pneumatic tool according to the invention (14), wherein the safety mechanism includes a trigger stem that is mechanically actuated when the operation part is operated, and wherein the ineffective state and the effective state are switched by the trigger stem.

(16) The pneumatic tool according to the invention (14), further comprising a control substrate configured to control actuations of the electromagnetic valve, wherein the safety mechanism is configured to disconnect electrical connection between the electromagnetic valve and the control substrate in the ineffective state, and to energize the electromagnetic valve and the control substrate in the effective state.

(17) The pneumatic tool according to any one of the inventions (14) to (16), further comprising a contact member that is slid when pressed to an operation target member, wherein when both the operation part and the contact member are operated, the safety mechanism shifts from the ineffective state to the effective state.

(18) The pneumatic tool according to the invention (17), further comprising a contact switch that is pressed when the contact member is slid, wherein when the contact member is slid, the safety mechanism becomes in the effective state before the contact switch becomes on.

(19) A pneumatic tool comprising:

a drive mechanism configured to be actuated by a pneumatic pressure of compressed air, an electromagnetic valve configured to control supply of the compressed air to the drive mechanism, a control substrate configured to control actuations of the electromagnetic valve, a main power supply switch configured to switch on and off states of supply of power, and a joint to which a hose for supplying the compressed air from an outside is detachably mounted, wherein the main power supply switch is configured to be switched between on and off states by an operation of detachably mounting the hose to the joint.

According to the invention (19), the main power supply switch is configured to be switched between on and off states by an operation of detachably mounting the hose to the joint. According to this configuration, the on and off states of the main power supply switch are switched depending on whether the hose for supplying the compressed air is connected. Therefore, it is possible to suppress useless energization when not in-use, thereby saving the power.

(20) The pneumatic tool according to the invention (19), further comprising a first piston that is actuated by a pneumatic pressure of the compressed air supplied from the hose, wherein the main power supply switch is arranged so that it can be pressed by the first piston.

(21) The pneumatic tool according to the invention (20), further comprising a second piston configured to slidably hold the first piston, wherein when the pneumatic pressure of the compressed air supplied from the hose is within a predetermined range, only the first piston is slid to press the main power supply switch, and wherein when the pneumatic pressure of the compressed air supplied from the hose exceeds the predetermined range, the second piston is slid in an opposite direction to a slide direction of the first piston, so that the main power supply switch is not pressed.

(22) The pneumatic tool according to the invention (19), wherein the joint has a socket main body to which a plug attached to a tip end of the hose can be detachably mounted, and a sleeve member provided to be slidable on an outer periphery of the socket main body, and wherein when the plug is mounted to the socket main body, the sleeve member is pushed in by the plug and the main power supply switch is pressed by the pushed-in sleeve member.

The invention claimed is:

1. A pneumatic tool comprising:

a drive mechanism including a piston configured to be actuated by a pneumatic pressure of compressed air, the piston configured to eject a striking target upon actuation by the pneumatic pressure of compressed air;

a body housing having the drive mechanism embedded therein;

a grip housing connected to the body housing, the grip housing including a first end and a second end that are opposite to each other along a longitudinal direction of the grip housing;

an electromagnetic valve configured to control supply of the compressed air to the drive mechanism; and a valve stem configured to be actuated by the electromagnetic valve and extending in the longitudinal direction from the first end to an air switching part arranged closer to the second end of the grip housing than the first end of the grip housing along the longitudinal direction, wherein upon actuation of the electromagnetic valve, the valve stem moves in the longitudinal direction of the grip housing to move the air switching part, wherein the electromagnetic valve is arranged on the first end of the grip housing and the drive mechanism is arranged on the second end of the grip housing, and wherein, upon actuation by the pneumatic pressure of the compressed air, the piston of the drive mechanism is configured to move in a direction substantially perpendicular to an axis that is arranged along the longitudinal direction of the grip housing.

2. The pneumatic tool according to claim 1, wherein the electromagnetic valve is insertable into the first end of the grip housing.

3. The pneumatic tool according to claim 1, further comprising a switch for the electromagnetic valve, configured to switch opened and closed states of the electromagnetic valve, wherein the switch for the electromagnetic valve is arranged on the first end side of the grip housing.

4. The pneumatic tool according to claim 3, further comprising a control substrate configured to control an actuation of the electromagnetic valve, wherein the switch for the electromagnetic valve is connected to a power supply terminal of the control substrate without electrical wiring.

5. The pneumatic tool according to claim 1, further comprising a control substrate configured to control an actuation of the electromagnetic valve, wherein the control substrate is arranged on the first end of the grip housing.

6. The pneumatic tool according to claim 1, wherein a moving direction of a movable iron core of the electromagnetic valve is arranged so as to be different from an occurrence direction of impact that is generated when the drive mechanism is actuated.

7. The pneumatic tool according to claim 6, wherein the moving direction of the movable iron core of the electromagnetic valve is along the longitudinal direction of the grip housing.

8. The pneumatic tool according to claim 1, wherein a moving direction of a valve body of the electromagnetic valve is arranged along the axis that passes through the grip housing.

9. The pneumatic tool according to claim 1, wherein the valve stem is configured to be actuated in conjunction with the electromagnetic valve and is arranged inside of the grip housing, and wherein the valve stem is moved in the longitudinal direction of the grip housing, so that supply of the compressed air to the drive mechanism is executed.

10. The pneumatic tool according to claim 9, wherein the electromagnetic valve and valve stem are detachable from the grip housing.

11. The pneumatic tool according to claim 9, wherein the grip housing includes a chamber configured to hold the compressed air, and wherein upon actuation of the electromagnetic valve, the valve stem moves in the longitudinal direction of the grip housing to move the air switching part from a standby position to an actuation position, and wherein the air switching part in the actuation position enables supply of compressed air from the chamber to the piston of the drive mechanism.

12. The pneumatic tool according to claim 9, wherein the electromagnetic valve and the valve stem are detachable from the first end of the grip housing, wherein upon insertion of the electromagnetic valve and the valve stem into the first end of the grip housing, the electromagnetic valve and the valve stem are inserted in the longitudinal direction of the grip housing.

13. The pneumatic tool according to claim 1, wherein the electromagnetic valve is detachable from the grip housing.

14. The pneumatic tool according to claim 1, wherein the electromagnetic valve is arranged on the first end of the grip housing such that the axis passes through the electromagnetic valve.

15. The pneumatic tool according to claim 1, further comprising:

a control unit including the electromagnetic valve and a power supply terminal configured to connect to a battery, wherein the control unit is arranged on the first end of the grip housing.

* * * * *